US011587518B2

(12) United States Patent
Takahashi et al.

(10) Patent No.: US 11,587,518 B2
(45) Date of Patent: Feb. 21, 2023

(54) DISPLAY DEVICE, SEMICONDUCTOR DEVICE, AND ELECTRONIC DEVICE

(71) Applicant: Semiconductor Energy Laboratory Co., Ltd., Kanagawa-ken (JP)

(72) Inventors: Kei Takahashi, Kanagawa (JP); Koji Kusunoki, Kanagawa (JP); Susumu Kawashima, Kanagawa (JP); Shigeru Onoya, Kanagawa (JP); Takahiro Fukutome, Kanagawa (JP); Shunpei Yamazaki, Tokyo (JP)

(73) Assignee: Semiconductor Energy Laboratory Co., Ltd.

( * ) Notice: Subject to any disclaimer, the term of this patent is extended or adjusted under 35 U.S.C. 154(b) by 0 days.

(21) Appl. No.: 16/955,306

(22) PCT Filed: Dec. 10, 2018

(86) PCT No.: PCT/IB2018/059811
§ 371 (c)(1),
(2) Date: Jun. 18, 2020

(87) PCT Pub. No.: WO2019/123089
PCT Pub. Date: Jun. 27, 2019

(65) Prior Publication Data

US 2021/0090513 A1 Mar. 25, 2021

(30) Foreign Application Priority Data

Dec. 22, 2017 (JP) ..... JP2017-245920
Feb. 19, 2018 (JP) ..... JP2018-027234

(51) Int. Cl.
*G09G 3/36* (2006.01)
*G09G 3/3233* (2016.01)
*G09G 3/3275* (2016.01)

(52) U.S. Cl.
CPC ..... *G09G 3/36* (2013.01); *G09G 3/3233* (2013.01); *G09G 3/3275* (2013.01)

(58) Field of Classification Search
CPC ..... G09G 3/36; G09G 3/3233; G09G 3/3275
See application file for complete search history.

(56) References Cited

U.S. PATENT DOCUMENTS 5,903,248 A 5/1999 Irwin
6,600,436 B2 7/2003 Tanaka
(Continued)

FOREIGN PATENT DOCUMENTS

CN 001573452 A 2/2005
CN 101490962 A 7/2009
(Continued)

OTHER PUBLICATIONS

International Search Report (Application No. PCT/IB2018/059811) dated Apr. 2, 2019.
(Continued)

*Primary Examiner* — Stacy Khoo
(74) *Attorney, Agent, or Firm* — Husch Blackwell LLP

(57) ABSTRACT

A semiconductor device includes a display device and a source driver. Each of a plurality of pixels included in the display device is supplied with a first data potential and a second data potential included in a range of a first potential or higher to a second potential or lower. The first data potential makes the pixel display an image with a first gray level. The pixel performs calculation with the first data potential and the second data potential to generate a third data potential. The third data potential makes the pixel display an image with a second gray level. A reference potential of the first data potential is an intermediate potential between the first potential and the second potential, and the gray level width that can be displayed by the second data
(Continued)

potential is larger than the gray level width that can be displayed by the first data potential.

4 Claims, 24 Drawing Sheets

(56) References Cited

U.S. PATENT DOCUMENTS

| | | | | |
|---|---|---|---|---|
| 7,224,338 | B2 | 5/2007 | Yamada | |
| 8,054,393 | B2 | 11/2011 | Takahashi | |
| 8,421,784 | B2 | 4/2013 | Zebedee | |
| 8,519,990 | B2 | 8/2013 | Yamazaki et al. | |
| 8,884,852 | B2 | 11/2014 | Yamamoto et al. | |
| 8,976,090 | B2 | 3/2015 | Yamamoto et al. | |
| 9,165,523 | B2 | 10/2015 | Funayama et al. | |
| 9,324,263 | B2 * | 4/2016 | Sugimoto | G09G 3/2014 |
| 2002/0186157 | A1 | 12/2002 | Tanaka | |
| 2004/0174329 | A1 | 9/2004 | Yamada | |
| 2005/0024317 | A1 | 2/2005 | Sano | |
| 2007/0164946 | A1 * | 7/2007 | Akutsu | G09G 3/36 345/87 |
| 2010/0238146 | A1 | 9/2010 | Zebedee | |
| 2010/0289830 | A1 * | 11/2010 | Yamamoto | G09G 3/3233 345/690 |
| 2012/0062537 | A1 | 3/2012 | Jeong et al. | |
| 2012/0162287 | A1 | 6/2012 | Funayama et al. | |
| 2012/0223978 | A1 | 9/2012 | Yamamoto et al. | |
| 2012/0236222 | A1 | 9/2012 | Kim et al. | |
| 2012/0249509 | A1 | 10/2012 | Kim et al. | |
| 2013/0069717 | A1 * | 3/2013 | Kim | G09G 3/3614 330/9 |
| 2016/0225859 | A1 * | 8/2016 | Takata | H01L 27/14658 |
| 2020/0193928 | A1 | 6/2020 | Kawashima et al. | |

FOREIGN PATENT DOCUMENTS

| | | | |
|---|---|---|---|
| CN | 101887689 | A | 11/2010 |
| CN | 102568419 | A | 7/2012 |
| CN | 102654979 | A | 9/2012 |
| JP | 09-275345 | A | 10/1997 |
| JP | 2001-520762 | | 10/2001 |
| JP | 2002-359559 | A | 12/2002 |
| JP | 2004-274335 | A | 9/2004 |
| JP | 2005-010697 | A | 1/2005 |
| JP | 2007-028662 | A | 2/2007 |
| JP | 2009-109600 | A | 5/2009 |
| JP | 2009-541781 | | 11/2009 |
| JP | 2010-266494 | A | 11/2010 |
| JP | 2011-227479 | A | 11/2011 |
| JP | 2012-141393 | A | 7/2012 |
| JP | 4970472 | B2 | 7/2012 |
| JP | 2012-185328 | A | 9/2012 |
| KR | 2004-0080338 | A | 9/2004 |
| KR | 10-0608967 | B1 | 8/2006 |
| KR | 2010-0122443 | A | 11/2010 |
| WO | WO 1998/047131 | A2 | 10/1998 |
| WO | WO 2008/018622 | A1 | 2/2008 |

OTHER PUBLICATIONS

Written Opinion (Application No. PCT/IB2018/059811) dated Apr. 2, 2019.

Yamazaki, S. et al., "Research, Development, and Application of Crystalline Oxide Semiconductor," SID Digest '12: SID International Symposium Digest of Technical Papers, Jun. 5, 2012, vol. 43, No. 1, pp. 183-186.

Yamazaki, S. et al., "Properties of Crystalline In—Ga—Zn-oxide Semiconductor and its Transistor Characteristics," Japanese Journal of Applied Physics, Mar. 31, 2014, vol. 53, No. 4S, pp. 04ED18-1-04ED18-10.

Ito, S. et al., "Analysis of Nanoscale Crystalline Structure of In—Ga—Zn—O Thin Film with Nano Beam Electron Diffraction," AM-FPD '13 Digest of Technical Papers, Jul. 2, 2013, pp. 151-154.

Yamazaki, S. et al., "In—Ga-—Zn-Oxide Semiconductor and Its Transistor Characteristics," ECS Journal of Solid State Science and Technology, Jul. 1, 2014, vol. 3, No. 9, pp. Q3012-Q3022.

Yamazaki, S., "Crystalline Oxide Semiconductor Using CAAC-IGZO and its Application," ECS Transactions, Oct. 1, 2014, vol. 64, No. 10, pp. 155-164, The Electrochemical Society.

Kato, K. et al., "Evaluation of Off-State Current Characteristics of Transistor Using Oxide Semiconductor Material, Indium-Gallium-Zinc Oxide," Japanese Journal of Applied Physics, 2012, vol. 51, pp. 021201-1-021201-7.

Matsuda, S. et al., "30-nm-Channel-Length C-Axis Aligned Crystalline In—Ga—Zn—O Transistors with Low Off-State Leakage Current and Steep Subthreshold Characteristics," 2015 Symposium On VLSI Technology : Digest of Technical Papers, 2015, pp. T216-T217.

Amano, S. et al., "Low Power LC Display Using In—Ga—Zn-Oxide TFTs Based on Variable Frame Frequency," SID Digest '10: SID International Symposium Digest of Technical Papers, May 23, 2010, vol. 41, No. 1, pp. 626-629.

Ryu, S. et al., "A 13-bit Universal Column Driver for Various Displays of OLED and LCD," Journal of the Society for Information Display, May 4, 2016, vol. 24, No. 5, pp. 277-285.

* cited by examiner

FIG. 15A
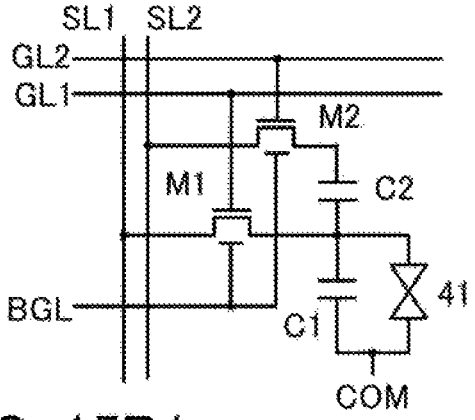
FIG. 15B1
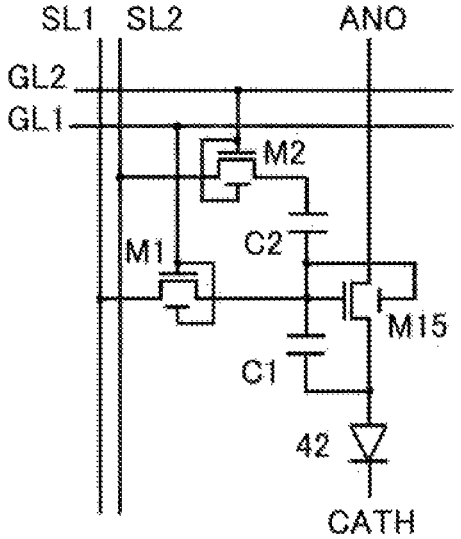
FIG. 15B2
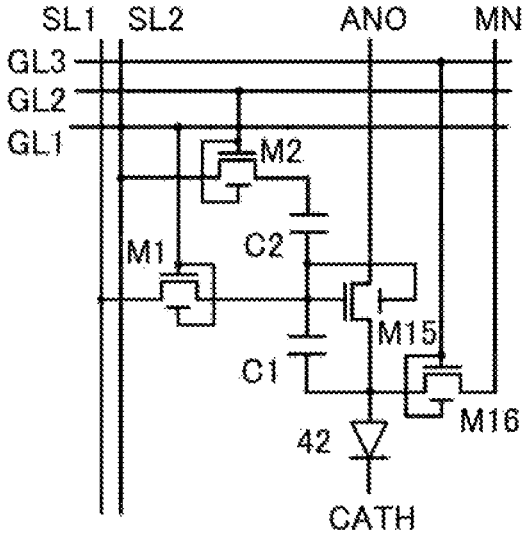
FIG. 15B3
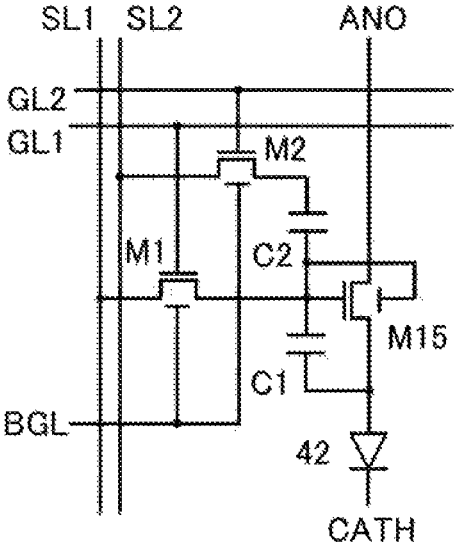
FIG. 15B4
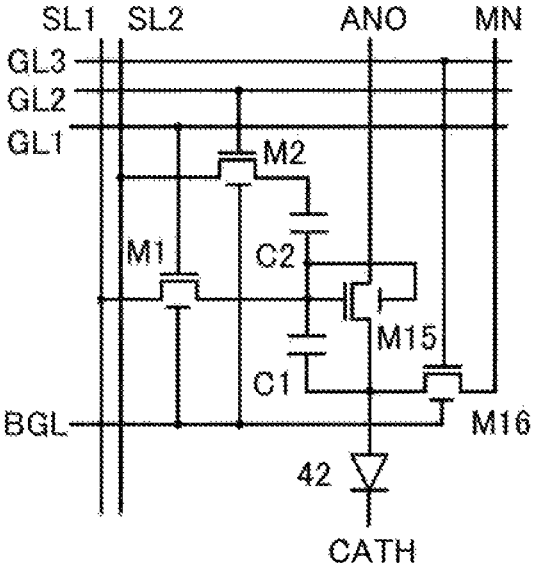

FIG. 16A1
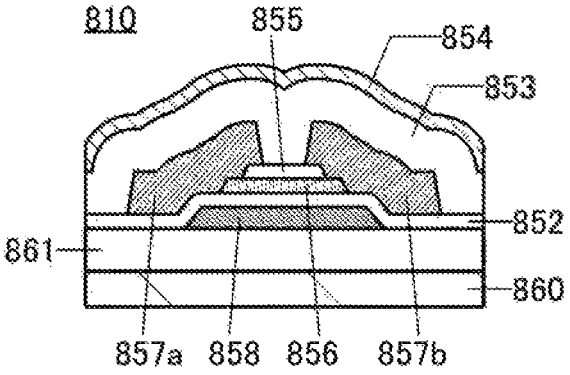
FIG. 16A2
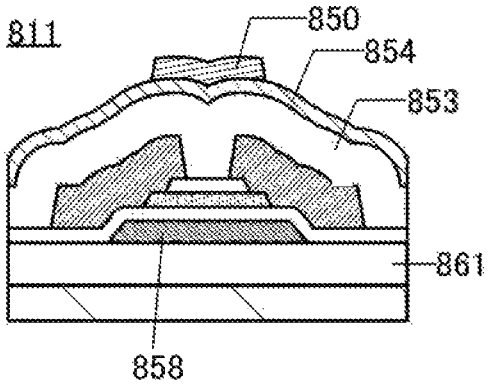
FIG. 16B1
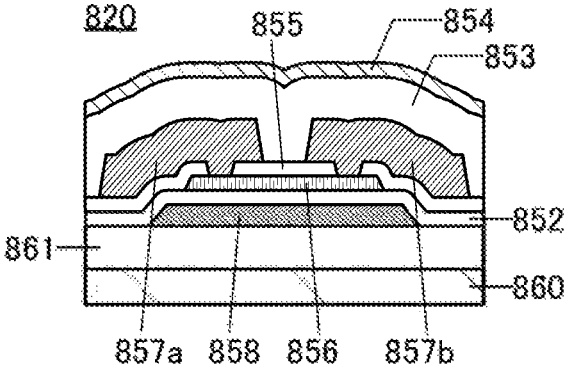
FIG. 16B2
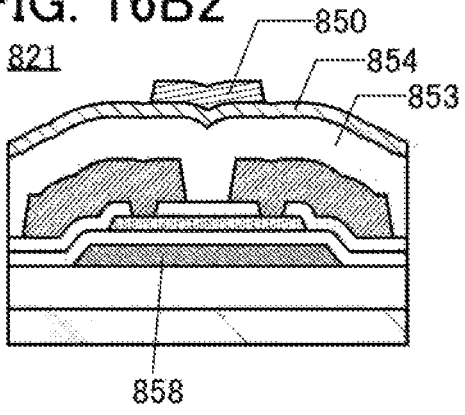
FIG. 16C1
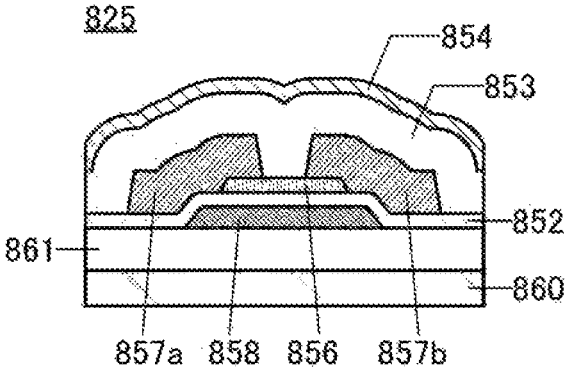
FIG. 16C2
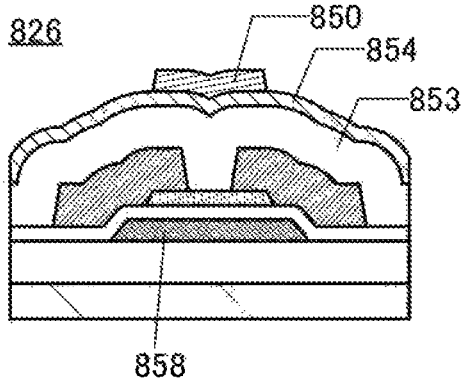

FIG. 17A1
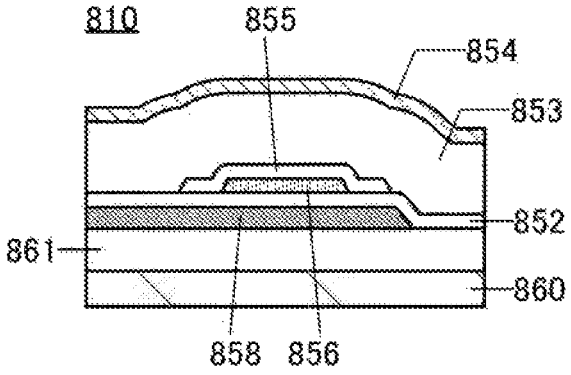
FIG. 17A2
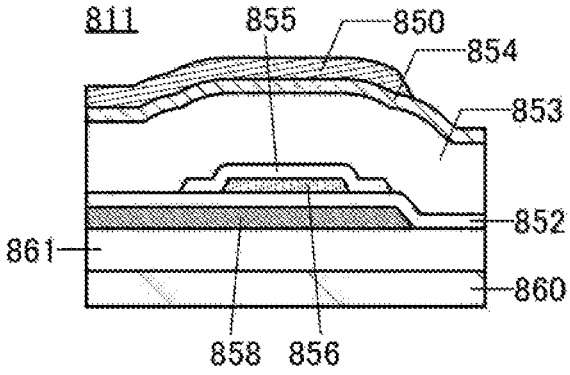
FIG. 17B1
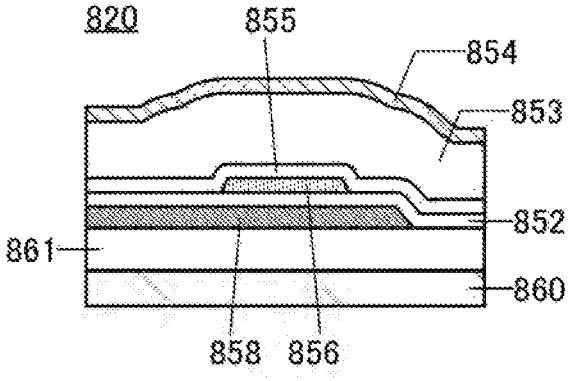
FIG. 17B2
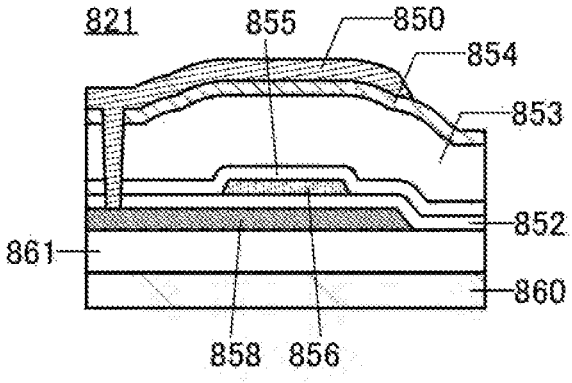
FIG. 17C1
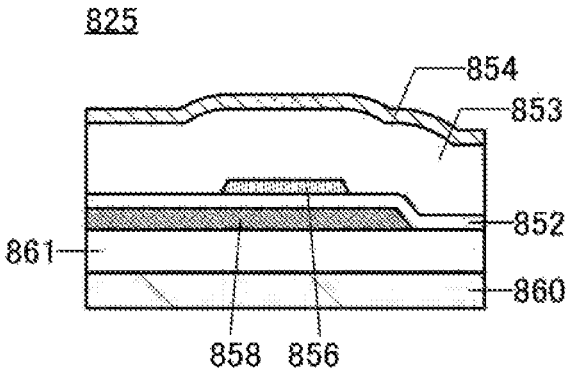
FIG. 17C2
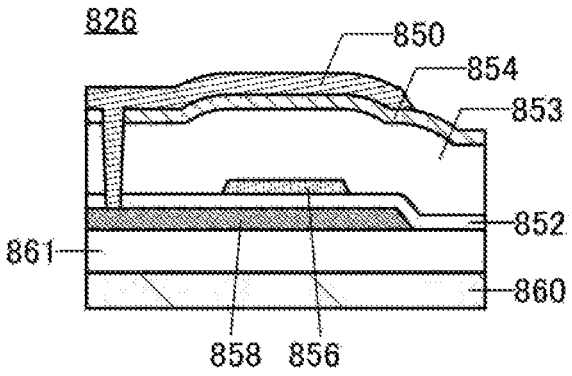

FIG. 18A1
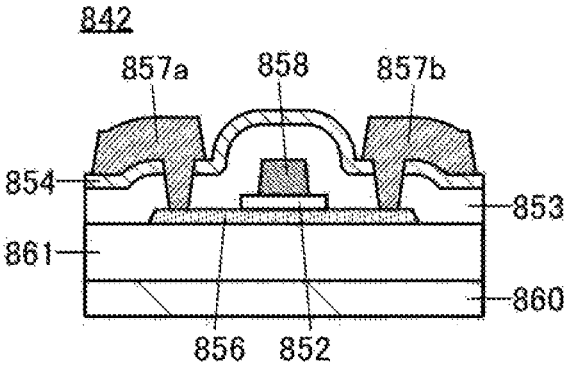
FIG. 18A2
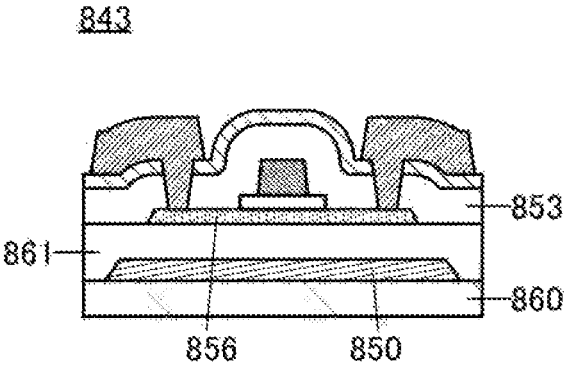
FIG. 18B1
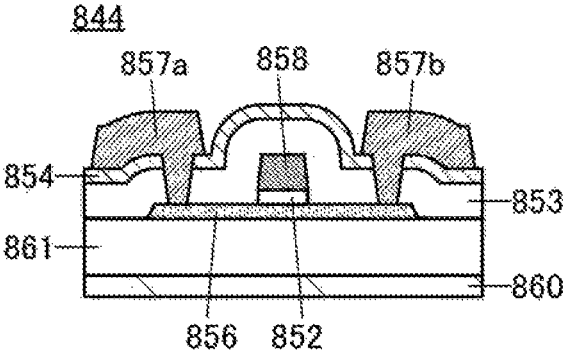
FIG. 18B2
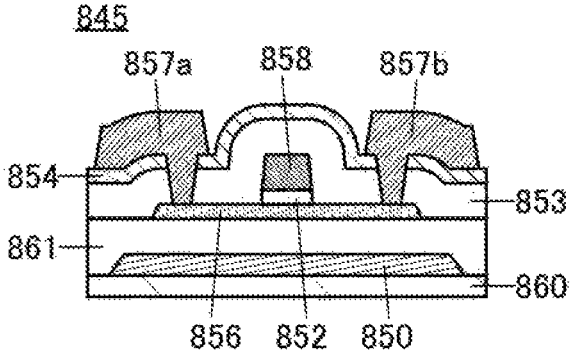
FIG. 18C1
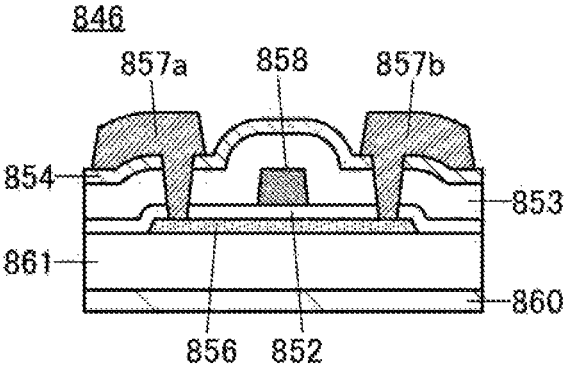
FIG. 18C2
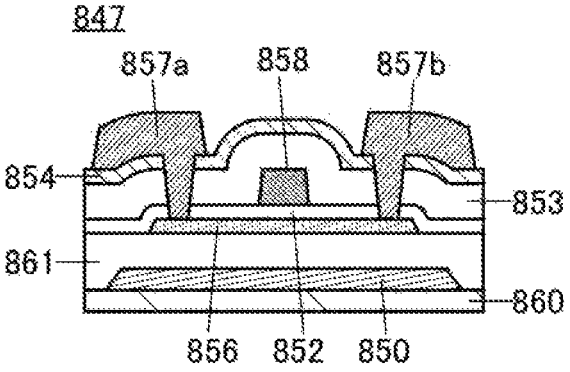

FIG. 19A1
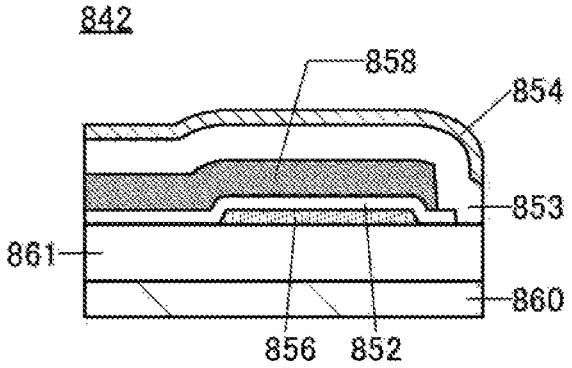
FIG. 19A2
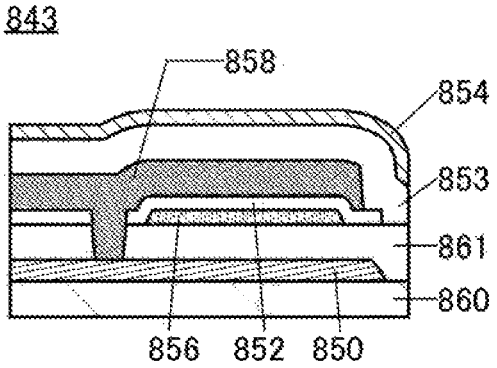
FIG. 19B1
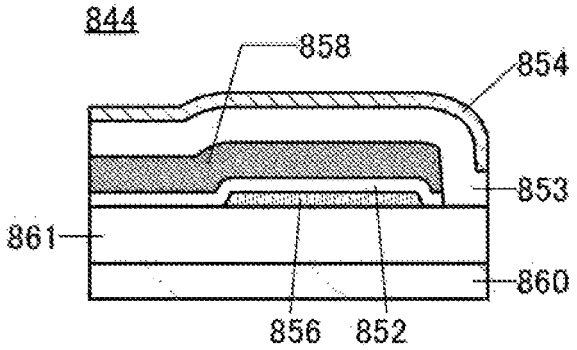
FIG. 19B2
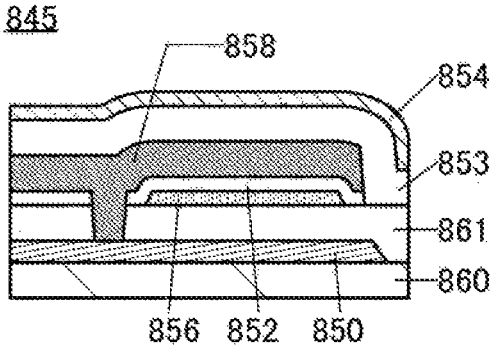
FIG. 19C1
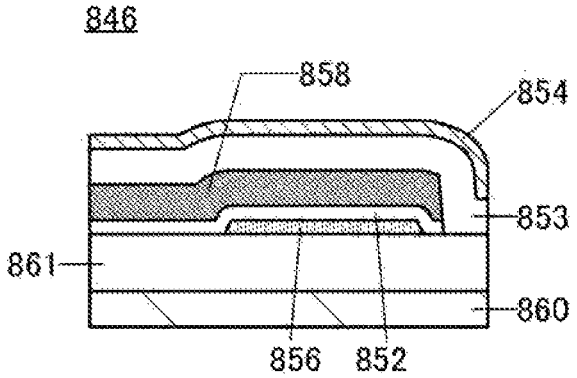
FIG. 19C2
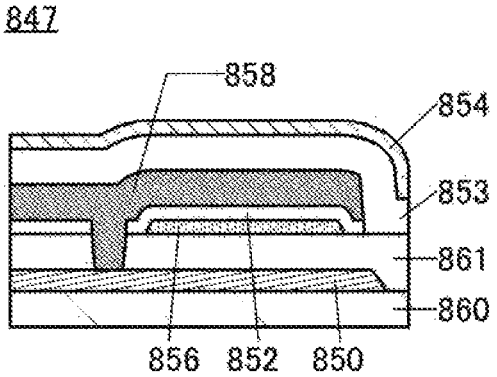

9100

9200

9101

9201

9201

9102

9201

DISPLAY DEVICE, SEMICONDUCTOR DEVICE, AND ELECTRONIC DEVICE

This application is a 371 of international application PCT/IB2018/059811 filed on Dec. 10, 2018 which is incorporated herein by reference.

TECHNICAL FIELD

One embodiment of the present invention relates to a display device, a semiconductor device, and an electronic device.

Furthermore, one embodiment of the present invention relates to an object, a method, or a manufacturing method. Alternatively, one embodiment of the present invention relates to a process, a machine, manufacture, or a composition of matter. One embodiment of the present invention relates to a driving method thereof or a manufacturing method thereof.

In this specification and the like, a semiconductor device generally means a device that can function by utilizing semiconductor characteristics. A memory device, a display device, an electro-optical device, a power storage device, a semiconductor circuit, and an electronic device include a semiconductor device in some cases.

BACKGROUND ART

A silicon-based semiconductor material is widely known as a semiconductor thin film that can be used in a transistor; in addition, an oxide semiconductor has been attracting attention as another material. As an example of the oxide semiconductor, not only single-component metal oxides such as indium oxide and zinc oxide but also multi-component metal oxides are known. Among the multi-component metal oxides, in particular, an In—Ga—Zn oxide (hereinafter also referred to as IGZO) has been actively studied.

From the studies on IGZO, a CAAC (c-axis aligned crystalline) structure and an nc (nanocrystalline) structure, which are not single crystal nor amorphous, have been found in an oxide semiconductor (see Non-Patent Document 1 to Non-Patent Document 3). Non-Patent Document 1 and Non-Patent Document 2 also disclose a technique for fabricating a transistor using an oxide semiconductor having a CAAC structure. Moreover, Non-Patent Document 4 and Non-Patent Document 5 show that a fine crystal is included even in an oxide semiconductor which has lower crystallinity than the CAAC structure or the nc structure.

In addition, a transistor that uses IGZO for an active layer has an extremely low off-state current (see Non-Patent Document 6), and an LSI and a display utilizing the characteristics have been reported (see Non-Patent Document 7 and Non-Patent Document 8).

In addition, a driver circuit has been reported in which data corresponding to a gamma value of a display element can be output owing to a high-resolution digital-analog converter circuit included in the driver circuit (see Non-Patent Document 9).

In addition, Patent Document 1 discloses a semiconductor device in which a display element included in a display device can be driven at a high voltage.

REFERENCE

Patent Document

[Patent Document 1] Japanese Published Patent Application No. 2011-227479

Non-Patent Document

[Non-Patent Document 1] S. Yamazaki et al., "SID Symposium Digest of Technical Papers", 2012, volume 43, issue 1, pp. 183-186.

[Non-Patent Document 2] S. Yamazaki et al., "Japanese Journal of Applied Physics", 2014, volume 53, Number 4S, pp. 04ED18-1-04ED18-10.

[Non-Patent Document 3] S. Ito et al., "The Proceedings of AM-FPD'13 Digest of Technical Papers", 2013, pp. 151-154.

[Non-Patent Document 4] S. Yamazaki et al., "ECS Journal of Solid State Science and Technology", 2014, volume 3, issue 9, pp. Q3012-Q3022.

[Non-Patent Document 5] S. Yamazaki, "ECS Transactions", 2014, volume 64, issue 10, pp. 155-164.

[Non-Patent Document 6] K. Kato et al., "Japanese Journal of Applied Physics", 2012, volume 51, pp. 021201-1-021201-7.

[Non-Patent Document 7] S. Matsuda et al., "2015 Symposium on VLSI Technology Digest of Technical Papers", 2015, pp. T216-T217.

[Non-Patent Document 8] S. Amano et al., "SID Symposium Digest of Technical Papers", 2010, volume 41, issue 1, pp. 626-629.

[Non-Patent Document 9] Seong-Young Ryu et al., "Journal of the SID", 2016, volume 24, issue 5, pp. 277-285.

SUMMARY OF THE INVENTION

Problems to be Solved by the Invention

An object of one embodiment of the present invention is to provide a novel display device. Another object of one embodiment of the present invention is to provide a novel method for driving a display device. Another object of one embodiment of the present invention is to provide a semiconductor device that suppresses an increase in power consumption. Another object of one embodiment of the present invention is to provide a semiconductor device that holds data without being influenced by temperature change.

Note that the description of a plurality of objects does not preclude the existence of each object. One embodiment of the present invention does not necessarily achieve all these objects. Objects other than those listed above will be apparent from the description of the specification, the drawings, the claims, and the like, and such objects could be objects of one embodiment of the present invention.

Means for Solving the Problems

One embodiment of the present invention is a display device including a pixel; the pixel is supplied with a first data potential and a second data potential included in the range of a first potential or higher to a second potential or lower. The first data potential has a function of making the pixel display an image with a first gray level. The pixel has a function of performing calculation with the first data potential and the second data potential to generate a third data potential. The third data potential has a function of making the pixel display an image with a second gray level. A reference potential of the first data potential is an intermediate potential between the first potential and the second potential, and a gray level width that can be displayed by the second data potential is larger than a gray level width that can be displayed by the first data potential.

In the above embodiment, the display device includes the pixel, a first wiring, a second wiring, a third wiring, a fourth wiring, and a fifth wiring. The pixel includes a first transistor, a second transistor, a first capacitor, a second capacitor, and a display element. A gate of the first transistor is electrically connected to the third wiring. One of a source and a drain of the first transistor is electrically connected to the first wiring. The other of the source and the drain of the first transistor is electrically connected to one electrode of the first capacitor, one electrode of the second capacitor, and one electrode of the display element. A gate of the second transistor is electrically connected to the fourth wiring. One of a source and a drain of the second transistor is electrically connected to the second wiring. The other of the source and the drain of the second transistor is electrically connected to the other electrode of the second capacitor. The fifth wiring is electrically connected to the other electrode of the first capacitor and the other electrode of the display element.

In the above embodiment, the display device preferably includes a liquid crystal element as the display element included in the pixel.

In the above embodiment, in the display device, the first transistor or the second transistor preferably includes a metal oxide in a semiconductor layer.

One embodiment of the present invention is a semiconductor device including a display device, a source driver, a first wiring, and a second wiring. The display device includes a pixel. The source driver includes a digital-analog converter circuit, a buffer circuit, a first switch, a second switch, a third switch, a fourth switch, and a switch control circuit. The pixel is electrically connected to the first wiring and the second wiring. The digital-analog converter circuit includes a first output terminal, a second output terminal, and a third output terminal. The first output terminal is electrically connected to a first input terminal included in the buffer circuit. An output terminal of the buffer circuit is electrically connected to one electrode of the third switch, one electrode of the fourth switch, and a second input terminal included in the buffer circuit. The second output terminal is electrically connected to one electrode of the first switch. The third output terminal is electrically connected to one electrode of the second switch. The first wiring is electrically connected to the other electrode of the fourth switch. The second wiring is electrically connected to the other electrode of the first switch, the other electrode of the second switch, and the other electrode of the third switch. The switch control circuit can control the first switch, the second switch, the third switch, and the fourth switch independently. The first output terminal can output a voltage in the range of a first potential to a second potential. The second output terminal can output the first potential. The third output terminal outputs the second potential.

An electronic device including the above-described semiconductor device and a temperature sensor is preferable.

Effect of the Invention

According to one embodiment of the present invention, a novel display device can be provided. According to one embodiment of the present invention, a novel method for driving a display device can be provided. According to one embodiment of the present invention, a semiconductor device that suppresses an increase in power consumption can be provided. According to one embodiment of the present invention, a semiconductor device that holds data without being influenced by temperature change can be provided.

Note that the description of the effects do not disturb the existence of other effects. One embodiment of the present invention does not have to have all of these effects. Effects other than these will be apparent from the description of the specification, the drawings, the claims, and the like and effects other than these can be derived from the description of the specification, the drawings, the claims, and the like.

BRIEF DESCRIPTION OF THE DRAWINGS

FIG. 10 Circuit

FIG. 13 Circuit

FIGS. 15A-15B4 are circuit diagrams each illustrating a structure example of a pixel.

FIGS. 16A1-16C2 are cross-sectional views each illustrating a structure example of a transistor.

FIGS. 17A1-17C2 are cross-sectional views each illustrating a structure example of a transistor.

FIGS. 18A1-18C2 are cross-sectional views each illustrating a structure example of a transistor.

FIGS. 19A1-19C2 are cross-sectional views each illustrating a structure example of a transistor.

MODE FOR CARRYING OUT THE INVENTION

Figure 1A:
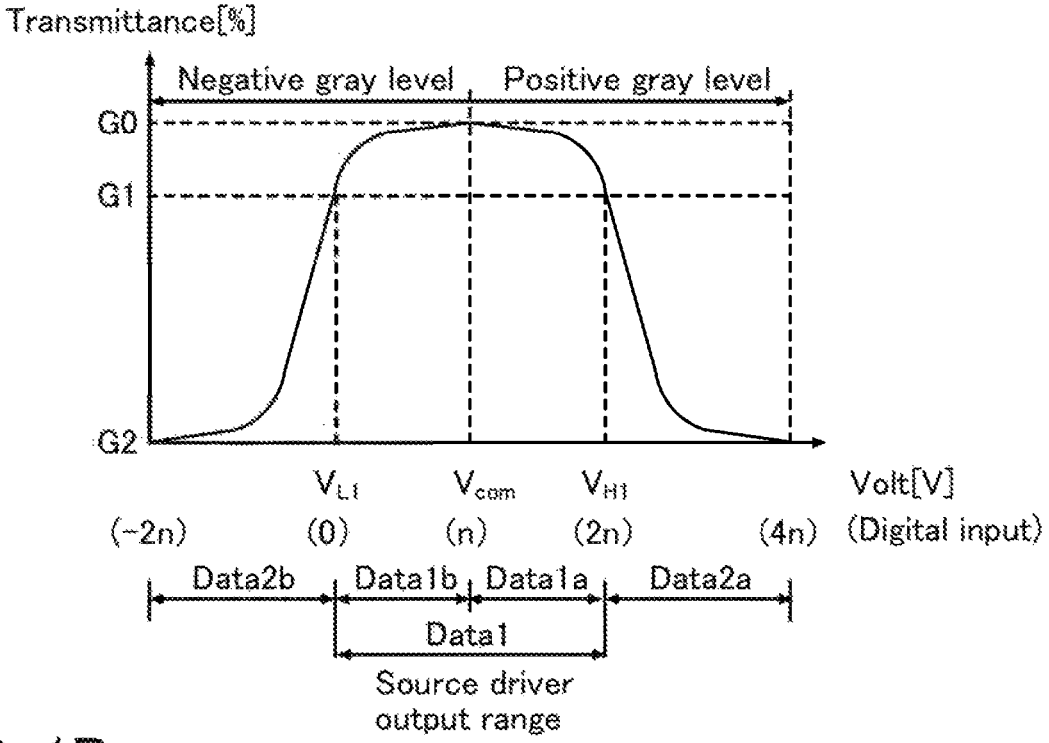
FIGS. 1A-1B are drawings showing gray level characteristics of a display element.

Embodiments of the present invention will be described in detail with reference to the drawings. Note that the present invention is not limited to the following description, and it will be readily appreciated by those skilled in the art that modes and details of the present invention can be modified in various ways without departing from the spirit and scope of the present invention. Thus, the present invention should not be construed as being limited to the description in the following embodiments.

Note that in structures of the invention described below, the same portions or portions having similar functions are denoted by the same reference numerals in different drawings, and explanation thereof is omitted. Furthermore, the same hatching pattern is applied to portions having similar functions, and the portions are not especially denoted by reference numerals in some cases.

Note that in each drawing described in this specification, the size, the layer thickness, or the region of each component is exaggerated for clarity in some cases. Therefore, they are not limited to the illustrated scale.

Note that in this specification, a high power supply voltage and a low power supply voltage are sometimes referred to as an H level (or $V_{DD}$) and an L level (or GND), respectively.

In this specification, the embodiments described below can be combined as appropriate. In the case where a plurality of structure examples are described in one embodiment, the structure examples can be combined as appropriate.

In this specification and the like, a metal oxide is an oxide of metal in a broad sense. Metal oxides are classified into an oxide insulator, an oxide conductor (including a transparent oxide conductor), an oxide semiconductor, and the like. For example, in the case where a metal oxide is used in a semiconductor layer of a transistor, the metal oxide is referred to as an oxide semiconductor in some cases. In the case where an OS transistor is mentioned, the OS transistor can also be referred to as a transistor including a metal oxide or an oxide semiconductor. In this specification and the like, a metal oxide containing nitrogen is also referred to as a metal oxide in some cases.

Embodiment 1

FIG. 1 is diagrams showing the gray level characteristics of a display element included in a display device. The display device includes a plurality of pixels, and the pixels each include a display element. Although the case where the display element is a liquid crystal element is described as an example, the display element is not limited to a liquid crystal element. For example, the display element may be an EL (Electroluminescence) element, a micro LED in which a plurality of LEDs (Light Emitting Diode) are arranged in an array, or the like. In the present invention, a method for controlling the gray level of a display element by a potential is described. For example, in a semiconductor device including a display device and a source driver, power consumption is reduced by lowering the output voltage of the source driver. With the lowered output voltage of the source driver, display with a gray level higher than the gray level that a liquid crystal element can display can be performed. Note that unless otherwise specified in this specification, the gray level characteristics can be rephrased as the response characteristics, and the response characteristics can be rephrased as the gray level characteristics.

The case where the display element is a liquid crystal element is described below. For example, a liquid crystal element has a response characteristic called the gamma value. The gamma value is a numerical value representing a response characteristic of a gray level with respect to a voltage supplied to a liquid crystal element, and it is known that different response characteristics are exhibited depending on a low gray level range, a middle gray level range, and a high gray level range. As a method for correcting the above different response characteristics, there is a correction method in which a gamma correction coefficient for converting the transmittance of a liquid crystal element into a linear characteristic is multiplied. Another method is known in which the response characteristics of a liquid crystal element are controlled as they are by finely controlling a voltage supplied to the liquid crystal element and corresponding to one gray level. Note that in order to finely control a voltage supplied to a liquid crystal element, the resolution of a digital-analog converter circuit included in a display device needs to be increased. In addition, in the low gray level range or the high gray level range, the amount of change in transmittance with respect to the voltage is small. Accordingly, in order to further finely control the transmittance in the low gray level range or the high gray level range, the resolution of a potential supplied to a liquid crystal element is increased or the maximum potential supplied to a liquid crystal element is increased, whereby the transmittance in the low gray level range or the high gray level range can be improved.

First, a semiconductor device is briefly described. Detailed description will be made with reference to FIG. 2: the semiconductor device includes a display device, a gate driver that selects a pixel, and a source driver that supplies data to a pixel. Note that the display device may include a gate driver and may further include a source driver.

In FIG. 1(A), the x axis represents a potential (Volt) supplied to a liquid crystal element, and the y axis represents the transmittance with respect to the potential supplied to the liquid crystal element. The liquid crystal element described here has the gray level characteristics from a minimum gray level G0 to a maximum gray level G2. Note that FIG. 1(A) shows an example of a liquid crystal element having the maximum transmittance at the minimum gray level G0. That is, an example is shown in which the display mode of the display device is normally white operation.

As an example, display data in the range of a digital input code "0" to a digital input code "2n" is supplied to the source driver as digital data. The digital input code "0" is converted into a data potential $V_{L1}$ by a digital-analog converter circuit, and the digital input code "2n" is converted into a data potential $V_{H1}$ by the digital-analog converter circuit. That is, a source driver output range Data1 is from the data potential $V_{L1}$ to the data potential $V_{H1}$. Note that it is preferable that n be a positive integer that is greater than or equal to 1 and 1 less than a power of 2.

In the liquid crystal element shown in FIG. 1(A), display data is supplied using a potential $V_{COM}$ as a reference potential. For example, a data potential Data1*a* or a data potential Data1*b* is supplied to the liquid crystal element. An example is shown in which the liquid crystal element exhibits the minimum gray level G0 in the case where the supplied data potential Data1 or data potential Data1*b* is the same potential as the potential $V_{COM}$. Note that the potential $V_{COM}$ is preferably an intermediate potential between the data potential $V_{L1}$ and the data potential $V_{H1}$. Note that the data potential Data1*a* or the data potential Data1*b* is a potential in the source driver output range Data1.

The transmittance of a liquid crystal element changes depending on a potential difference supplied to both ends of the liquid crystal element. Thus, as the data potential Data1*a*, a voltage lower than or equal to the data potential $V_{H1}$ is supplied using the potential $V_{COM}$ as a reference potential. As the data potential Data1*b*, a voltage higher than or equal to the data potential $V_{L1}$ is supplied using the potential $V_{COM}$ as a reference potential. For example, the data potential Data1*a* is displayed using the digital input code "n" to the digital input code "2n", and the data potential Data1*b* is displayed using the digital input code "0" to a digital input code "n". As an example, the digital input code "n" exhibits the same potential as the potential $V_{COM}$ and the minimum gray level G0. Both of the data potential $V_{L1}$ and the data potential $V_{H1}$ can exhibit the gray level G1. That is, the gray level that can be displayed in the case where the data potential Data1*b* or the data potential Data1*a* is the source driver output range Data1 is in the range of the minimum gray level G0 to the gray level G1.

Furthermore, a data potential Data2*a* or a data potential Data2*b* is preferably supplied to the pixel. When the pixel performs calculation with a plurality of supplied data potentials, a data potential supplied to the liquid crystal element can be increased. As an example, the voltage range of the supplied data potential Data2*a* or data potential Data2*b* is preferably the same scale as the source driver output range Data1.

As an example, the data potential Data1*a* is subjected to calculation with the data potential Data2*a*, whereby the display element can display the maximum gray level G2. As another example, in the case where inversion is performed centering around the potential $V_{COM}$, the data potential Data1*b* is subjected to calculation with the data potential Data2*b*, whereby display at the maximum gray level G2 can be performed. Note that the calculation in the pixel is not limited to addition and subtraction can be performed. Furthermore, in the calculation, the data potential Data2*a* or the data potential Data2*b* can be multiplied by a coefficient.

Thus, the liquid crystal element can display up to "n" gray levels owing to the data potential Data1*a* or the data potential Data1*b*. Furthermore, the pixel performs calculation with the data potential Data2*a* or the data potential Data2*b*, whereby the range of the gray levels that can be displayed is expanded to the gray level corresponding to a digital input code "3n". In other words, by calculation with a plurality of supplied data potentials, the pixel can display the gray level range that is wider than the gray level range that can be displayed in the source driver output range.

The power consumption of the source driver can be reduced when the source driver output range is reduced. When the source driver output range corresponds to a region with a small amount of transmittance change with respect to the voltage of the liquid crystal element, display at a gray level with a small amount of transmittance change can be finely controlled. Furthermore, in the case where the display mode of the liquid crystal element is normally white, the data potential Data2*a* or the data potential Data2*b* to be subjected to calculation is supplied to the pixel, so that the liquid crystal element can be supplied with a potential high enough to control the high gray level range. Thus, the contrast of an image displayed on the display device can be improved.

Figure 1B:
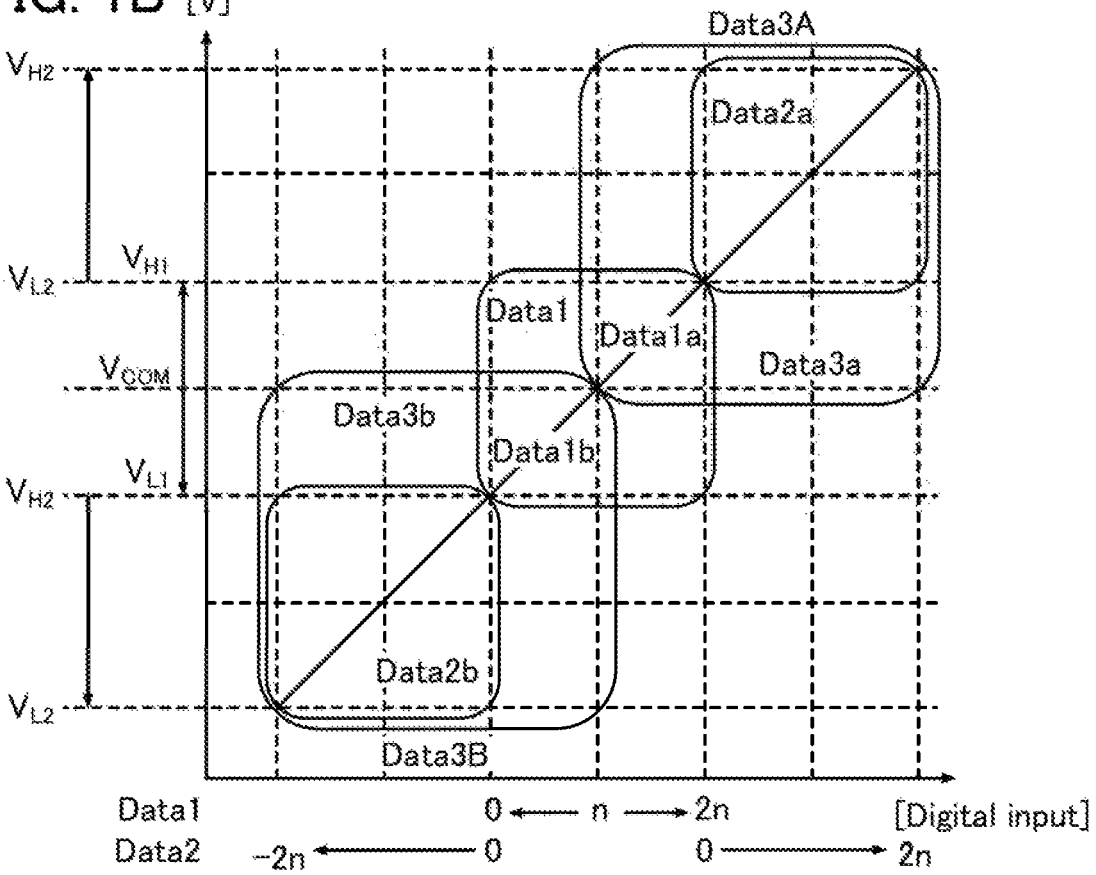

FIG. 1(B) is a diagram showing a voltage supplied to the liquid crystal element with respect to display data. Note that the display data is supplied as digital data. The digital-analog converter circuit preferably has a linear output voltage with respect to the display data. In FIG. 1(B), the x axis uses digital input codes as a unit, and the y axis represents data potential using a voltage as a unit.

In FIG. 1(B), for description, result of calculation with the data potential Data1*a* and the data potential Data2*a* is a positive gray level. Furthermore, result of calculation with the data potential Data1*b* and the data potential Data2*b* is described as a negative gray level in order to distinguish it from the positive gray level. Note that the gray levels of the liquid crystal element changes in accordance with the potential difference supplied to both ends of the liquid crystal element; thus, the positive gray level and the negative gray level can display the same gray level.

A data potential Data3*a* represents a data potential generated by calculation with the data potential Data1*a* and the data potential Data2*a*, and a data potential Data3*b* represents a data potential generated by calculation with the data potential Data1*b* and the data potential Data2*b*. Note that FIG. 1(B) explicitly illustrates a source driver output range Data1, a range Data3A which represents a positive gray level, and a range Data3B which represents a negative gray level.

First, an example is described in which the source driver supplies, to the pixel, the data potential Data1*a* and the data potential Data2*a* that represent positive gray levels.

The source driver supplies, to the pixel, any one of the display data in the range of the digital input code "n" corresponding to the potential $V_{COM}$ to the digital input code "2n" corresponding to the data potential $V_{H1}$. The display data is converted into the data potential Data1*a* by the digital-analog converter circuit to be supplied to the pixel.

Then, the source driver supplies, to the pixel, any one of the display data in the range of the digital input code "0" corresponding to the data potential $V_{L1}$ to the digital input code "2n" corresponding to the data potential $V_{H1}$. The display data is converted into the data potential Data2*a* by the digital-analog converter circuit to be supplied to the pixel. Note that in order to distinguish the first data writing from the second data writing to the pixel, the voltage range of the second data writing is from a data potential $V_{L2}$ to a data potential $V_{H2}$. Thus, the pixel performs calculation with the data potential Data1*a* and the data potential Data2*a* to generate the data potential Data3*a*, which is supplied to the liquid crystal element.

Next, how the source driver supplies, to the pixel, the data potential Data1*b* and the data potential Data2*b* that represent negative gray levels is described.

The source driver supplies, to the pixel, any one of the display data in the range of the digital input code "n" corresponding to the potential $V_{COM}$ to the digital input code "0" corresponding to the data potential $V_{L1}$. The display data is converted into the data potential Data1*b* by the digital-analog converter circuit to be supplied to the pixel.

Then, the source driver supplies, to the pixel, any one of the display data in the range of the digital input code "0" corresponding to the data potential $V_{H2}$ to a digital input code "−2n" corresponding to the data potential $V_{L2}$. The display data is converted into the data potential Data2*b* by the digital-analog converter circuit to be supplied to the pixel. Note that in order to distinguish the first data writing from the second data writing to the pixel, the voltage range of the second data writing is from the data potential $V_{L2}$ to the data potential $V_{H2}$. Thus, the pixel performs calculation with the data potential Data1*b* and the data potential Data2*b* to generate the data potential Data3*b*, which is supplied to the liquid crystal element.

In this embodiment, writing of the display data to the pixel is performed twice, whereby display data exceeding the source driver output range can be supplied to the display element. Note that the number of times the display data is supplied to the pixel is not limited to two. The display data may be supplied to the pixel a plurality of times. For example, one of the display data supplied to the pixel a plurality of times may function as a correction table of the temperature at which the display device is used. For example, in the case where the display element is a liquid crystal element, when the display device is used in a low-temperature environment, a larger potential supplied to the liquid crystal element enables the display element to be driven more smoothly.

Figure 2:
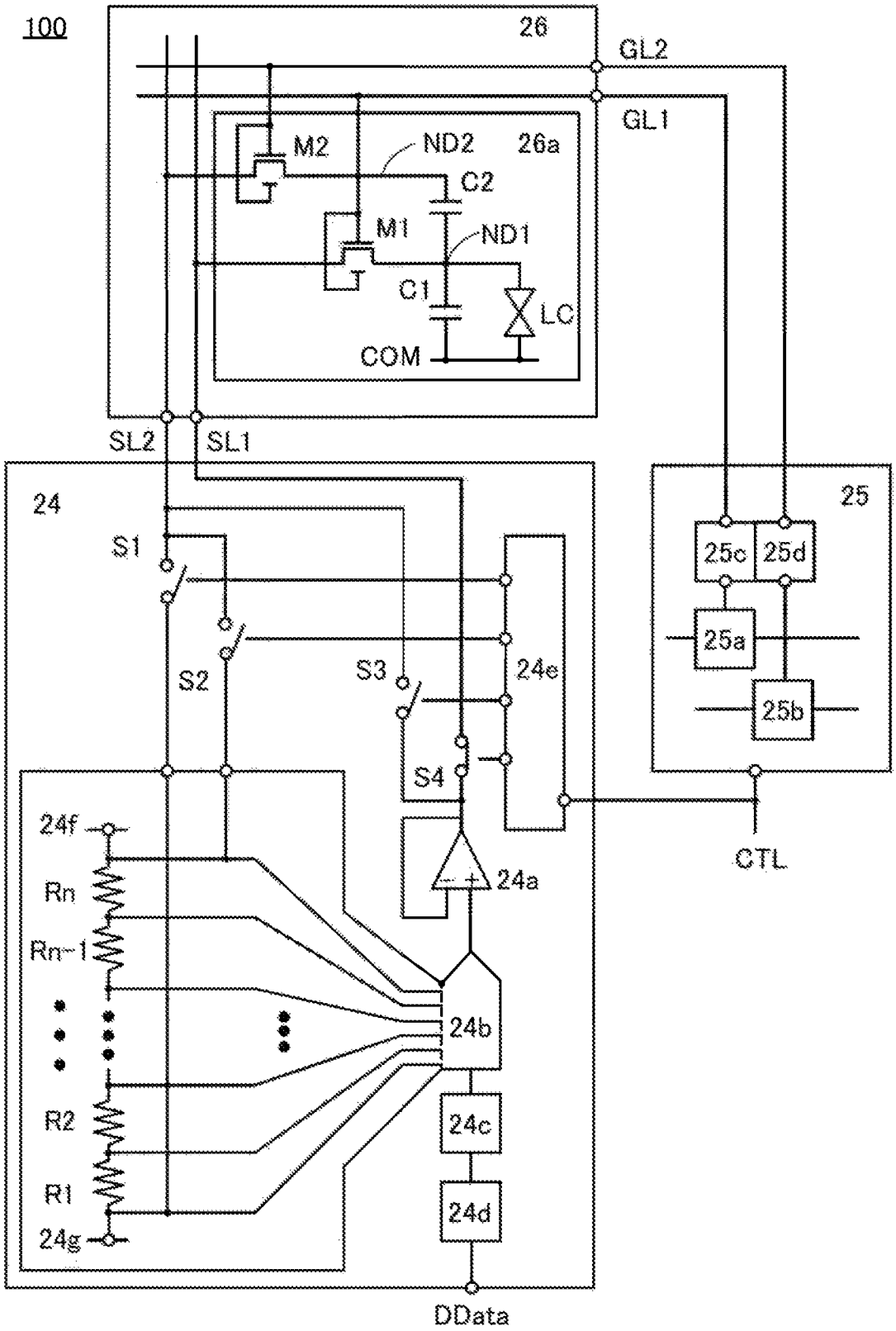
FIG. 2 is a circuit diagram illustrating a structure example of a semiconductor device.

FIG. 2 is a circuit diagram illustrating a structure example of a semiconductor device 100 of one embodiment of the present invention. The semiconductor device 100 includes a source driver 24, a gate driver 25, and a display device 26.

The source driver 24 includes a buffer circuit 24*a*, a digital-analog converter circuit 24*b*, a level shifter circuit 24*c*, a latch circuit 24*d*, a switch control circuit 24*e*, a switch S1, a switch S2, a switch S3, and a switch S4. The digital-analog converter circuit 24*b* includes a wiring 24*f*, a wiring 24*g*, resistors R1 to Rn, a first output terminal, a second output terminal, and a third output terminal. Note that n is a positive integer.

The gate driver 25 includes a plurality of shift register circuits 25*a*, a plurality of shift register circuits 25*b*, a plurality of buffer circuits 25*c*, and a plurality of buffer circuits 25*d*. Note that for simplification of description, FIG. 2 shows the shift register circuit 25*a*, the shift register circuit 25*b*, the buffer circuit 25*c*, and the buffer circuit 25*d*.

The display device 26 includes a plurality of pixels 26*a*, a plurality of wirings GL1, a plurality of wirings GL2, a plurality of wirings SL1, a plurality of wirings SL2, and a wiring COM. Each of the plurality of pixels 26*a* includes a transistor M1, a transistor M2, a capacitor C1, a capacitor C2, and a display element LC. Note that for simple description of the display device 26, FIG. 2 illustrates an example in which the pixel 26*a* is connected to the wiring GL1, the wiring GL2, the wiring SL1, the wiring SL2, and the wiring COM. In the following description, the display element LC is substituted with a liquid crystal element LC.

First, electrical connections in the pixel 26*a* are described. A gate of the transistor M1 is electrically connected to the wiring GL1. One of a source and a drain of the transistor M1 is electrically connected to the wiring SL1. The other of the source and the drain of the transistor M1 is electrically connected to one electrode of the capacitor C1, one electrode of the capacitor C2, and one electrode of the liquid crystal element LC. A gate of the transistor M2 is electrically connected to the wiring GL2. One of a source and a drain of the transistor M2 is electrically connected to the wiring SL2. The other of the source and the drain of the transistor M1 is electrically connected to the other electrode of the capacitor C2. The wiring COM is electrically connected to the other electrode of the capacitor C1 and the other electrode of the liquid crystal element LC. A node ND1 is formed by the connection of the other of the source and the drain of the transistor M1, the one electrode of the capacitor C1, the one electrode of the capacitor C2, and the one electrode of the liquid crystal element LC. A node ND2 is formed by the connection of the other of the source and the drain of the transistor M2 and the other electrode of the capacitor C2.

Next, electrical connections in the source driver 24 are described. A data bus DData is electrically connected to the level shifter circuit 24*c* through the latch circuit 24*d*. The level shifter circuit 24*c* is electrically connected to the digital-analog converter circuit 24*b*. In the digital-analog converter circuit 24*b*, the first output terminal is electrically connected to an input terminal of the buffer circuit 24*a*, the second output terminal is electrically connected to one electrode of the switch S1, and the third output terminal is electrically connected to one electrode of the switch S2. An output terminal of the buffer circuit 24*a* is electrically connected to one electrode of the switch S3 and one electrode of the switch S4. The wiring SL1 is electrically connected to the other electrode of the switch S4. The wiring SL2 is electrically connected to the other electrode of the switch S1, the other electrode of the switch S2, and the other electrode of the switch S3. The switch control circuit 24*e* is electrically connected to the switch S1, the switch S2, the switch S3, and the switch S4.

Next, electrical connections in the gate driver 25 are described. The shift register circuit 25*a* is electrically connected to the buffer circuit 25*c* and the switch control circuit 24*e*. The shift register circuit 25*b* is electrically connected to the buffer circuit 25*d*. The buffer circuit 25*c* is electrically connected to the wiring GL1. The buffer circuit 25*d* is electrically connected to the wiring GL2.

A plurality of wirings CTL are electrically connected to the gate driver 25 and the switch control circuit 24*e*. A clock signal, a start pulse signal, a pulse width control signal, and the like are supplied to the wirings CTL. The wirings CTL are described in detail with reference to FIG. 12.

Next, the operation of the gate driver 25 is described. The shift register circuit 25*a* can supply a first scan signal to the wiring GL1 of the display device 26 through the buffer circuit 25*c*. The shift register circuit 25*b* can supply a second scan signal to the wiring GL2 of the display device 26 through the buffer circuit 25*d*. Although not illustrated, the first scan signal or the second scan signal is also supplied to the switch control circuit 24*e* as a data write signal to the pixel 26*a*.

Next, the operation of the source driver 24 is described. The latch circuit 24*d* is supplied with the display data as digital data through the data bus DData. The display data is supplied to the digital-analog converter circuit 24*b* through the level shifter circuit 24*c*. Note that the digital-analog converter circuit 24*b* may have a function of the level shifter circuit 24*c*.

The digital-analog converter circuit 24*b* can convert supplied display data into a data potential. In this case, the data potential preferably has linearity with respect to the display data. For example, when a plurality of resistors are connected in series between the wiring 24*g* supplied with a data potential $V_L$ and the wiring 24*f* supplied with a data potential $V_H$ as shown in FIG. 2, the digital-analog converter circuit 24*b* can generate a plurality of different potentials corresponding to the number of resistors. The generated potential is a data potential representing a gray level when supplied to the pixel 26*a*. The number of the generated data potentials is preferably equal to the number of the gray levels displayed by the display device 26. Alternatively, the number of the generated data potentials is preferably greater than the number of the gray levels displayed by the display device 26. For example, a data potential is output from the first output terminal of the digital-analog converter circuit 24*b*, the data potential $V_L$ is output from the second output terminal, and the data potential $V_H$ is output from the third output terminal.

The switch control circuit 24*e* can control turning on or off of the switch S1 to the switch S4 independently. The switch control circuit 24*e* is supplied with data write signals to the pixel 26*a* from the shift register circuit 25*a* and the shift register circuit 25*b* included in the gate driver 25. Thus, the switch control circuit 24*e* can control turning on or off of the switch S1 to the switch S4 in accordance with the timing of data writing to the pixel 26*a*. Thus, the switch control circuit 24*e* can control the timing of supplying the data potential to the pixel 26*a*. For example, a data write signal to the pixel 26*a* can be generated from a clock signal, a start pulse signal, a pulse width control signal, or the like supplied to the wiring CTL and can delay the timing for a predetermined period of time.

The operations of the pixel 26*a* and the switch control circuit 24*e* are described in detail with reference to timing charts in FIG. 3.

Figure 3A:
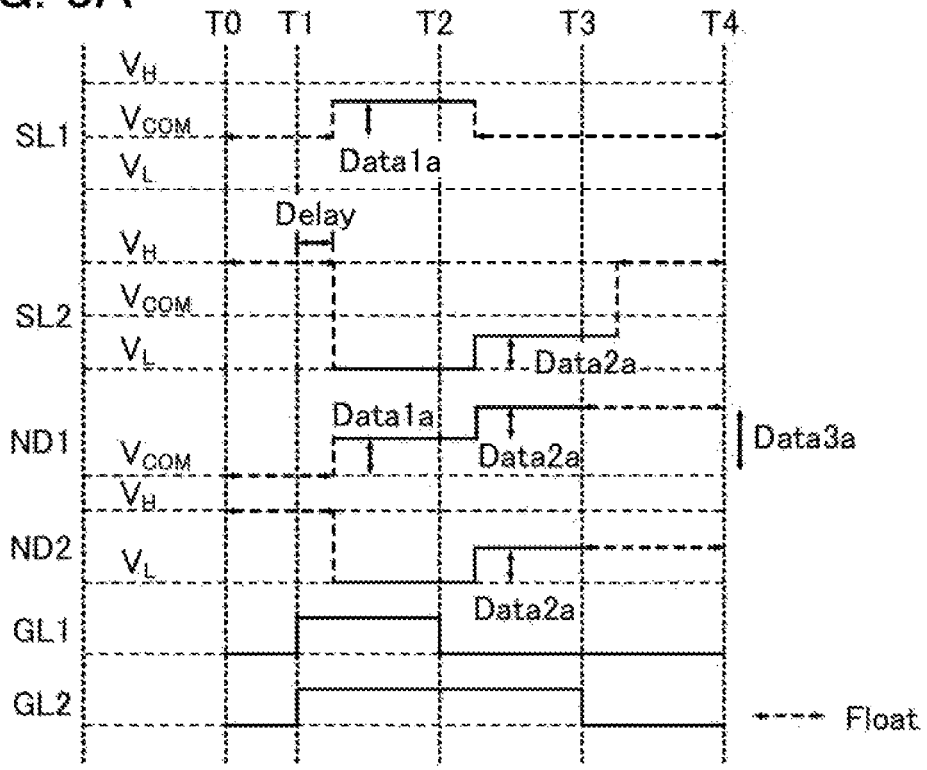
FIGS. 3A-3B are timing charts each showing an operation example of a semiconductor device.
Figure 3B:
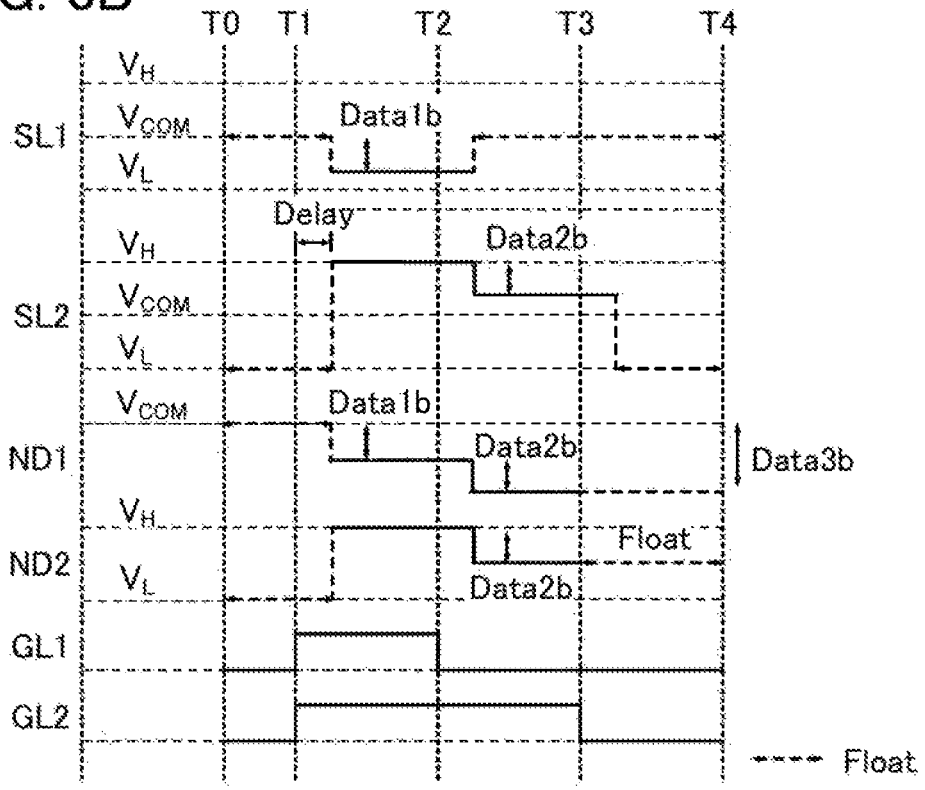

FIG. 3 illustrates timing charts showing operation examples of the semiconductor device 100 of one embodiment of the present invention. FIG. 3(A) illustrates a timing chart of the case where a positive gray level is set, and FIG. 3(B) illustrates a timing chart of the case where a negative gray level is set.

First, with reference to FIG. 3(A), the timing chart of the case where a positive gray level is set is described.

At Time T1, the first scan signal is supplied to the wiring GL1, and the second scan signal is supplied to the wiring GL2. The first scan signal and the second scan signal are supplied to the switch control circuit 24*e*. In the case where the switch S1 and the switch S4 are turned off by the switch control circuit 24*e*, the wiring SL1 or the wiring SL2 is brought into a floating state in some cases. A period indicated by a dashed arrow in FIG. 3 is a period in which floating (Float) is allowed.

The transistor M1 is brought into an on state by the state of the first scan signal. The node ND1 is supplied with the data potential Data1*a* through the wiring SL1. The transistor M2 is brought into an on state by the second scan signal. The node ND2 is supplied with a second data potential through the wiring SL2. The data potential $V_L$ corresponding to the first data potential is supplied to the node ND1 using the potential $V_{COM}$ supplied to the wiring COM as a reference potential. In addition, the data potential Data1*a* that uses the data potential $V_L$ supplied to the node ND1 as a reference potential is supplied to the node ND2.

Note that at Time T1, it is preferable that the switch control circuit 24*e* control the switch S1 to be in an on state, the switch S2 to be in an off state, the switch S3 to be in an off state, and the switch S4 to be in an on state. In addition, it is preferable that the switch control circuit 24*e* control the switch S1 to the switch S4 later than input of the first scan signal or the second scan signal. In other words, a delay period (Delay) of output timing of a data potential supplied to the wiring SL1 or the wiring SL2 is controlled in accordance with the timing of turning on or off the transistor M1 or the transistor M2, whereby correct data can be written independently of the characteristics variation and the like of the transistor M1 or the transistor M2. Although there is a period in which data of the node ND1 or the node ND2 is undetermined until the data potential is supplied to the wiring SL1 or the wiring SL2, it does not matter. This is because the data of the node ND1 or the node ND2 should be determined by Time T2. Furthermore, in controlling delay, the delay period is preferably changed in accordance with the temperature.

At time T2, the transistor M1 is brought into an off state by the state of the first scan signal, and the transistor M2 is kept in an on state by the state of the second scan signal. The switch control circuit 24*e* controls the switch S1 to be in an off state, the switch S2 to be in an off state, the switch S3 to be in an on state, and the switch S4 to be in an off state. The node ND1 is brought into a floating state in which the data potential Data1*a* is held. The second data potential is supplied to the node ND2 through the wiring SL2. In this case, the data potential Data2*a* that uses the data potential $V_L$ as a reference potential is supplied as the second data potential. In accordance with charge conservation of a capacitor, the data potential Data1*a* held in the node ND1 is subjected to calculation with the data potential Data2*a* through the capacitor C2, and the data potential Data3*a* is generated. The data potential Data3 is calculated by the following Formula 1. Hereinafter, a transistor being brought into an off state means that a signal supplied to a gate of the transistor is changed to "L", and a transistor being brought into an on state means that a signal supplied to a gate of the transistor is changed to "H".

$$\text{Data3}=\text{Data1}+(C2/(C1+C2))\times\text{Data2} \quad \text{(Formula 1)}$$

Note that the capacitance values of the capacitor C1 and the capacitor C2 are preferably the same. Alternatively, when the capacitor C2 has a capacitance value different from that of the capacitor C1, the capacitor C2 can be multiplied by a coefficient in the calculation. For a specified delay period from Time T2, the wiring SL1 preferably holds the supplied data potential. With the delay period, data writing to the node ND1 is surely performed.

At Time T3, the transistor M2 is brought into an off state by the state of the second scan signal, and the transistor M1 is kept in an off state by the state of the first scan signal. When the transistor M2 is brought into an off state, the node ND2 is brought into a floating state. For a specified period from Time T3, the wiring SL2 preferably holds the supplied data potential. With the delay period, data writing to the node ND2 is surely performed. Thus, the potential of the data potential Data2*a* is held in the node ND2, and the data potential Data3*a* is held in the node ND1. Accordingly, the data potential Data3*a* using the potential $V_{COM}$ as a reference potential is supplied to the liquid crystal element LC.

With reference to FIG. 3(B), the timing chart of the case where a negative gray level is set is described. Note that the description of the content overlapping with the description of FIG. 3(A) is omitted.

At Time T1, the first scan signal is supplied to the wiring GL1, and the second scan signal is supplied to the wiring GL2. The first scan signal and the second scan signal are supplied to the switch control circuit 24*e*.

The transistor M1 is brought into an on state by the state of the first scan signal. The node ND1 is supplied with the data potential Data1*b* through the wiring SL1. The transistor M2 is brought into an on state by the state of the second scan signal. The node ND2 is supplied with the second data potential through the wiring SL2. The data potential $V_H$ corresponding to the second data potential is supplied to the node ND1 using the potential $V_{COM}$ supplied to the wiring COM as a reference potential. In addition, the data potential Data1*b* using the data potential $V_H$ supplied to the node ND1 as a reference potential is supplied to the node ND2.

Note that at Time T1, it is preferable that the switch control circuit 24*e* control the switch S1 to be in an off state, the switch S2 to be in an on state, the switch S3 to be in an off state, and the switch S4 to be in an on state. In addition, it is preferable that the switch control circuit 24*e* control the switch S1 to the switch S4 later than input of the first scan signal or the second scan signal.

At time T2, the transistor M1 is brought into an off state by the state of the first scan signal, and the transistor M2 is kept in an on state by the state of the second scan signal. The switch control circuit 24*e* controls the switch S1 to be in an off state, the switch S2 to be in an off state, the switch S3 to be in an on state, and the switch S4 to be in an off state. The node ND1 is brought into a floating state in which the data potential Data1*b* is held. The second data potential is supplied to the node ND2 through the wiring SL2. In this case, the data potential Data2*b* that uses the data potential $V_H$ as a reference potential is supplied as the second data potential. In accordance with charge conservation of a capacitor, the data potential Data1*b* held in the node ND1 is subjected to calculation with the data potential Data2*b* through the capacitor C2, and the data potential Data3*b* is generated.

At Time T3, the transistor M1 is kept in an off state by the state of the first scan signal, and the transistor M2 is brought into an off state by the state of the second scan signal. When the transistor M2 is brought into an off state, the node ND2 is brought into a floating state. Thus, the potential of the data potential Data2*b* is held in the node ND2, and the data potential Data3*b* is held in the node ND1. Accordingly, the data potential Data3*b* using the potential $V_{COM}$ as a reference potential is supplied to the liquid crystal element LC.

Thus, in FIGS. 3(A) and 3(B), a plurality of data potentials supplied to a pixel are subjected to calculation and the data potential Data3*a* or the data potential Data3*b* can be generated. With the data potential Data3*a* or the data potential Data3*b*, a voltage exceeding the source driver output range can be supplied to the liquid crystal element. Thus, in the case where the data potential Data3*a* or the data potential Data3*b* is supplied, the pixel can perform display with a high gray level as compared with the case where display is performed within the source driver output range.

Figure 4:
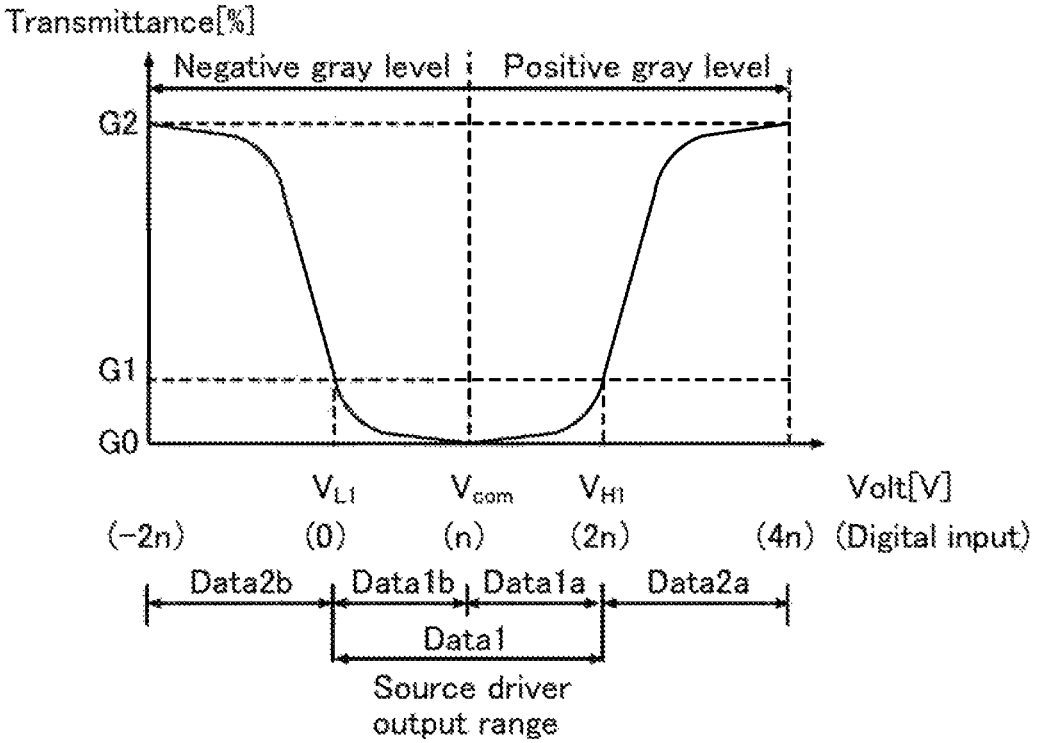
FIG. 4 is a drawing showing gray level characteristics of a display element.

FIG. 4 illustrates the transmittance with respect to a potential supplied to a liquid crystal element with the use of a display mode different from that in FIG. 1(A). To a liquid crystal element having gray level characteristics shown in FIG. 4, display data is supplied using the potential $V_{COM}$ as a reference potential. For example, the data potential Data1*a* or the data potential Data1*b* is supplied to the liquid crystal element. An example is shown in which the liquid crystal element exhibits the minimum gray level G0 in the case where the supplied data potential Data1 or data potential Data1*b* is the same potential as the potential $V_{COM}$. That is, an example is shown in which the display mode of the display device is normally black. Note that the data potential Data1*a* or the data potential Data1*b* is a potential in the source driver output range Data1.

Figure 5A:
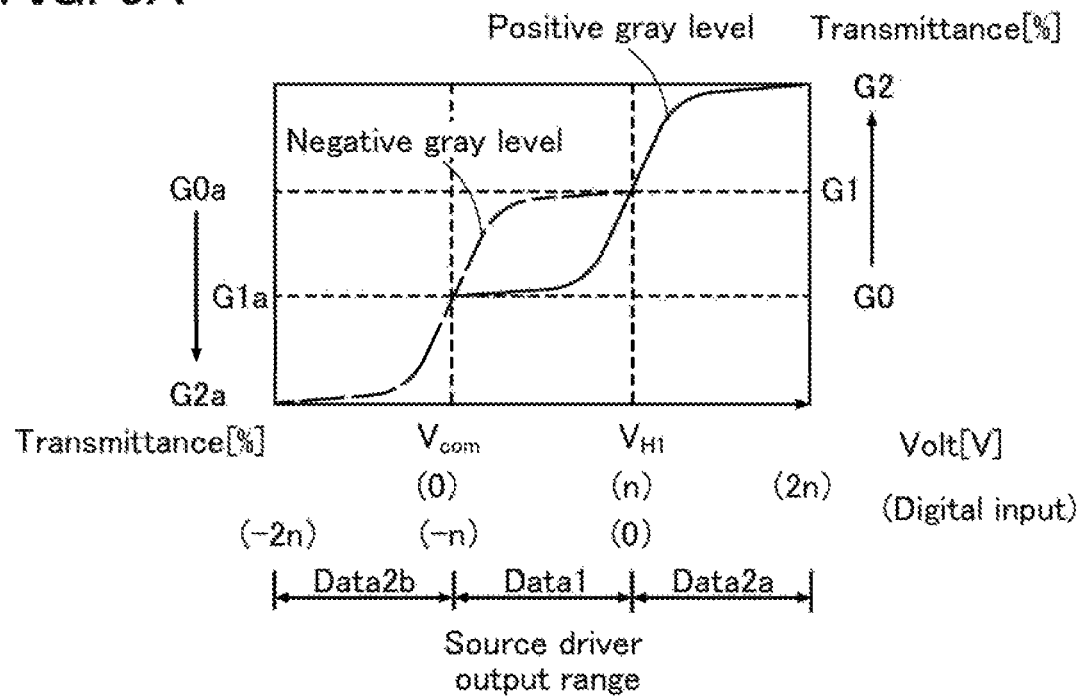
FIGS. 5A-5B are drawings showing gray level characteristics of a display element.

FIG. 5(A) illustrates the transmittance with respect to a potential supplied to a liquid crystal element. In a driving method shown in FIG. 5(A), a potential can be supplied to a liquid crystal element by a method different from that in FIG. 1(A). Display data in the range of the digital input code "0" to the digital input code "n" is supplied to the source driver. That is, a feature in which the resolution of the source driver for controlling the gray level from the minimum gray level G0 to the gray level G1 can be half of that in FIG. 1(A) can be obtained. Therefore, in the driving method shown in FIG. 5, it is preferable that a reference potential supplied to a liquid crystal element in the case of display with a positive gray level be inversion of that in the case of display with a negative gray level.

For example, in the case where display with a positive gray level is performed with the source driver output range Data1, the digital input code "0" is converted into the data potential $V_{COM}$ by the digital-analog converter circuit, and the digital input code "n" is converted into the data potential $V_{H1}$ by the digital-analog converter circuit.

Furthermore, the data potential Data2*a* is preferably supplied to the pixel. The data potential Data2*a* is converted in the voltage range of the data potential $V_{COM}$ to the data potential $V_{H2}$. When the pixel performs calculation with a plurality of supplied data potentials, a data potential supplied to the liquid crystal element can be increased. The voltage range of the supplied data potential Data2*a* is preferably the same scale as the source driver output range Data1. Thus, the maximum gray level G2 the display device 26 can display corresponds to the digital input code "2n" at the maximum. Note that the written expression data potential $V_{H1}$ or data potential $V_{H2}$ is for distinguishing first wiring from second writing, and the source driver output range is the same.

In the case where display with a negative gray level is performed with the source driver output range Data1, the digital input code "0" is converted into the data potential $V_{H1}$ by the digital-analog converter circuit, and the digital input code "−n" is converted into the data potential $V_{COM}$ by the digital-analog converter circuit. That is, in the first data writing, the data potential $V_{H1}$ is supplied as a reference potential.

Furthermore, the data potential Data2*b* is preferably supplied to the pixel. When the pixel performs calculation with a plurality of supplied data potentials, a data potential supplied to the liquid crystal element can be increased. The voltage range of the supplied data potential Data2*b* is preferably the same scale as the source driver output range Data1. The data potential Data2*b* is supplied using the data potential $V_{H2}$ as a reference potential. Thus, a maximum gray level G2*a* the display device 26 can display corresponds to the digital input code "−2n" at the maximum.

Figure 5B:
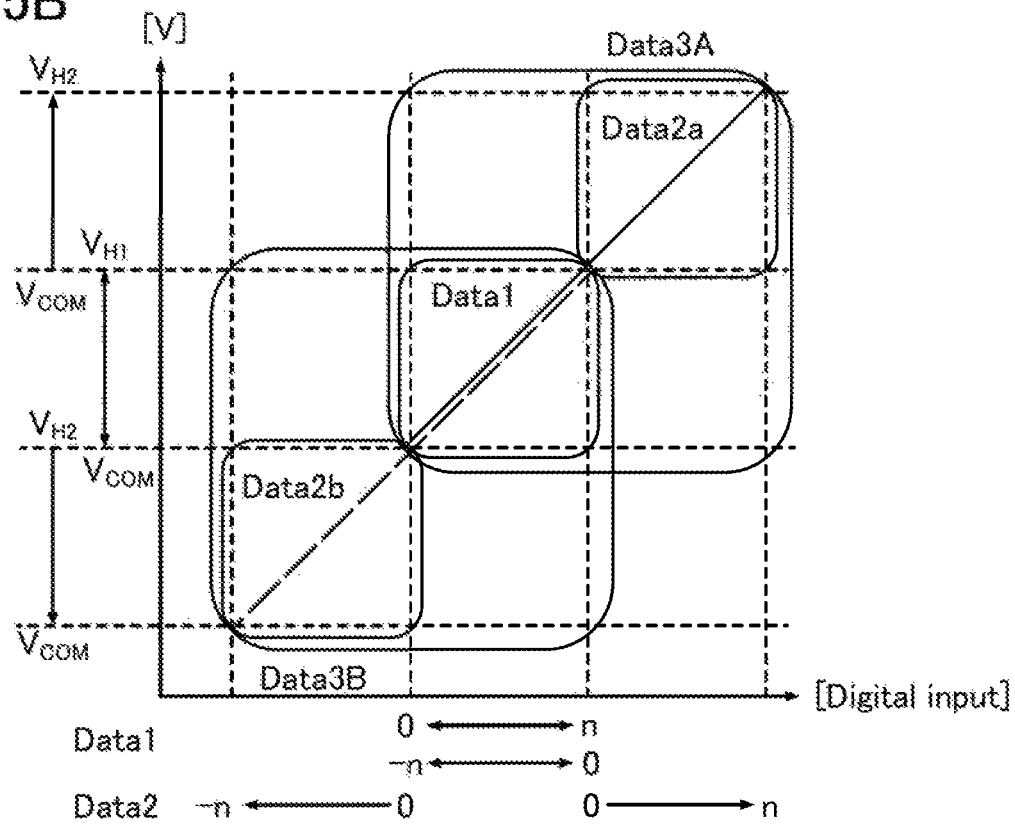

FIG. 5(B) is a diagram showing a voltage supplied to the liquid crystal element with respect to display data. Note that the display data is supplied as digital data. The digital-analog converter circuit preferably has a linear output voltage with respect to the display data. Note that in FIG. 5(B), the output characteristics of the potentials representing positive gray levels and the output characteristics of the potentials representing negative gray levels overlap with each other; hence they are explicitly shifted in the diagram.

As illustrated in FIGS. 5(A) and 5(B), in the case of displaying a positive gray level, the data potential Data1 is subjected to calculation with the data potential Data2*a*, so that the liquid crystal element can display the maximum gray level G2. In the case of displaying a negative gray level, the display data is inverted on the basis of the data potential $V_{H1}$ and supplied. Accordingly, in the case of displaying a negative gray level, the data potential Data1 is subjected to calculation with the data potential Data2*b*, so that the maximum gray level G2 can be displayed. Note that the calculation in the pixel is not limited to addition and subtraction can be performed. Furthermore, in the calculation, the data potential Data2*a* or the data potential Data2*b* can be multiplied by a coefficient.

Thus, the liquid crystal element can display up to a gray level corresponding to the digital input code "n" owing to the data potential Data1. Furthermore, the pixel performs calculation with the data potential Data2*a* or the data potential Data2*b*, whereby the range of the gray levels that can be displayed is expanded to the gray level corresponding to the digital input code "2n". In other words, by calculation with a plurality of supplied data potentials, the pixel can display the gray level range that is wider than the gray level range that can be displayed in the source driver output range.

The power consumption of the source driver can be reduced when driving is performed by inverting the potential $V_{COM}$ supplied to the liquid crystal element and the source driver output range is reduced. When the source driver output range corresponds to a region with a small amount of transmittance change with respect to the voltage of the liquid crystal element, display at a gray level with a small amount of transmittance change can be finely controlled. Furthermore, the data potential Data2*a* or the data potential Data2*b* to be subjected to calculation is supplied to the pixel, so that the liquid crystal element can be supplied with a potential high enough to control the high gray level range. Thus, the contrast of an image displayed on the display device can be improved.

Note that the number of times the display data is supplied to the pixel is not limited to two. The display data may be supplied to the pixel a plurality of times. For example, one of the display data supplied to the pixel a plurality of times may function as a correction table of the temperature at which the display device is used. When the display device is used in a low-temperature environment, a larger potential supplied to the liquid crystal element enables the display element to be driven more smoothly.

FIG. 5(B) explicitly illustrates the source driver output range Data1, the range Data3A which represents a positive gray level, and the range Data3B which represents a negative gray level.

Figure 6A:
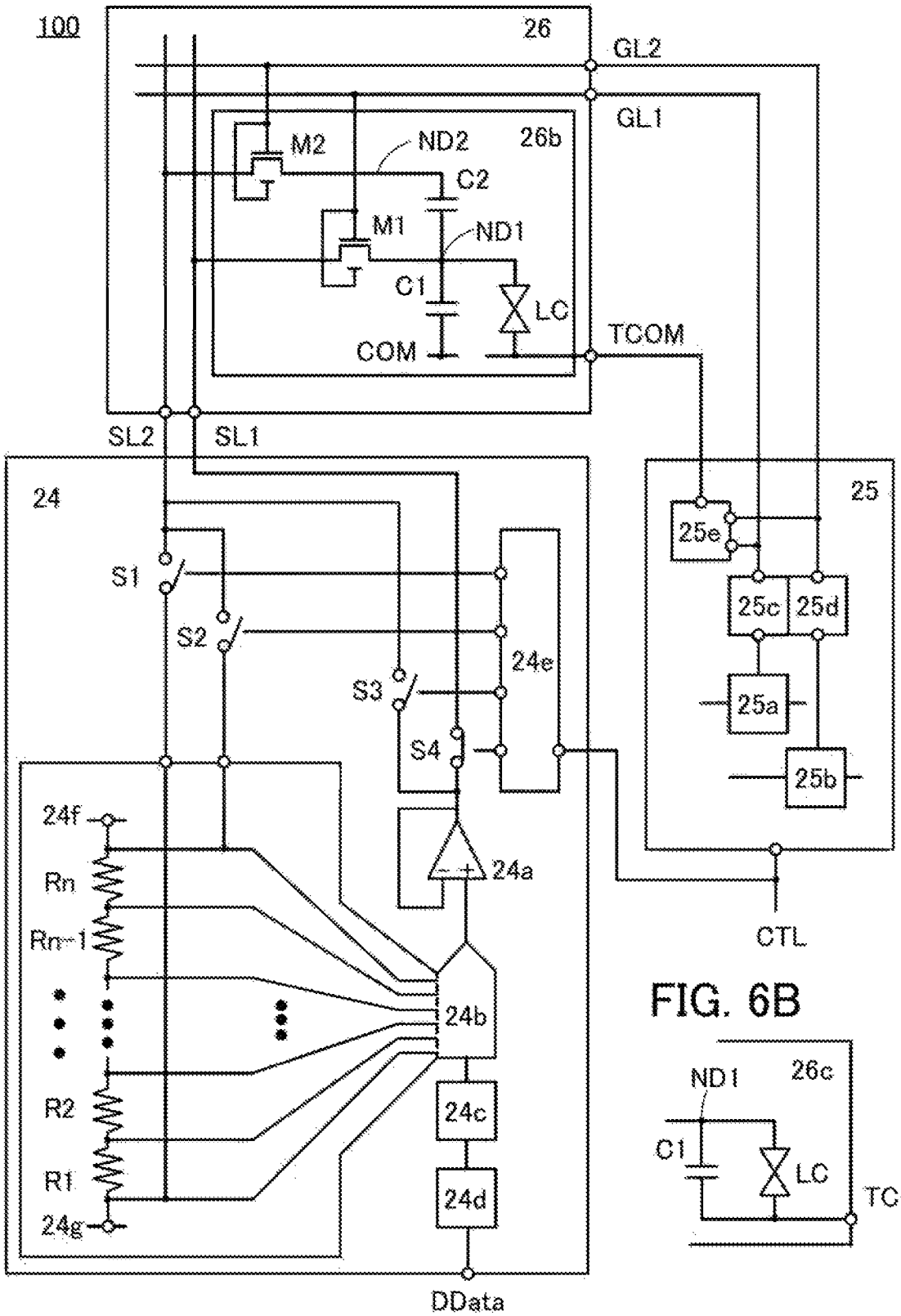
FIGS. 6A-6B are circuit diagrams illustrating a structure example of a semiconductor device.

FIG. 6(A) is a diagram illustrating the semiconductor device 100 having a structure different from that in FIG. 2. Portions different from those in FIG. 2 are described with reference to FIG. 6(A). The difference is that the gate driver 25 includes an inversion control circuit 25*e* and that the other electrode of the liquid crystal element LC is connected to a wiring TCOM.

The inversion control circuit 25*e* is electrically connected to the wiring TCOM, the shift register circuit 25*a*, and the shift register circuit 25*b*. The inversion control circuit 25*e* is supplied with the first scan signal or the second scan signal from the shift register circuit 25*a* or the shift register circuit 25*b*. The inversion control circuit 25*e* generates, from the supplied scan signal, an inversion signal that is supplied to the wiring TCOM. That is, the inversion control circuit 25*e* can invert the potential $V_{COM}$ in the liquid crystal element. The inversion signal supplied to the wiring TCOM may be supplied from a processor, a display controller, or the like, for example.

Note that degradation of a liquid crystal material or display unevenness such as flicker can be suppressed when the polarity of the data voltage applied with respect to the potential $V_{COM}$ in the liquid crystal element is inverted at regular intervals and driving is performed. As an example of the inversion driving, source line inversion driving, gate line inversion driving, dot inversion driving, and the like as well as frame inversion driving can be given.

Frame inversion driving is a driving method in which the polarity of a voltage applied to a liquid crystal element is inverted every one frame period. Note that one frame period corresponds to a period for displaying an image for one pixel. Although there is no particular limitation on the length of the period, it is preferable that the one frame period be at least less than or equal to 1/60 seconds so that a person viewing an image does not perceive a flicker.

It is desirable that the period is further shortened and the frequency is increased to reduce motion blur. It is desirable that the period is 1/120 seconds or shorter (the frequency is 120 Hz or higher). It is more desirable that the period is 1/180 seconds or shorter (the frequency is 180 Hz or higher). In the case where the frame frequency is increased in this manner, when the increased frame frequency does not match the frame frequency of the original image data, image data needs to be interpolated. In this case, image data is interpolated by using a motion vector, so that display at a high frame frequency can be achieved. In this manner, the motion of the image is smoothly displayed and display with few afterimages can be performed.

Note that in this specification, display devices including liquid crystal elements as display elements are classified into a direct-view type, a projection type, and the like depending on a method for displaying an image. Moreover, liquid crystal display devices can be classified into a transmissive type, a reflective type, and a transflective type according to whether a pixel transmits or reflects illumination light. As an example of the liquid crystal element, an element that controls the transmission or non-transmission of light utilizing an optical modulation action of a liquid crystal is given. The element can include a pair of electrodes and a liquid crystal layer. Note that the optical modulation action of the liquid crystal is controlled by an electric field applied to the liquid crystal (including a horizontal electric field, a vertical electric field, or an oblique electric field). Examples of a liquid crystal used for the liquid crystal element are a nematic liquid crystal, a cholesteric liquid crystal, a smectic liquid crystal, a discotic liquid crystal, a thermotropic liquid crystal, a lyotropic liquid crystal, a low-molecular liquid crystal, a high-molecular liquid crystal, a polymer dispersed liquid crystal (PDLC), a ferroelectric liquid crystal, an anti-ferroelectric liquid crystal, a main-chain liquid crystal, a side-chain high-molecular liquid crystal, and a banana-shaped liquid crystal.

Examples of a display method of the liquid crystal display device are a TN (Twisted Nematic) mode, an STN (Super Twisted Nematic) mode, an IPS (In-Plane-Switching) mode, an FFS (Fringe Field Switching) mode, an MVA (Multi-domain Vertical Alignment) mode, a PVA (Patterned Vertical Alignment) mode, an ASV (Advanced Super View) mode, an ASM (Axially Symmetric aligned Micro-cell) mode, an OCB (Optical Compensated Birefringence) mode, an ECB (Electrically Controlled Birefringence) mode, an FLC (Ferroelectric Liquid Crystal) mode, an AFLC (AntiFerroelectric Liquid Crystal) mode, a PDLC (Polymer Dispersed Liquid Crystal) mode, a PNLC (Polymer Network Liquid Crystal) mode, a guest-host mode, and a blue phase mode.

A pixel 26*b* illustrated in FIG. 6(A) has a structure in which a liquid crystal element is provided between a pixel electrode included in the pixel 26*b* and the wiring TCOM positioned at a counter substrate. For example, the display method such as a TN mode, a VA mode, an MVA mode, or an OCB mode is a structure example of the pixel 26*b*. For example, the pixel 26*a* in FIG. 2 preferably has a display method similar to that of the pixel 26*b*. Note that in the pixel 26*a*, the potential $V_{COM}$ is supplied as a reference potential to the other electrode of the liquid crystal element LC and the other electrode of the capacitor C1, whereas in the pixel 26*b*, the potential $V_{COM}$ is supplied as a reference potential to the wiring TCOM. Note that the wiring COM of the pixel 26*b* may be at a potential different from the potential $V_{COM}$.

Figure 6B:
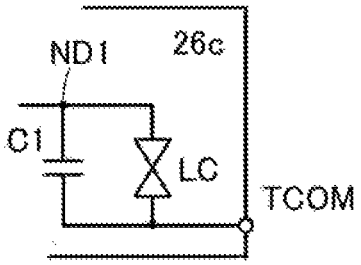

A pixel 26*c* illustrated in FIG. 6(B) is different from the pixel 26 illustrated in FIG. 6(A) in that the other electrode of the liquid crystal element LC and the other electrode of the capacitor C1 are connected to the wiring TCOM. For example, a display method such as an FFS mode or an IPS mode is a structure example of the pixel 26*c*. In the pixel 26*c*, the same reference potential is preferably supplied to the other electrode of the liquid crystal element LC and the other electrode of the capacitor C1.

Embodiment 2

In this embodiment, a structure example of a semiconductor device in which the influence of temperature change is suppressed is described with reference to FIG. 7.

Figure 7:
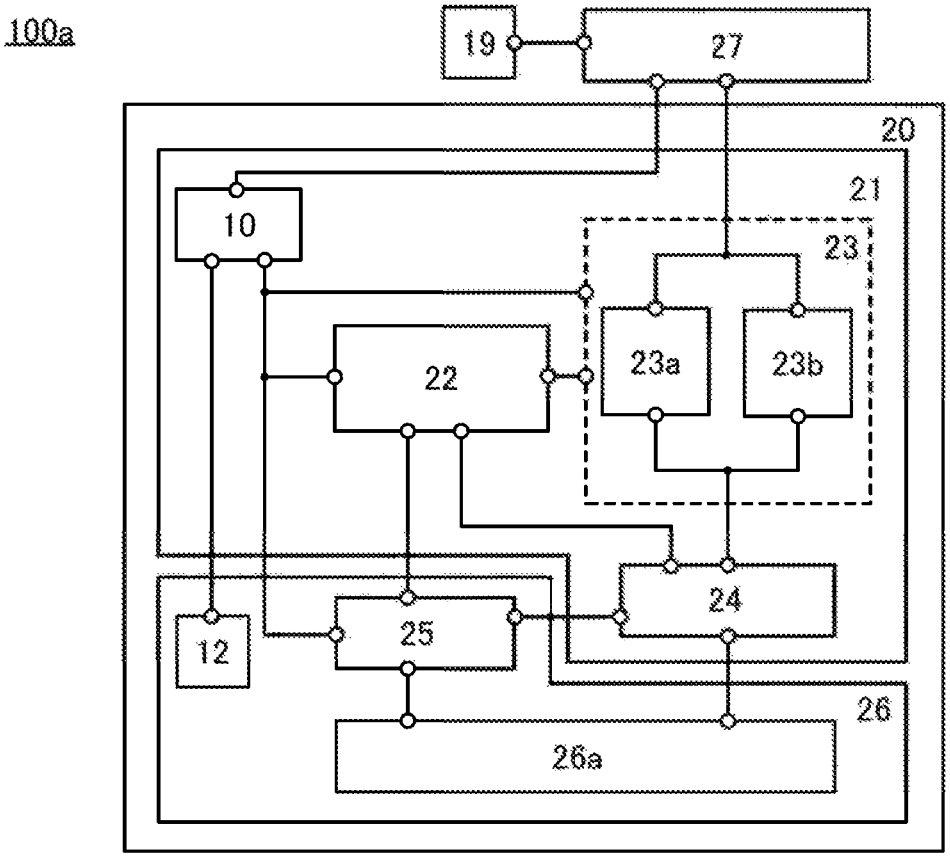
FIG. 7 is a block diagram illustrating a structure example of a semiconductor device.

FIG. 7 is a block diagram illustrating a structure example of a semiconductor device 100*a*. The semiconductor device 100*a* includes a display device 20, a CPU 27, and a temperature sensor 19. The display device 20 includes a control portion 21 and the display device 26. The display device 26 includes the plurality of pixels 26*a*, the gate driver 25, and a voltage reference circuit 12. The control portion 21 includes a semiconductor device 10, a display controller 22, a frame memory 23, and the source driver 24. The frame memory 23 includes a memory device 23*a* and a memory device 23*b*. Note that the voltage reference circuit 12 is described in detail with reference to FIG. 9 and FIG. 10(B).

The frame memory 23 includes, for example, the memory device 23*a* and the memory device 23*b*, and thus can be used for comparison processing for determining whether display data corresponds to a still image or a moving image; filtering processing for improving image quality; image data synthesizing processing for overlapping an image, text information, and the like to each other; image data synthesizing processing for overlapping different images to each other; or the like. Note that image data is preferably supplied to the frame memory 23 from the CPU 27 or the like.

The CPU 27 can collect temperature information such as environmental temperature at which the display device 26, a component such as the frame memory 23, or the display device 20 is used from the temperature sensor 19 or the like and supply it to the semiconductor device 10.

A memory circuit such as a DRAM (Dynamic Random Access Memory) or an SRAM (Static Random Access Memory) may be used for the memory device 23*a* and the memory device 23*b*. Note that a transistor with a low off-state current is used for the memory circuit, whereby a still image and the like can be held for a long period. As the memory device including a transistor with a low off-state current, a DOSRAM (registered trademark) "Dynamic Oxide Semiconductor RAM", a NOSRAM (registered trademark) "Nonvolatile Oxide Semiconductor RAM", and the like can be given.

In the display device 20 illustrated in FIG. 7, the pixel 26*a*, the voltage reference circuit 12, and the gate driver 25 are formed using transistors each including a metal oxide in a semiconductor layer, for example. A transistor including a metal oxide in a semiconductor layer is characterized by having a low off-state current. Note that the transistor with a low off-state current is described in detail in Embodiment 5. Furthermore, the pixel 26*a*, the voltage reference circuit 12, and the gate driver 25 are formed using the same transistors, whereby the threshold voltages of the transistors can be controlled by voltages supplied to back gates of the transistors.

For example, in the case where the semiconductor device 100*a* is used in a high-temperature environment, the off-state current of the transistor might be increased. Accordingly, when the back gate of the transistor included in the gate driver 25 is controlled, a change in threshold voltage of the transistor can be controlled. That is, even in the case of the use in a high-temperature environment, an increase in the off-state current of the transistor included in the gate driver 25 can be suppressed. In addition, the threshold voltage of the transistor might vary due to characteristic variation, voltage stress, or the like. With the semiconductor device 10, the influence of the transistor variation, variation in threshold voltage, or the like can be reduced. Thus, an increase in the power consumption of the semiconductor device 100*a* can be suppressed.

Figure 8:
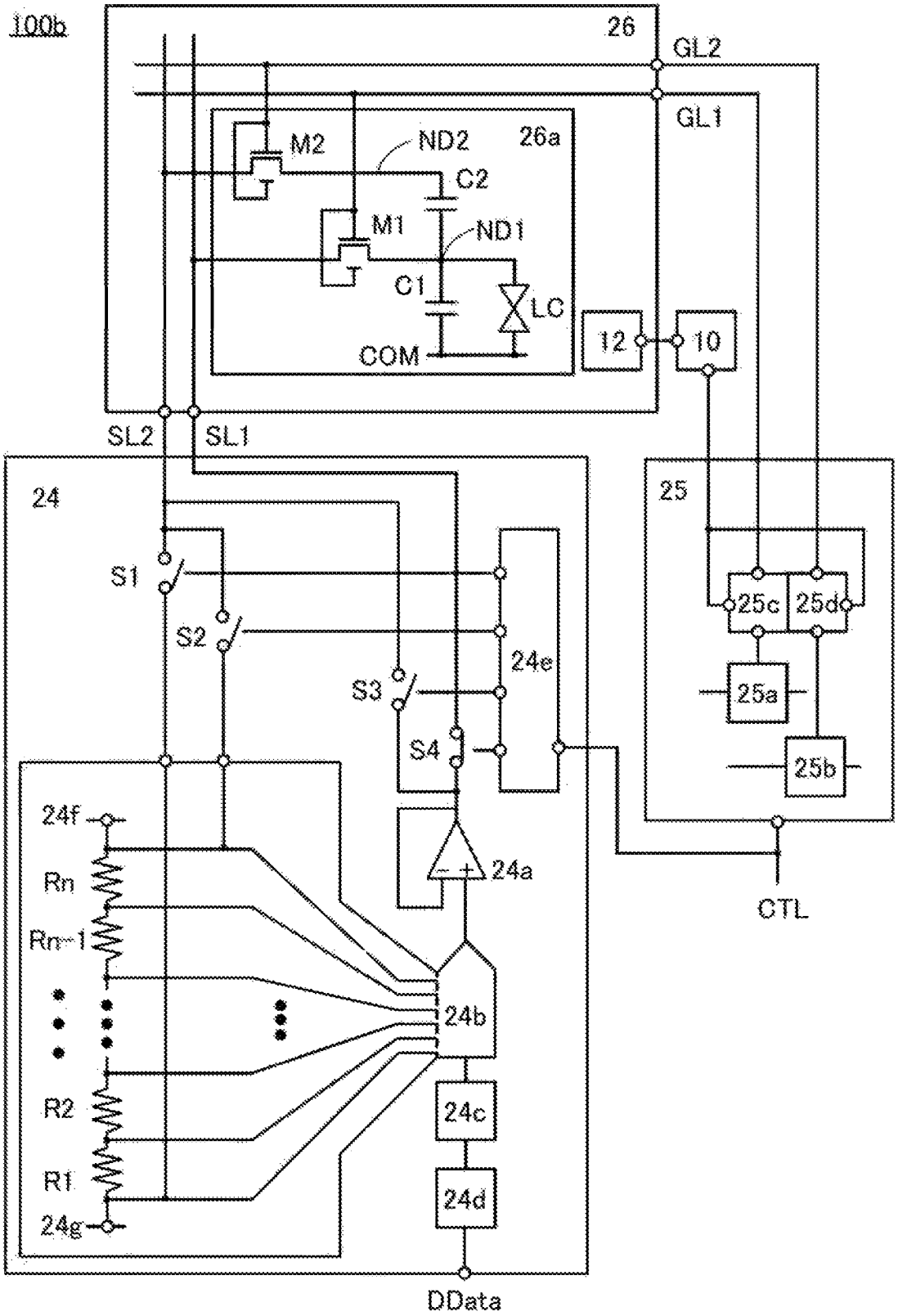
FIG. 8 is a circuit diagram illustrating a structure example of a semiconductor device.

FIG. 8 is a circuit diagram illustrating a structure example of a semiconductor device 100*b* of one embodiment of the present invention. FIG. 8 illustrates the source driver 24, the gate driver 25, and the display device 26 of the semiconductor device 100*a* illustrated in FIG. 7. The semiconductor device 100*b* illustrated in FIG. 8 illustrates the semiconductor device 100*a* illustrated in FIG. 7 in detail. The display device 26 includes the voltage reference circuit 12. The semiconductor device 10 is electrically connected to the voltage reference circuit 12, the buffer circuit 25*c*, and the buffer circuit 25*d*. The semiconductor device 10 preferably includes the voltage reference circuit 12.

The transistor included in the voltage reference circuit 12 is characterized by including a metal oxide in a semiconductor layer, like the transistors included in the display device 26 and the gate driver 25. Thus, the voltage reference circuit 12 functions as a sensor for the semiconductor device 10. Therefore, in accordance with the usage environment of an electronic device including the semiconductor device 100*b*, or the like, a feedback loop that controls the threshold voltage of the transistors included in the semiconductor device 100*b* can be formed.

<<Semiconductor Device 10>>

Figure 9:
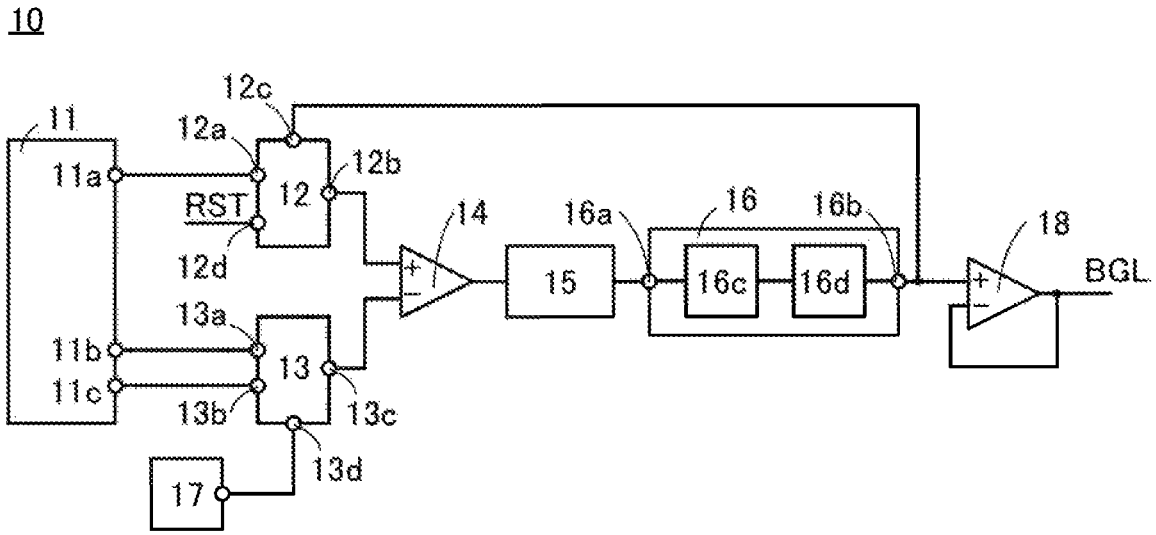
FIG. 9 is a circuit diagram illustrating a structure example of a semiconductor device.

The semiconductor device 10 illustrated in FIG. 9 includes a band gap reference circuit 11, the voltage reference circuit 12, a selection circuit 13, a difference detection circuit 14, a voltage controlled oscillator 15, a negative voltage generation circuit 16, an operation mode control circuit 17, and an amplifier 18.

The band gap reference circuit 11 includes an output terminal 11*a*, an output terminal 11*b*, and an output terminal 11*c*. A first current is output to the output terminal 11*a*, a first potential is output to the output terminal 11*b*, and a second potential is output to the output terminal 11*c*.

The voltage reference circuit 12 includes an input terminal 12*a*, an input terminal 12*c*, an input terminal 12*d*, and an output terminal 12*b*. The voltage reference circuit 12 includes a first transistor including a metal oxide in a semiconductor layer. The first transistor is described in detail with reference to FIG. 10(B). The first transistor includes a back gate, and the back gate is electrically connected to the input terminal 12*c*. In the case where the first current is supplied to the first transistor through the input terminal 12*a*, the threshold voltage of the first transistor is output to the output terminal 12*b*. A wiring RST is electrically connected to the input terminal 12*d*. A signal supplied to the wiring RST can initialize a back gate potential of the first transistor. Note that the input terminal 12*d* is not necessarily provided.

The selection circuit 13 includes an input terminal 13*a*, an input terminal 13*b*, an input terminal 13*d*, and an output terminal 13*c*. The input terminal 13*a* is electrically connected to the output terminal 11*b*, and the input terminal 13*b* is electrically connected to the output terminal 11*c*. The operation mode control circuit 17 is electrically connected to the input terminal 13*d*. Thus, the selection circuit 13 outputs, to the output terminal 13*c*, either the first potential supplied to the input terminal 13*a* or the second potential supplied to the input terminal 13*b*, in accordance with a temperature sensed by the operation mode control circuit 17. Note that the temperature selection conditions may be managed more finely and the selection circuit 13 may output a different potential depending on the temperature. Note that the operation mode control circuit 17 may include a temperature sensor for sensing the temperature. Alternatively, a structure may be employed in which a temperature sensor is connected to the operation mode control circuit 17 or a structure may be employed in which temperature information is supplied from a CPU or the like.

The difference detection circuit 14 detects and outputs a voltage difference between the threshold voltage of the first transistor and the output voltage of the selection circuit 13 as a difference voltage. The difference detection circuit 14 can perform detection easily by using an amplifier. Note that the difference detection circuit 14 may be composed of an analog-digital converter circuit.

The voltage controlled oscillator 15 can convert the input difference voltage into a frequency. The voltage controlled oscillator 15 preferably converts the voltage into a frequency by using a VCO circuit (Voltage Controlled Oscillator) or the like. Accordingly, the level of the output frequency of the voltage controlled oscillator 15 is controlled in accordance with the voltage level.

The negative voltage generation circuit 16 includes an input terminal 16*a*, an output terminal 16*b*, a level shifter circuit 16*c*, and a charge pump circuit 16*d*. As an input frequency, the output frequency is supplied to the level shifter circuit 16*c* through the input terminal 16*a*. The level shifter circuit 16*c* can adjust the amplitude voltage of an input frequency supplied to the charge pump circuit 16*d*. The level shifter circuit 16*c* can generate a positive-phase signal and an inverted signal which are to be supplied to the charge pump circuit 16*d*. The charge pump circuit 16*d* can generate a negative voltage in accordance with the supplied input frequency.

The negative voltage generated by the charge pump circuit 16*d* can be supplied to the input terminal 12*c* of the voltage reference circuit 12. Thus, the voltage supplied to the back gate of the first transistor by the voltage reference circuit 12 can be controlled such that the threshold voltage of the first transistor converges to the same voltage as the output voltage of the selection circuit 13.

The amplifier 18 can convert a signal of the negative voltage generated by the charge pump circuit 16*d* into a low-impedance output signal and output it. An output of the amplifier 18 is supplied to the gate driver 25, the pixel 26*a*, or the like.

For example, in the case where a transistor including a metal oxide in a semiconductor layer is used for the gate driver, the pixel of the display device, or the like, the threshold voltage of the transistor can be controlled by a signal VBG which is output as a voltage to the back gate of the transistor by the semiconductor device 10. Therefore, even when the gate driver or the display device is used in an environment with a large temperature change, the threshold voltage of the transistor is adjusted to be the threshold voltage selected by the operation mode control circuit 17 by the signal VBG supplied to the back gate of the transistor. Thus, the off-state current of the transistor is kept low. Furthermore, data deterioration caused by the use of the memory device in a high-temperature environment and display defects in a pixel which are caused by the use of the display device in a high-temperature environment can be reduced. Furthermore, an increase in power consumption or standby power of the gate driver or the display device used in a high-temperature environment can be suppressed.

Figure 10A:
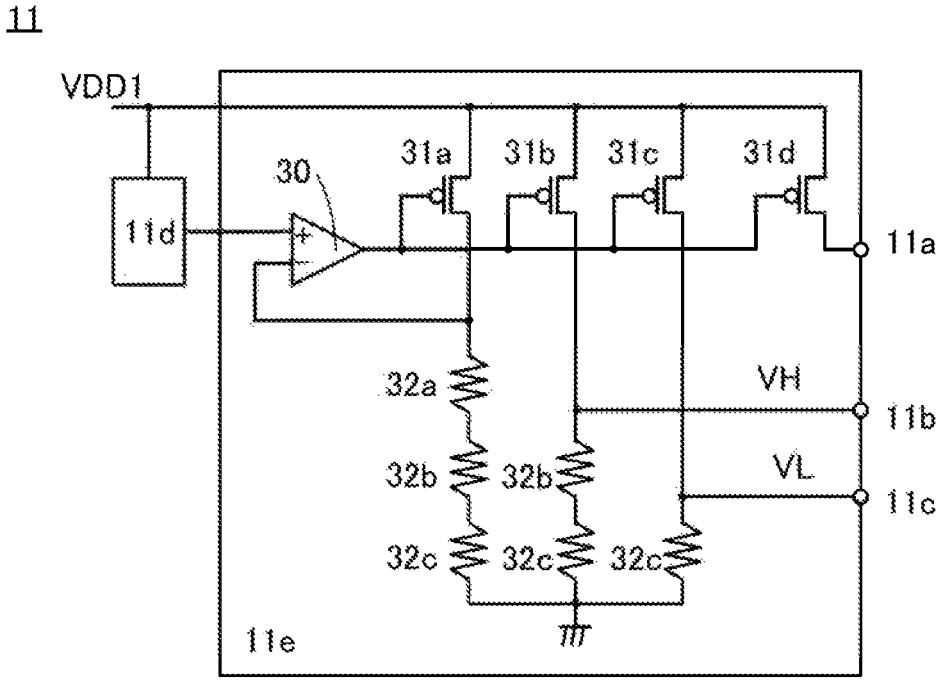
FIGS. 10A-10B are circuit diagrams illustrating structure examples of semiconductor devices.

FIG. 10(A) is a circuit diagram illustrating a structure example of the band gap reference circuit 11. The band gap reference circuit 11 includes a band gap reference circuit 11*d* and a reference voltage current generation circuit 11*e*. The band gap reference circuit 11*d* can output a given voltage to an output terminal. For example, a known circuit may be used as the band gap reference circuit 11*d*. The given voltage is preferably set to the threshold voltage of the first transistor at normal temperature (25° C.), for example. Note that the given voltage is not limited, and is preferably set in accordance with the usage environment of the gate driver, the display device, the electronic device, or the like.

The reference voltage current generation circuit 11*e* includes an amplifier 30, transistors 31*a* to 31*d*, and resistors 32*a* to 32*c*. The transistors 31*a* to 31*d* are preferably p-channel transistors. The amplifier 30 preferably has a voltage follower connection. The output terminal of the band gap reference circuit 11*d* is electrically connected to a non-inverting input terminal of the amplifier 30. An output terminal of the amplifier 30 is electrically connected to an inverting input terminal.

The output terminal of the amplifier 30 is electrically connected to a gate of each of the transistors 31*a* to 31*d*. A source of each of the transistors 31*a* to 31*d* is connected to a wiring VDD1 so that a current mirror circuit is formed. A drain of the transistor 31*a* is electrically connected to the resistors 32*a* to 32*c* connected in series. A drain of the transistor 31*b* is electrically connected to the resistors 32*b* and 32*c* connected in series. A drain of the transistor 31*c* is electrically connected to the resistor 32*c*. Note that the current mirror circuit may be formed using n-channel transistors.

The transistors 31*a* to 31*d* preferably have the same channel length. Furthermore, when the transistors 31*a* to 31*c* have the same channel width, the amounts of current flowing through the transistors 31*a* to 31*c* can be the same. Thus, a given voltage can be easily generated by changing the resistance value.

As an example, a reference voltage can be generated when the transistor 31*a* allows current to flow through the resistors 32*a* to 32*c* connected in series. When the reference voltage is supplied to the inverting input terminal, the amplifier 30 functions as a voltage follower. As another example, the first potential can be generated when the transistor 31*b* allows current to flow through the resistors 32*b* and 32*c* connected in series. The first potential is output to the output terminal 11*b*. Furthermore, as another example, the second potential can be generated when the transistor 31*c* allows current to flow through the resistor 32*c*. The second potential is output to the output terminal 11*c*.

The reference voltage current generation circuit lle includes the transistor 31*d* that generates the first current. Note that the channel width of the transistor 31*d* may be the same as or different from those of the transistors 31*a* to 31*c*. The first current flowing through the transistor 31*d* is output to the output terminal 11*a*.

Thus, an example is shown in which the reference voltage current generation circuit 11*e* outputs a second voltage and a first voltage higher than the second voltage. As another example, the threshold voltage of the first transistor may be controlled more finely by increasing the number of stages of the current mirror and setting combinations of resistors more finely.

Figure 10B:
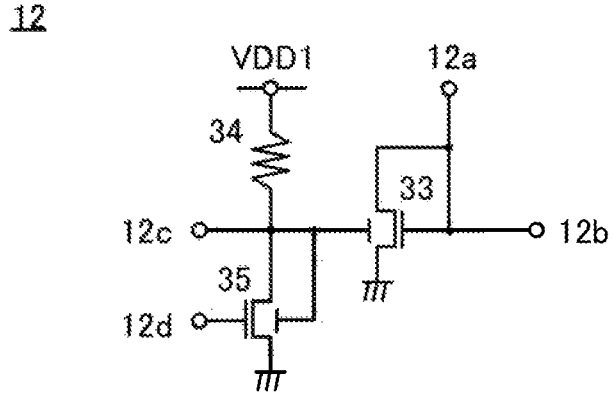

FIG. 10(B) is a circuit diagram illustrating a structure of the voltage reference circuit 12. The voltage reference circuit 12 includes a transistor 33, a resistor 34, and a transistor 35. The transistor 33 and the transistor 35 each include a metal oxide in a semiconductor layer. The transistor 33 corresponds to the first transistor included in the voltage reference circuit 12 illustrated in FIG. 9.

A drain and a gate of the transistor 33 are electrically connected to the input terminal 12*a* and the output terminal 12*b*. A source of the transistor 33 is electrically connected to a wiring GND. A back gate of the transistor 33 is electrically connected to one electrode of the resistor 34, one of a source and a drain of the transistor 35, a back gate of the transistor 35, and the input terminal 12*c*. The other electrode of the resistor 34 is electrically connected to the wiring VDD1. The other of the source and the drain of the transistor 35 is electrically connected to the wiring GND. Note that a potential supplied to the wiring GND is a low potential for operating the shift register circuit 25*a* and is not limited to 0 V.

The first current is supplied to the drain and the gate of the transistor 33 through the input terminal 12*a*. Thus, the threshold voltage of the transistor 33 is output to the output terminal 12*b*. It is known that the threshold voltage of the transistor 33 is shifted by a voltage supplied to the back gate of the transistor 33. Thus, when a negative voltage generated by the charge pump circuit 16*d* is supplied to the back gate of the transistor 33 through the input terminal 12*c*, a feedback loop with the transistor 33 as a center is formed. When a selection voltage selected in accordance with the temperature detected by the operation mode control circuit 17 is the same as the output voltage of the output terminal 12*b* of the voltage reference circuit 12, the feedback adjustment converges in the selection circuit 13 and the adjustment ends.

The transistor 35 can initialize the back gate potential of the transistor 33. The resistor 34 can generate the back gate potential of the transistor 33 using a voltage supplied to the wiring VDD1 as reference. A capacitor, a diode, or the like may be used instead of the resistor 34. The negative voltage generation circuit 16 described later is preferably capable of finely adjusting a negative voltage supplied to the back gate of the transistor 33, because the negative voltage is generated with the use of the charge pump circuit 16*d*. Consequently, when current flows through a resistor, the negative voltage supplied to the back gate of the transistor 33 can be finely adjusted.

Figure 11:
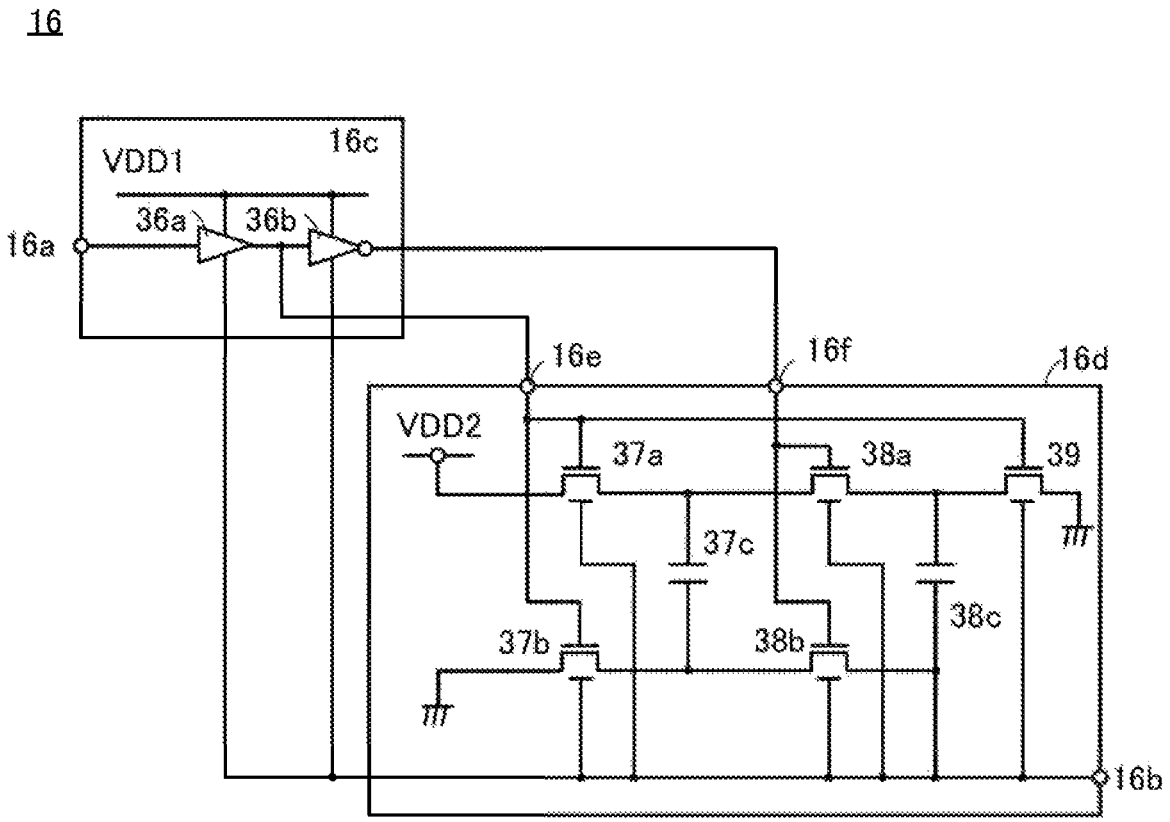
FIG. 11 is a circuit diagram illustrating a structure example of a semiconductor device.

FIG. 11 is a circuit diagram illustrating a structure of the negative voltage generation circuit 16. The negative voltage generation circuit 16 includes the input terminal 16*a*, the output terminal 16*b*, the level shifter circuit 16*c*, and the charge pump circuit 16*d*. The level shifter circuit 16*c* includes a level shifter 36*a* and a level shifter 36*b*. The level shifter circuit 16*c* can adjust the amplitude voltage of a signal to be supplied to the charge pump circuit 16*d*. For example, the level shifter 36*a* can extend a voltage to a positive voltage side. For example, the level shifter 36*b* can extend a voltage to a negative voltage side. For example, the voltage supplied to the wiring VDD1 is the maximum voltage on the positive voltage side. For example, the negative voltage generated by the charge pump circuit 16*d* is the minimum voltage on the negative voltage side. Note that the level shifter circuit 16*c* may be formed in the display device 26.

The input frequency is supplied to the level shifter circuit 16*c* through the input terminal 16*a*. The level shifter 36*a* can generate a positive-phase signal supplied to the charge pump circuit 16*d* and the level shifter 36*b* can generate an inverted signal supplied to the charge pump circuit 16*d*.

The charge pump circuit 16*d* includes a transistor 37*a*, a transistor 37*b*, a capacitor 37*c*, a transistor 38*a*, a transistor 38*b*, a capacitor 38*c*, a transistor 39, an input terminal 16*e*, an input terminal 16*f*, the output terminal 16*b*, a wiring VDD2, and the wiring GND. Note that the transistor 37*a*, the transistor 37*b*, the transistor 38*a*, the transistor 38*b*, and the transistor 39 each preferably include a metal oxide in a semiconductor layer.

The input terminal 16*e* is electrically connected to a gate of the transistor 37*a*, a gate of the transistor 37*b*, and a gate of the transistor 39. The input terminal 16*f* is electrically connected to a gate of the transistor 38*a* and a gate of the transistor 38*b*. The wiring VDD2 is electrically connected to one of a source and a drain of the transistor 37*a*. The wiring GND is electrically connected to one of a source and a drain of the transistor 37*b*. The other of the source and the drain of the transistor 37*a* is electrically connected to one of a source and a drain of the transistor 38*a* and one electrode of the capacitor 37*c*. The other of the source and the drain of the transistor 37*b* is electrically connected to one of a source and a drain of the transistor 38*b* and the other electrode of the capacitor 37*c*. The other of the source and the drain of the transistor 38*a* is electrically connected to one of a source and a drain of the transistor 39 and one electrode of the capacitor 38*c*. The other of the source and the drain of the transistor 39 is electrically connected to the wiring GND. The other of the source and the drain of the transistor 38*b* is electrically connected to the output terminal 16*b*, the level shifter 36*a*, the level shifter 36*b*, the other electrode of the capacitor 38*c*, and a back gate of each of the transistor 37*a*, the transistor 37*b*, the transistor 38*a*, the transistor 38*b*, and the transistor 39.

A positive voltage is supplied to the wiring VDD2. A voltage lower than the positive voltage supplied to the wiring VDD2 is supplied to the wiring GND. Note that a reference potential of the circuit is preferably supplied to the wiring GND. Hereinafter, the case where 0 V that is a ground potential is supplied is described as an example. The voltage supplied to the wiring VDD2 is preferably lower than or equal to the voltage supplied to the wiring VDD1. Furthermore, the voltage supplied to the wiring VDD2 is preferably lower than the voltage supplied to the wiring VDD1.

An output of the level shifter 36*a* brings the transistor 37*a*, the transistor 37*b*, and the transistor 39 into an on state. In this case, an output of the level shifter 36*b* is in an inverted state of the output of the level shifter 36*a*, and thus the transistor 38*a* and the transistor 38*b* are brought into an off state. Thus, a positive voltage is supplied to the one electrode of the capacitor 37*c* from the wiring VDD2, and 0 V is supplied to the other electrode of the capacitor 37*c* from the wiring GND, for example. Thus, a voltage corresponding to a potential difference between the wiring VDD2 and 0V is held in the capacitor 37*c*.

Next, the output of the level shifter 36*a* is inverted, and the transistor 37*a*, the transistor 37*b*, and the transistor 39 are brought into an off state. In this case, the output of the level shifter 36*b* is in an inverted state of the output of the level shifter 36*a*, and the transistor 38*a* and the transistor 38*b* are brought into an on state. Thus, the capacitor 37*c* and the capacitor 38*c* form a combined capacitor, and the voltage held in the capacitor 37*c* becomes a smoothed potential. In this case, a node formed by the other electrode of the capacitor 37*c* and the other electrode of the capacitor 38*c* through the transistor 38*b* is a floating node, and thus a potential of the floating node is a reference potential of the smoothed potential.

Next, the output of the level shifter 36*a* brings the transistor 37*a*, the transistor 37*b*, and the transistor 39 into an on state. In this case, the output of the level shifter 36*b* is in an inverted state of the output of the level shifter 36*a*, and the transistor 38*a* and the transistor 38*b* are brought into an off state.

Here, the capacitor 38*c* is focused on and described. The smoothed potential is held in the capacitor 38*c*. Then, in the case where the potential of the one electrode of the capacitor 38*c* is changed to 0 V supplied to the wiring GND, the potential of the one electrode of the capacitor 38*c* becomes a reference potential, and the smoothed potential is generated as a negative voltage in the other electrode of the capacitor 38*c*.

The generated negative voltage is supplied to the output terminal 16*b*, and further supplied to the back gate of each of the transistor 37*a*, the transistor 37*b*, the transistor 38*a*, the transistor 38*b*, and the transistor 39. Furthermore, the generated negative voltage is supplied as negative power supply of the level shifter 36*a* and the level shifter 36*b*.

As described above, by using the semiconductor device 10 described in this embodiment, a semiconductor device can be provided in which the threshold voltages of transistors are controlled by a feedback loop in accordance with the usage environment of a gate driver, a display device, an electronic device, or the like, and data can be held without being influenced by temperature change. Furthermore, an increase in power consumption can be suppressed.

<<Gate driver 25>>

Figure 12:
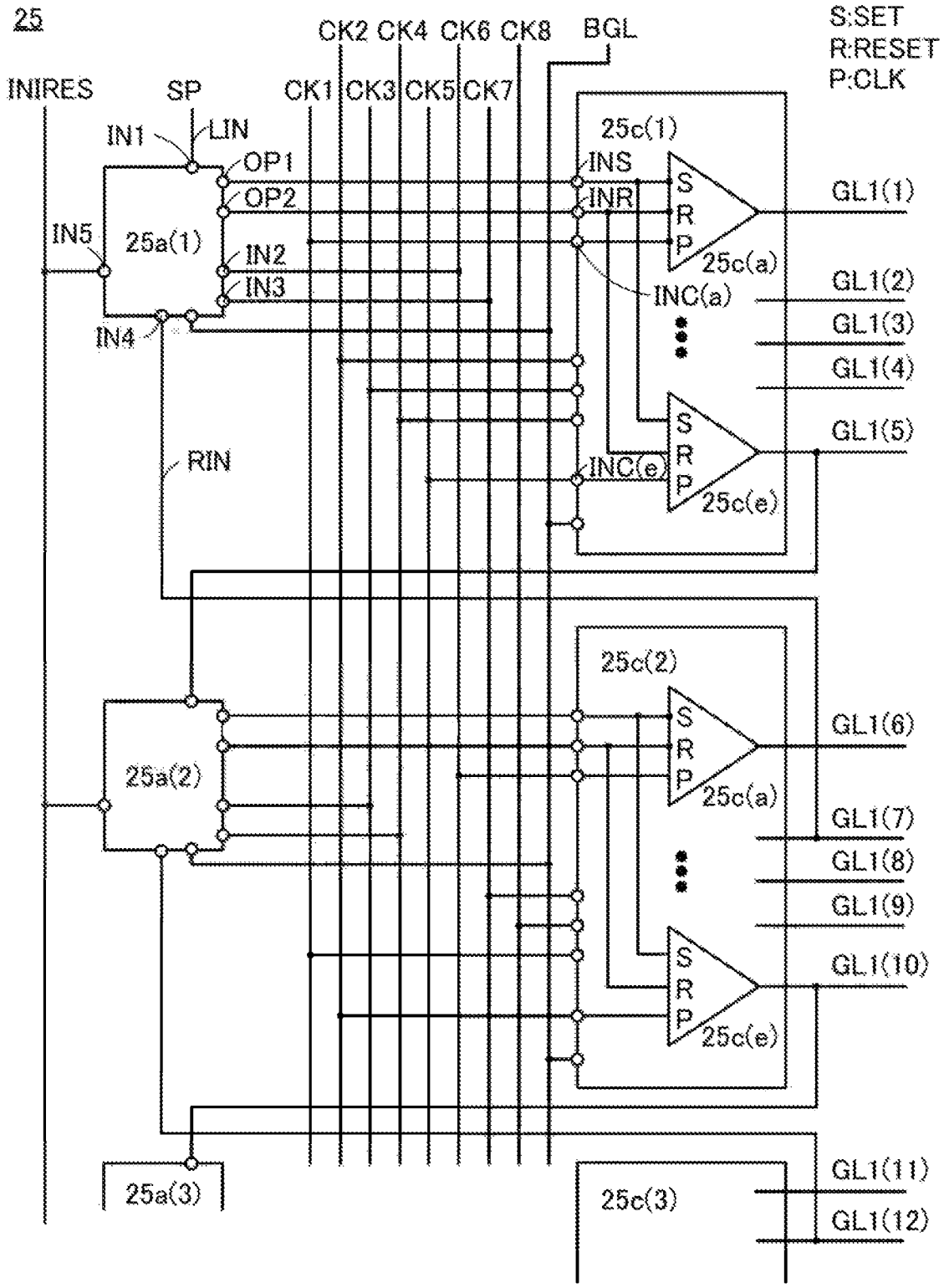
FIG. 12 is a circuit diagram illustrating a structure example of a semiconductor device.

FIG. 12 is a circuit diagram illustrating a structure example of a gate driver of one embodiment of the present invention. The gate driver 25 includes a plurality of shift register circuits 25*a*, a plurality of buffer circuits 25*c*, a wiring INIRES, a wiring SP, a wiring CK1 to a wiring CK8, and a wiring BGL. As an example, the shift register circuit 25*a* generating the first scan signal and the buffer circuit 25*c* are described.

With the gate driver 25 illustrated in FIG. 12, as an example, a shift register circuit 25*a*(1) and a buffer circuit 25*c*(1) are described. The shift register circuit 25*a*(1) includes an output terminal OP1, an output terminal OP2, and an input terminal IN1 to an input terminal IN5. The buffer circuit 25*c*(1) includes an input terminal INS, an input terminal INR, an input terminal INC(a) to an input terminal INC(e), and a buffer circuit 25*c*(*a*) to a buffer circuit 25*c*(*e*).

The input terminal IN1 of the shift register circuit 25*a*(1) is electrically connected to a wiring LIN to which a start pulse SP1 is supplied through the wiring SP. The input terminal IN2 of the shift register circuit 25*a*(1) is electrically connected to the wiring CK6 supplied with a sixth clock signal. The input terminal IN3 of the shift register circuit 25*a*(1) is electrically connected to the wiring CK7 supplied with a seventh clock signal. The input terminal IN4 of the shift register circuit 25*a*(1) is electrically connected to a wiring RIN supplied with a return signal. The input terminal IN5 of the shift register circuit 25*a*(1) is electrically connected to the wiring INIRES supplied with an initialization signal.

The output terminal OP1 is supplied with a selection signal SET and is electrically connected to the input terminal INS of the buffer circuit 25*c*(1). The output terminal OP2 is supplied with a non-selection signal RESET and is electrically connected to the input terminal INR of the buffer circuit 25*c*(1). The wiring CK1 to the wiring CK5 are electrically connected to the input terminal INC(a) to the input terminal INC(e), respectively. The wiring BGL is electrically connected to the shift register circuit 25*a*(1) and the buffer circuit 25*c*(1).

Figure 13A:
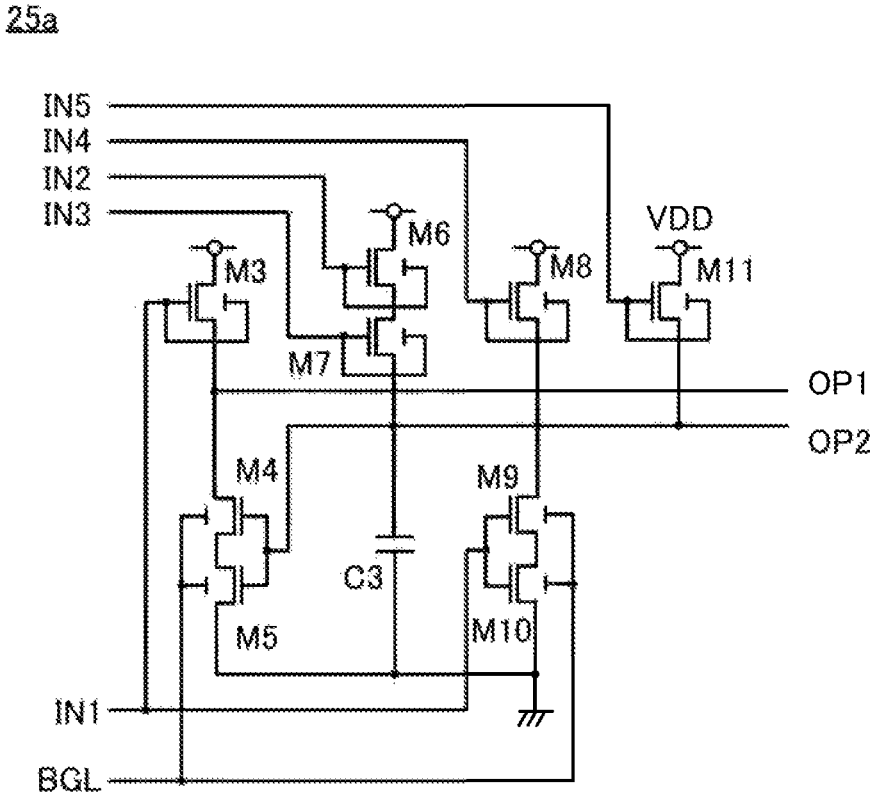
FIGS. 13A-13C are circuit diagrams each illustrating a structure example of a semiconductor device.

Next, a structure example of the shift register circuit 25*a* is described with reference to a circuit diagram in FIG. 13(A). The shift register circuit 25*a* includes a transistor M3 to a transistor M11, a capacitor C3, a wiring VDD, and the wiring GND. Note that a potential supplied to the wiring VDD is a high potential for operating the shift register circuit 25*a*, and a potential supplied to the wiring GND is a low potential for operating the shift register circuit 25*a* and is not limited to 0 V.

The input terminal IN1 is electrically connected to a gate of the transistor M3, a gate of the transistor M9, and a gate of the transistor M10. The input terminal IN2 is electrically connected to a gate of the transistor M6. The input terminal IN3 is electrically connected to a gate of the transistor M7. The input terminal IN4 is electrically connected to a gate of the transistor M8. The input terminal INS is electrically connected to a gate of the transistor M11.

The output terminal OP1 is electrically connected to one of a source and a drain of the transistor M3 and one of a source and a drain of the transistor M4. The output terminal OP2 is electrically connected to a gate of the transistor M4, a gate of the transistor M5, one of a source and a drain of the transistor M7, one of a source and a drain of the transistor M8, one of a source and a drain of the transistor M11, and one electrode of the capacitor C3.

The wiring VDD is electrically connected to the other of the source and the drain of the transistor M3, one of a source and a drain of the transistor M6, the other of the source and the drain of the transistor M8, and the other of the source and the drain of the transistor M11. The wiring GND is electrically connected to one of a source and a drain of the transistor M5, one of a source and a drain of the transistor M10, and the other electrode of the capacitor C3.

The other of the source and the drain of the transistor M4 is electrically connected to the other of the source and the drain of the transistor M5. The other of the source and the drain of the transistor M6 is electrically connected to the other of the source and the drain of the transistor M7. One of a source and a drain of the transistor M9 is electrically connected to the other of the source and the drain of the transistor M10.

Back gates of the transistor M3, the transistor M6, the transistor M7, the transistor M8, and the transistor M11 are electrically connected to respective gates. Back gates of the transistor M4, the transistor M5, the transistor M9, and the transistor M10 are electrically connected to the wiring BGL.

When a signal VBG supplied to the wiring BGL is supplied to the back gates of the transistor M4, the transistor M5, the transistor M9, and the transistor M10, an increase in off-state current can be suppressed.

Figure 13B:
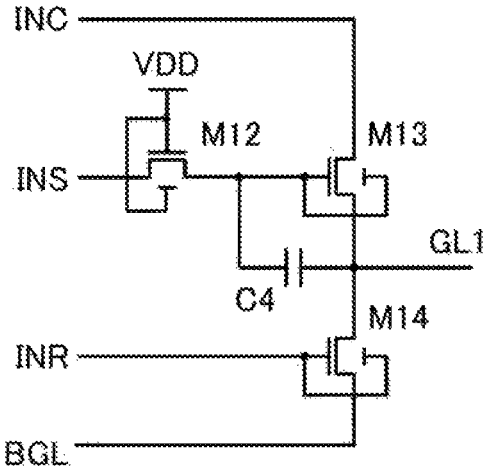

Next, a structure example of the buffer circuit 25*c*(*a*) is described as an example with reference to a circuit diagram in FIG. 13(B). The buffer circuit 25*c*(*a*) illustrated in FIG. 13(B) includes a transistor M12, a transistor M13, a transistor M14, and a capacitor C4.

A gate of the transistor M12 is electrically connected to the wiring VDD. One of a source and a drain of the transistor M12 is electrically connected to the input terminal INS. The other of the source and the drain of the transistor M12 is electrically connected to a gate of the transistor M13 and one electrode of the capacitor C4. One of a source and a drain of the transistor M13 is electrically connected to the input terminal INC. The other of the source and the drain of the transistor M13 is electrically connected to the wiring GL1, one of a source and a drain of the transistor M14, and the other electrode of the capacitor C4. A gate of the transistor M14 is electrically connected to the wiring INR. The other of the source and the drain of the transistor M14 is electrically connected to the wiring BGL. The gates of the transistor M12, the transistor M13, and the transistor M14 are electrically connected to respective back gates.

In the case where the non-selection signal RESET is supplied to the wiring INR, the signal VBG supplied to the wiring BGL is supplied to the wiring GL1 through the transistor M14. Therefore, an increase in off-state current of the transistor M1 can be suppressed by the signal VBG. That is, deterioration of the display data of the pixel 26*a* is suppressed, which enables favorable display to be kept.

Figure 13C:
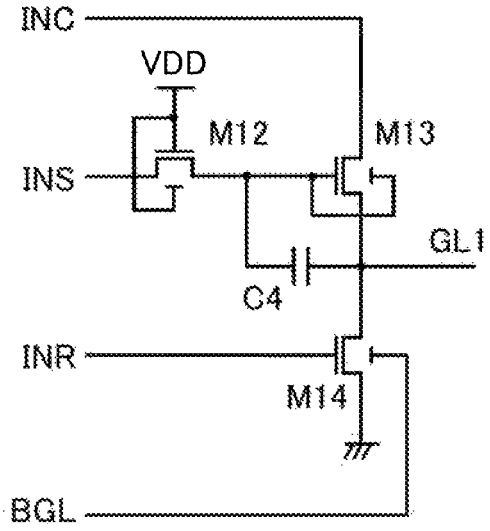

A structure example different from that in FIG. 13(B) is described with reference to a circuit diagram illustrated in FIG. 13(C). In FIG. 13(C), the other of the source and the drain of the transistor M14 is electrically connected to the wiring GND. In addition, the back gate of the transistor M14 is electrically connected to the wiring BGL.

In the case where the transistor M14 is in an off state, the back gate of the transistor M14 is controlled by the signal VBG, whereby an increase in off-state current of the transistor M14 can be suppressed. Therefore, an increase in power consumption of the buffer circuit 25*c* can be suppressed.

Note that FIGS. 13(B) and 13(C) can be implemented in combination as appropriate.

Figure 14A:
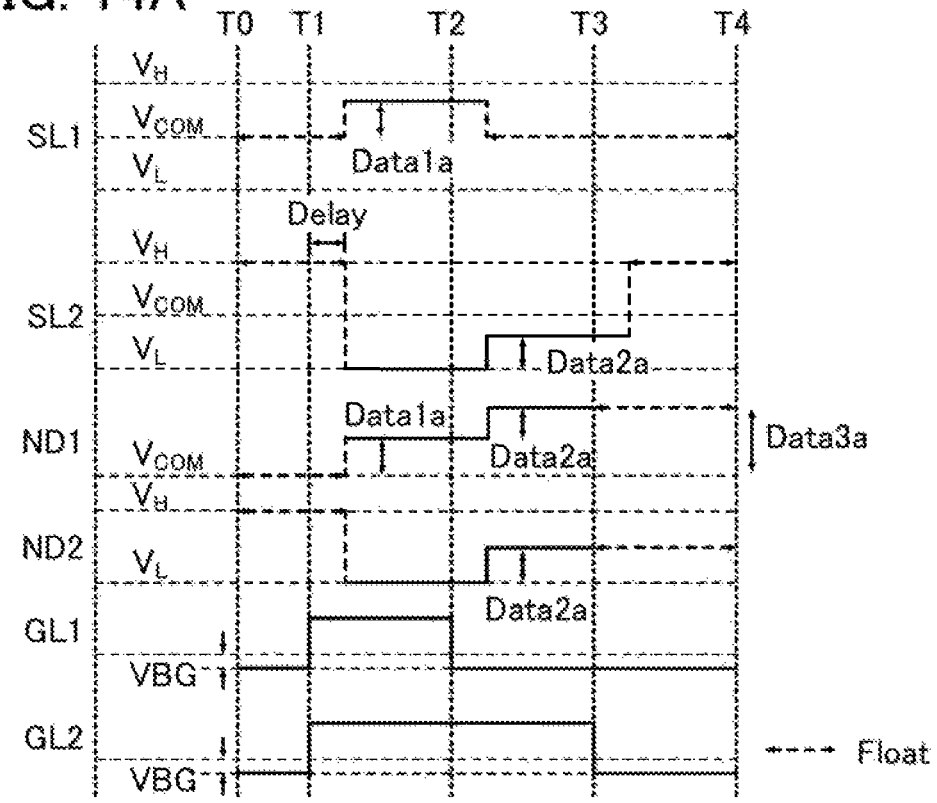
FIGS. 14A-14B are timing charts each showing an operation example of a semiconductor device.
Figure 14B:
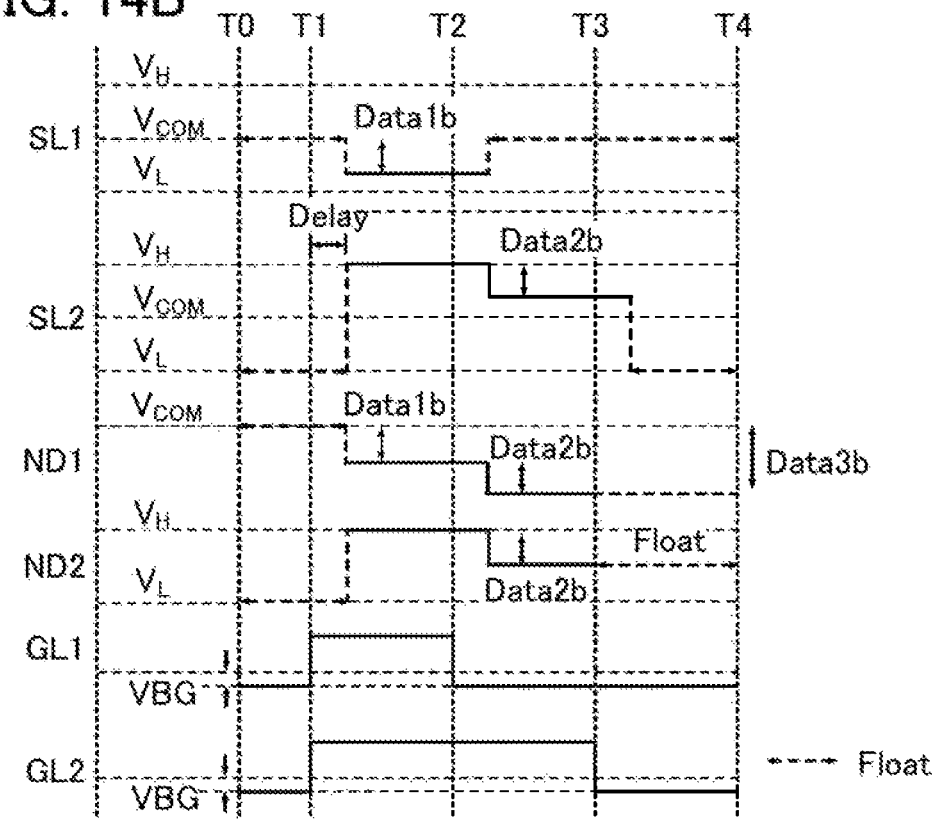

FIG. 14 illustrates timing charts showing operation examples of the semiconductor device 100*b* using the semiconductor device 10. FIG. 14(A) illustrates a timing chart of the case where a positive gray level is set, and FIG. 14(B) illustrates a timing chart of the case where a negative gray level is set.

FIG. 14(A) shows an operation example of the case where the buffer circuit 25*c* of the gate driver 25 has the circuit structure in FIG. 13(C). The semiconductor device 10 can control the low-potential output of the buffer circuit 25*c*. For example, as illustrated in FIG. 13(C), the back gate of the transistor M14 can control the low-potential output of the buffer circuit 25*c* with a signal supplied to the wiring BGL. In other words, the threshold voltage of the transistor M14 is controlled by the signal VBG supplied to the wiring BGL. The signal VBG is controlled to have the same value as the threshold voltage of the transistor M14 by the output voltage of the output terminal 12*b* of the voltage reference circuit 12. This is applicable to the case shown in FIG. 14(A) where a positive gray level is set or the case shown in FIG. 14(B) where a negative gray level is set. Thus, in the semiconductor device 100*b*, depending on the situation such as the case where a transistor including a metal oxide in a semiconductor layer is used in a high-temperature environment, or the case where operation is performed in consideration of variation in the transistor, a potential supplied to a gate of the transistor is controlled and the off state can be kept. Accordingly, display defects can be suppressed and, in addition, an increase in power consumption or the like can be suppressed.

<<Pixel>>

FIG. 15 illustrates circuit diagrams of pixel circuits each having a structure different from that of the pixel 26*a* illustrated in FIG. 2. In each structure, a repeated description is omitted.

FIG. 15(A) illustrates a pixel circuit in which a liquid crystal element is used as a display element. The pixel circuit includes the transistor M1, the transistor M2, the capacitor C1, the capacitor C2, a display element 41, the wiring GL1, the wiring GL2, the wiring SL1, the wiring SL2, the wiring COM, and the wiring BGL. The gate of the transistor M1 is electrically connected to the wiring GL1. The one of the source and the drain of the transistor M1 is electrically connected to the wiring SL1. The other of the source and the drain of the transistor M1 is electrically connected to the one electrode of the capacitor C1, the one electrode of the capacitor C2, and one electrode of the display element 41. The gate of the transistor M2 is electrically connected to the wiring GL2. The one of the source and the drain of the transistor M2 is electrically connected to the wiring SL2. The other of the source and the drain of the transistor M2 is electrically connected to the other electrode of the capacitor C2. The wiring BGL is electrically connected to the back gate of the transistor M1 and the back gate of the transistor M2. The wiring COM is electrically connected to the other electrode of the capacitor C1 and the other electrode of the display element 41. The wiring BGL is preferably commonly connected to pixels arranged in an array.

Note that a display region may be divided into a plurality of display regions, and wirings of the divided display regions may be connected to different wirings BGL. The output voltage VBG of the semiconductor device 10 is supplied to the wiring BGL. When the output voltage VBG is supplied to the wiring BGL, the influence such as characteristics variation or a shift in the threshold voltage of a transistor due to voltage stress or the like can be reduced. Moreover, when the output voltage VBG and a scan signal supplied for bringing the transistor M1 and the transistor M2 into an off state are supplied to the transistor M1 and the transistor M2, the off-state current of the transistor M1 and the transistor M2 can be suppressed from increasing.

FIG. 15(B1) illustrates a pixel circuit using an EL (Electroluminescence) element as the display element. The pixel circuit includes the transistor M1, the transistor M2, a transistor M15, the capacitor C1, the capacitor C2, a display element 42, the wiring GL1, the wiring GL2, the wiring SL1, the wiring SL2, a wiring ANO, and a wiring CATH. The gate of the transistor M1 is electrically connected to the wiring GL1. The one of the source and the drain of the transistor M1 is electrically connected to the wiring SL1. The other of the source and the drain of the transistor M1 is electrically connected to a gate of the transistor M15, the one electrode of the capacitor C1, and the one electrode of the capacitor C2. The gate of the transistor M2 is electrically connected to the wiring GL2. The one of the source and the drain of the transistor M2 is electrically connected to the wiring SL2. The other of the source and the drain of the transistor M2 is electrically connected to the other electrode of the capacitor C2. One of a source and a drain of the transistor M15 is electrically connected to the wiring ANO. The other of the source and the drain of the transistor M15 is electrically connected to the other electrode of the capacitor C1 and the wiring CATH. Back gates of the transistor M1, the transistor M2, and the transistor M15 are electrically connected to the gates of the transistor M1, the transistor M2, and the transistor M15, respectively. When the output voltage VBG and the scan signal supplied for bringing the transistor M1 and the transistor M2 into an off state are supplied to the transistor M1 and the transistor M2, the off-state current of the transistor M1 and the transistor M2 can be suppressed from increasing.

FIG. 15(B2) illustrates a pixel circuit having a structure different from that in FIG. 15(B1). The pixel circuit illustrated in FIG. 15(B2) is different in that a transistor M16, a wiring MN, and a wiring GL3 are further provided. A gate of the transistor M16 is electrically connected to the wiring GL3. One of a source and a drain of the transistor M16 is electrically connected to the wiring MN. The other of the source and the drain of the transistor M16 is electrically connected to the other of the source and the drain of the transistor M15, the other electrode of the capacitor C1, and one electrode of the display element 42. Back gates of the transistor M1, the transistor M2, the transistor M15, and the transistor M16 are electrically connected to respective gates.

In the structure of the pixel circuit of FIG. 15(B2), with the transistor M16, writing of display data of the transistor M15 can be secured. The threshold voltage of the transistor 45 can be read out from the wiring MN through the transistor 48. By setting a change in the threshold voltage of the transistor 45 over time to a correction value, the display data to be written to the pixel can correct a change in the threshold value with the correction value. Moreover, when the output voltage VBG and the scan signal supplied for bringing the transistor M1 and the transistor M2 into an off state are supplied, the off-state current of the transistor M1 and the transistor M2 can be suppressed from increasing.

FIG. 15(B3) illustrates a pixel circuit having a structure different from that in FIG. 15(B1). The pixel circuit illustrated in FIG. 15(B3) is different in that the wiring BGL is electrically connected to the back gate of the transistor M1 and the back gate of the transistor M2. Effects similar to those of FIG. 15(A) can be obtained.

FIG. 15(B4) illustrates a pixel circuit having a structure different from that in FIG. 15(B2). The pixel circuit illustrated in FIG. 15(B4) is different in that the wiring BGL is electrically connected to the back gate of the transistor M1, the back gate of the transistor M2, and the back gate of the transistor M16. Effects similar to those of FIG. 15(A) can be obtained.

Examples of transistors which can be used instead of the transistors described in the above are described with reference to drawings.

The display device 26 can be fabricated using a transistor with any of various structures, such as a bottom-gate transistor or a top-gate transistor. Therefore, a material for a semiconductor layer or the transistor structure can be easily changed depending on the existing production line.

<<Bottom-Gate Tansistor>>

FIG. 16(A1) is a cross-sectional view of a channel-protective transistor 810, which is a type of bottom-gate transistor, in the channel length direction. In FIG. 16(A1), the transistor 810 is formed over a substrate 860. The transistor 810 includes an electrode 858 over the substrate 860 with an insulating layer 861 therebetween. The transistor 810 also includes a semiconductor layer 856 over the electrode 858 with an insulating layer 852 therebetween. The electrode 858 can function as a gate electrode. The insulating layer 852 can function as a gate insulating layer.

The transistor 810 includes an insulating layer 855 over a channel formation region in the semiconductor layer 856. The transistor 810 also includes an electrode 857*a* and an electrode 857*b* which are over the insulating layer 852 and partly in contact with the semiconductor layer 856. The electrode 857*a* can function as one of a source electrode and a drain electrode. The electrode 857*b* can function as the other of the source electrode and the drain electrode. Part of the electrode 857*a* and part of the electrode 857*b* are formed over the insulating layer 855.

The insulating layer 855 can function as a channel protective layer. With the insulating layer 855 provided over the channel formation region, the semiconductor layer 856 can be prevented from being exposed at the time of forming the electrode 857*a* and the electrode 857*b*. Thus, the channel formation region in the semiconductor layer 856 can be prevented from being etched at the time of forming the electrode 857*a* and the electrode 857*b*. According to one embodiment of the present invention, a transistor with favorable electrical characteristics can be provided.

The transistor 810 includes an insulating layer 853 over the electrode 857*a*, the electrode 857*b*, and the insulating layer 855 and also includes an insulating layer 854 over the insulating layer 853.

In the case where an oxide semiconductor is used for the semiconductor layer 856, a material capable of removing oxygen from part of the semiconductor layer 856 to generate oxygen vacancies is preferably used at least for portions of the electrode 857*a* and the electrode 857*b* which are in contact with the semiconductor layer 856. The carrier concentration in the regions of the semiconductor layer 856 where oxygen vacancies are generated is increased, so that the regions become n-type regions (also referred to as $n^+$ regions in some cases). Accordingly, the regions can function as a source region and a drain region. When an oxide semiconductor is used for the semiconductor layer 856, examples of the material capable of removing oxygen from the semiconductor layer 856 to generate oxygen vacancies include tungsten and titanium.

Formation of the source region and the drain region in the semiconductor layer 856 makes it possible to reduce contact resistance between the semiconductor layer 856 and each of the electrode 857*a* and the electrode 857*b*. Accordingly, the electrical characteristics of the transistor, such as the field-effect mobility and the threshold voltage, can be improved.

In the case where a semiconductor such as silicon is used for the semiconductor layer 856, a layer that functions as an n-type semiconductor or a p-type semiconductor is preferably provided between the semiconductor layer 856 and the electrode 857*a* and between the semiconductor layer 856 and the electrode 857*b*. The layer that functions as an n-type semiconductor or a p-type semiconductor can function as the source region or the drain region in the transistor.

The insulating layer 854 is preferably formed using a material that has a function of preventing or reducing diffusion of impurities into the transistor from the outside. Note that the insulating layer 854 can be omitted as necessary.

A transistor 811 shown in FIG. 16(A2) is different from the transistor 810 in that an electrode 850 that can function as a back gate electrode is provided over the insulating layer 854. The electrode 850 can be formed using a material and a method similar to those for the electrode 858.

In general, a back gate electrode is formed using a conductive layer and positioned such that a channel formation region in a semiconductor layer is positioned between a gate electrode and the back gate electrode. Thus, the back gate electrode can function in a manner similar to that of the gate electrode. The potential of the back gate electrode may be the same as the potential of the gate electrode or may be a ground potential (GND potential) or a given potential. When the potential of the back gate electrode is changed independently of the potential of the gate electrode, the threshold voltage of the transistor can be changed. For example, the output voltage of the semiconductor device 10 in FIG. 9 is preferably supplied to the back gate.

The electrode 858 and the electrode 850 can each function as a gate electrode. Thus, the insulating layer 852, the insulating layer 853, and the insulating layer 854 can each function as a gate insulating layer. The electrode 850 may be provided between the insulating layer 853 and the insulating layer 854.

In the case where one of the electrode 858 and the electrode 850 is referred to as a "gate electrode", the other is referred to as a "back gate electrode". For example, in the transistor 811, in the case where the electrode 850 is referred to as a "gate electrode", the electrode 858 is referred to as a "back gate electrode". In the case where the electrode 850 is used as a "gate electrode", the transistor 811 can be regarded as a kind of top-gate transistor. One of the electrode 858 and the electrode 850 may be referred to as a "first gate electrode", and the other may be referred to as a "second gate electrode".

By providing the electrode 858 and the electrode 850 with the semiconductor layer 856 therebetween and setting the potentials of the electrode 858 and the electrode 850 to the same potential, a region of the semiconductor layer 856 through which carriers flow is enlarged in the film thickness direction; thus, the number of transferred carriers is increased. As a result, the on-state current of the transistor 811 is increased and the field-effect mobility is increased.

Therefore, the transistor 811 is a transistor having high on-state current for its occupation area. That is, the occupation area of the transistor 811 can be small for required on-state current. According to one embodiment of the present invention, the occupation area of a transistor can be reduced. Therefore, according to one embodiment of the present invention, a semiconductor device having a high degree of integration can be provided.

The gate electrode and the back gate electrode are formed using conductive layers and thus each have a function of preventing an electric field generated outside the transistor from affecting the semiconductor layer in which the channel is formed (in particular, an electric field blocking function against static electricity and the like). When the back gate electrode is formed larger than the semiconductor layer such that the semiconductor layer is covered with the back gate electrode, the electric field blocking function can be enhanced.

When the back gate electrode is formed using a light-blocking conductive film, light can be prevented from entering the semiconductor layer from the back gate electrode side. Therefore, photodegradation of the semiconductor layer can be prevented, and deterioration in electrical characteristics of the transistor, such as a shift of the threshold voltage, can be prevented.

According to one embodiment of the present invention, a transistor with favorable reliability can be provided. Moreover, a semiconductor device with favorable reliability can be provided.

FIG. 16(B1) is a cross-sectional view of a channel-protective transistor 820, which has a structure different from that of FIG. 16(A1), in the channel length direction. The transistor 820 has substantially the same structure as the transistor 810 but is different from the transistor 810 in that the insulating layer 855 covers end portions of the semiconductor layer 856. The semiconductor layer 856 is electrically connected to the electrode 857*a* through an opening portion formed by selectively removing part of the insulating layer 855 that overlaps with the semiconductor layer 856. The semiconductor layer 856 is electrically connected to the electrode 857*b* through another opening portion formed by selectively removing part of the insulating layer 855 that overlaps with the semiconductor layer 856. A region of the insulating layer 855 that overlaps with the channel formation region can function as a channel protective layer.

A transistor 821 shown in FIG. 16(B2) is different from the transistor 820 in that the electrode 850 that can function as a back gate electrode is provided over the insulating layer 854.

With the insulating layer 855, the semiconductor layer 856 can be prevented from being exposed at the time of forming the electrode 857*a* and the electrode 857*b*. Thus, the semiconductor layer 856 can be prevented from being reduced in thickness at the time of forming the electrode 857*a* and the electrode 857*b*.

The distance between the electrode 857*a* and the electrode 858 and the distance between the electrode 857*b* and the electrode 858 are longer in the transistor 820 and the transistor 821 than in the transistor 810 and the transistor 811. Thus, the parasitic capacitance generated between the electrode 857*a* and the electrode 858 can be reduced. Moreover, the parasitic capacitance generated between the electrode 857*b* and the electrode 858 can be reduced. According to one embodiment of the present invention, a transistor with favorable electrical characteristics can be provided.

FIG. 16(C1) is a cross-sectional view of a channel-etched transistor 825, which is a type of bottom-gate transistor, in the channel length direction. In the transistor 825, the electrode 857*a* and the electrode 857*b* are formed without the insulating layer 855. Thus, part of the semiconductor layer 856 that is exposed at the time of forming the electrode 857*a* and the electrode 857*b* might be etched. However, since the insulating layer 855 is not provided, the productivity of the transistor can be increased.

A transistor 826 shown in FIG. 16(C2) is different from the transistor 825 in that the electrode 850 that can function as a back gate electrode is provided over the insulating layer 854.

FIGS. 17(A1) to 17(C2) are cross-sectional views of the transistors 810, 811, 820, 821, 825, and 826 in the channel width direction, respectively.

In each of the structures shown in FIGS. 17(B2) and 17(C2), the gate electrode is connected to the back gate electrode, and the gate electrode and the back gate electrode have the same potential. In addition, the semiconductor layer 856 is positioned between the gate electrode and the back gate electrode.

The length of each of the gate electrode and the back gate electrode in the channel width direction is longer than the length of the semiconductor layer 856 in the channel width direction. In the channel width direction, the whole of the semiconductor layer 856 is covered with the gate electrode and the back gate electrode with the insulating layers 852, 855, 853, and 854 positioned therebetween.

In this structure, the semiconductor layer 856 included in the transistor can be electrically surrounded by electric fields of the gate electrode and the back gate electrode.

The transistor device structure in which the semiconductor layer 856 in which the channel formation region is formed is electrically surrounded by electric fields of the gate electrode and the back gate electrode, as in the transistor 821 or the transistor 826, can be referred to as a Surrounded channel (S-channel) structure.

With the S-channel structure, an electric field for inducing a channel can be effectively applied to the semiconductor layer 856 by one or both of the gate electrode and the back gate electrode, which enables the transistor to have an improved current drive capability and high on-state current characteristics. In addition, the transistor can be miniaturized because the on-state current can be increased. The S-channel structure can also increase the mechanical strength of the transistor.

<<Top-Gate Transistor>>

A transistor 842 shown in FIG. 18(A1) is a type of top-gate transistor. The transistor 842 is different from the transistor 810 and the transistor 820 in that the electrode 857*a* and the electrode 857*b* are formed after the insulating layer 854 is formed. The electrode 857*a* and the electrode 857*b* are electrically connected to the semiconductor layer 856 through opening portions formed in the insulating layer 853 and the insulating layer 854.

Part of the insulating layer 852 that does not overlap with the electrode 858 is removed, and an impurity is introduced into the semiconductor layer 856 using the electrode 858 and the remaining insulating layer 852 as masks, so that an impurity region can be formed in the semiconductor layer 856 in a self-aligned manner. The transistor 842 includes a region where the insulating layer 852 extends beyond end portions of the electrode 858. The semiconductor layer 856 in a region into which the impurity is introduced through the insulating layer 852 has a lower impurity concentration than the semiconductor layer 856 in a region into which the impurity is introduced not through the insulating layer 852. An LDD (Lightly Doped Drain) region is formed in the region of the semiconductor layer 856 that does not overlap with the electrode 858.

A transistor 843 shown in FIG. 18(A2) is different from the transistor 842 in that the electrode 850 is included. The transistor 843 includes the electrode 850 that is formed over the substrate 860. The electrode 850 includes a region overlapping with the semiconductor layer 856 with the insulating layer 861 therebetween. The electrode 850 can function as a back gate electrode.

As in a transistor 844 shown in FIG. 18(B1) and a transistor 845 shown in FIG. 18(B2), the insulating layer 852 in a region that does not overlap with the electrode 858 may be completely removed. Alternatively, as in a transistor 846 shown in FIG. 18(C1) and a transistor 847 shown in FIG. 18(C2), the insulating layer 852 may be left.

Also in the transistor 842 to the transistor 847, after the formation of the electrode 858, the impurity is introduced into the semiconductor layer 856 using the electrode 858 as a mask, so that an impurity region can be formed in the semiconductor layer 856 in a self-aligned manner. According to one embodiment of the present invention, a transistor with favorable electrical characteristics can be provided. Furthermore, according to one embodiment of the present invention, a semiconductor device having a high degree of integration can be provided.

FIGS. 19(A1) to 19(C2) are cross-sectional views of the transistors 842, 843, 844, 845, 846, and 847 in the channel width direction, respectively.

The transistor 843, the transistor 845, and the transistor 847 each have the above-described S-channel structure. However, one embodiment of the present invention is not limited to this, and the transistor 843, the transistor 845, and the transistor 847 do not necessarily have the S-channel structure.

Next, a resistor that can be used as the temperature sensor for detecting the temperature information supplied to the operation mode control circuit 17 in FIG. 9 is described with reference to FIG. 20.

Figure 20:
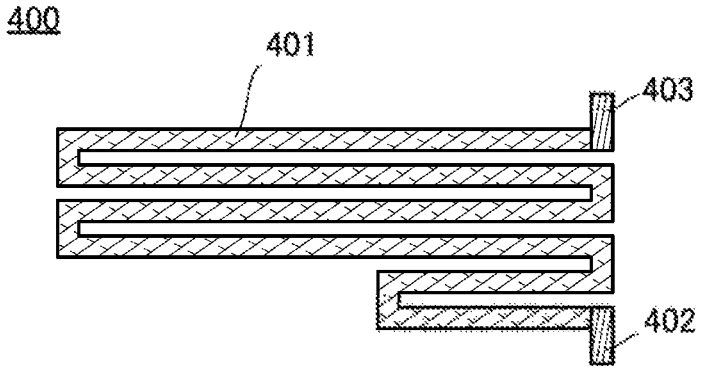
FIG. 20 is a top view illustrating a structure example of a resistor.

FIG. 20 is a top view of a resistor 400. The resistor 400 includes an oxide semiconductor 401, a conductor 402, and a conductor 403. The oxide semiconductor 401 includes a meandering portion in the top view. Note that the oxide semiconductor preferably contains a metal oxide.

The oxide semiconductor 401 has a property in that the resistivity changes with temperature. In the resistor 400, current is fed between the conductor 402 and the conductor 403 and the resistance of the oxide semiconductor 401 is measured, whereby a temperature can be detected.

The oxide semiconductor 401 used for the resistor 400 is formed using the same oxide semiconductor as that of the semiconductor layer 856 used for the transistor. The resistivity of the oxide semiconductor 401 is so high that the oxide semiconductor 401 cannot function satisfactorily as a resistor. Therefore, the oxide semiconductor 401 is preferably subjected to treatment for reducing the resistivity after the oxide semiconductor 401 is etched to have the shape shown in FIG. 20.

An example of the above-described treatment for reducing the resistivity is plasma treatment with a rare gas such as He, Ar, Kr, or Xe. The plasma treatment may be performed using a mixed gas of the rare gas and nitrogen oxide, ammonium, nitrogen, or hydrogen. By the plasma treatment, an oxygen vacancy is formed in the oxide semiconductor 401, so that the resistivity thereof can be reduced.

Another example of the above-described treatment for reducing the resistivity is treatment in which a film containing much hydrogen such as silicon nitride is formed to be in contact with the oxide semiconductor 401. By adding hydrogen to the oxide semiconductor 401, the resistivity thereof can be reduced.

By any of the treatments for reducing the resistivity, the resistivity of the oxide semiconductor 401 at room temperature can be higher than or equal to $1\times10^{-3}$ Ωcm and lower than or equal to $1\times10^{4}$ Ωcm.

This embodiment can be implemented in appropriate combination with any of the other embodiments.

Embodiment 3

In this embodiment, examples of electronic devices each including the semiconductor device, the display device, and/or the memory device described in the above embodiment are described.

In this embodiment, electronic devices each including a display device fabricated using one embodiment of the present invention are described.

Figure 21A:
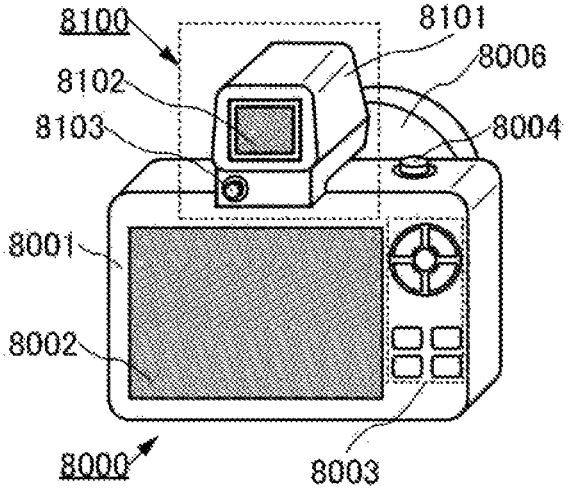
FIGS. 21A-21E are perspective views illustrating examples of electronic devices.

FIG. 21(A) is an external view of a camera 8000 to which a finder 8100 is attached.

The camera 8000 includes a housing 8001, a display portion 8002, operation buttons 8003, a shutter button 8004, and the like. A detachable lens 8006 is attached to the camera 8000.

Although the lens 8006 of the camera 8000 here is detachable from the housing 8001 for replacement, the lens 8006 may be integrated with the housing 8001.

The camera 8000 can take images at the press of the shutter button 8004. The display portion 8002 functions as a touch panel and images can also be taken at the touch of the display portion 8002.

The housing 8001 of the camera 8000 includes a mount including an electrode, so that the finder 8100, a stroboscope, or the like can be connected to the housing.

The finder 8100 includes a housing 8101, a display portion 8102, a button 8103, and the like.

The housing 8101 includes a mount for engagement with the mount of the camera 8000 so that the finder 8100 can be attached to the camera 8000. The mount includes an electrode, and a video or the like received from the camera 8000 through the electrode can be displayed on the display portion 8102.

The button 8103 functions as a power button. The on/off state of the display portion 8102 can be switched with the button 8103.

The display device of one embodiment of the present invention can be used in the display portion 8002 of the camera 8000 and the display portion 8102 of the finder 8100.

Note that although the camera 8000 and the finder 8100 are separate and detachable electronic devices in FIG. 21(A), a finder including a display device may be incorporated in the housing 8001 of the camera 8000.

Figure 21B:
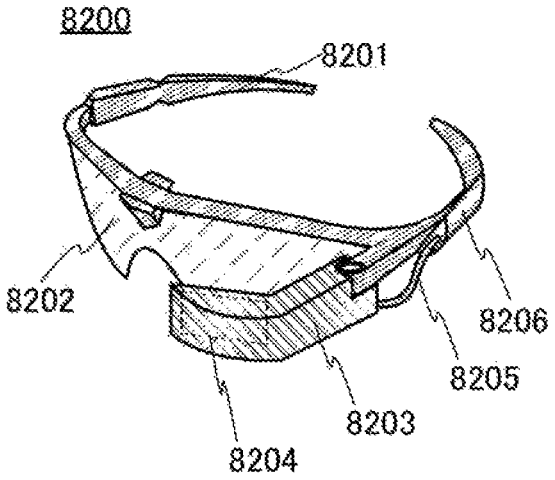

FIG. 21(B) is an external view of a head-mounted display 8200.

The head-mounted display 8200 includes a mounting portion 8201, a lens 8202, a main body 8203, a display portion 8204, a cable 8205, and the like. A battery 8206 is incorporated in the mounting portion 8201.

The cable 8205 supplies electric power from the battery 8206 to the main body 8203. The main body 8203 includes a wireless receiver or the like and can display received video information, such as image data, on the display portion 8204. The movement of the eyeball and the eyelid of a user is captured by a camera provided in the main body 8203 and then coordinates of the sight line of the user are calculated using the information to utilize the sight line of the user as an input means.

A plurality of electrodes may be provided in a portion of the mounting portion 8201 the user touches. The main body 8203 may have a function of sensing current flowing through the electrodes with the movement of the user's eyeball to recognize the user's sight line. The main body 8203 may have a function of sensing current flowing through the electrodes to monitor the user's pulse. The mounting portion 8201 may include various sensors such as a temperature sensor, a pressure sensor, and an acceleration sensor to have a function of displaying the user's biological information on the display portion 8204. The main body 8203 may sense the movement of the user's head or the like to change a video displayed on the display portion 8204 in synchronization with the movement.

The display device of one embodiment of the present invention can be used in the display portion 8204.

Figure 21C:
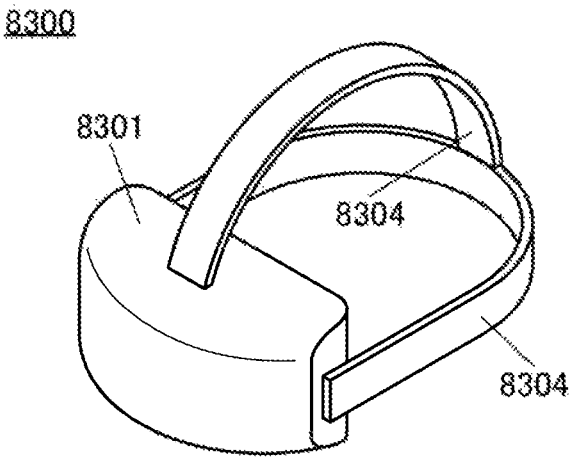
Figure 21D:
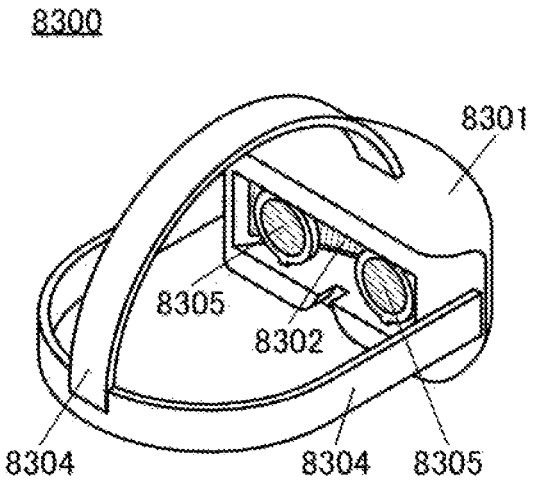
Figure 21E:
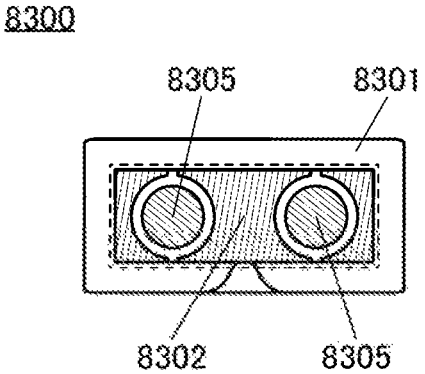

FIGS. 21(C), 21(D), and 21(E) are external views of a head-mounted display 8300. The head-mounted display 8300 includes a housing 8301, a display portion 8302, a band-shaped fixing unit 8304, and a pair of lenses 8305.

A user can see display on the display portion 8302 through the lenses 8305. Note that it is suitable that the display portion 8302 be curved and placed. When the display portion 8302 is curved and placed, a user can feel a high realistic sensation. Note that although the structure in which one display portion 8302 is provided is described in this embodiment as an example, the structure is not limited thereto, and two display portions 8302 may be provided. In that case, one display portion is placed for one eye of the user, so that three-dimensional display using parallax or the like is possible.

Note that the display device of one embodiment of the present invention can be used in the display portion 8302. The display device including the semiconductor device of one embodiment of the present invention has an extremely high resolution; thus, even when a video is magnified by the lenses 8305 as in FIG. 21(E), the user does not perceive pixels, and a more realistic video can be displayed.

Next, FIG. 22(A) to FIG. 22(G) show examples of electronic devices that are different from the electronic devices illustrated in FIG. 21(A) to FIG. 21(E).

Electronic devices illustrated in FIG. 22(A) to FIG. 22(G) include a housing 9000, a display portion 9001, a speaker 9003, an operation key 9005 (including a power switch or an operation switch), a connection terminal 9006, a sensor 9007 (having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared ray), a microphone 9008, and the like.

The electronic devices illustrated in FIG. 22(A) to FIG. 22(G) have a variety of functions. Examples include a function of displaying a variety of information (a still image, a moving image, a text image, and the like) on the display portion, a touch panel function, a function of displaying a calendar, date, time, and the like, a function of controlling processing with a variety of software (programs), a wireless communication function, a function of being connected to a variety of computer networks with a wireless communication function, a function of transmitting and receiving a variety of data with a wireless communication function, and a function of reading out a program or data stored in a memory medium and displaying it on the display portion. Note that functions of the electronic devices illustrated in FIG. 22(A) to FIG. 22(G) are not limited thereto, and the electronic devices can have a variety of functions. Although not illustrated in FIG. 22(A) to FIG. 22(G), the electronic devices may each include a plurality of display portions. The electronic devices may each include a camera and the like and have a function of taking a still image, a function of taking a moving image, a function of storing the taken image in a memory medium (external or incorporated in the camera), a function of displaying the taken image on the display portion, or the like.

The details of the electronic devices illustrated in FIG. 22(A) to FIG. 22(G) are described below.

Figure 22A:
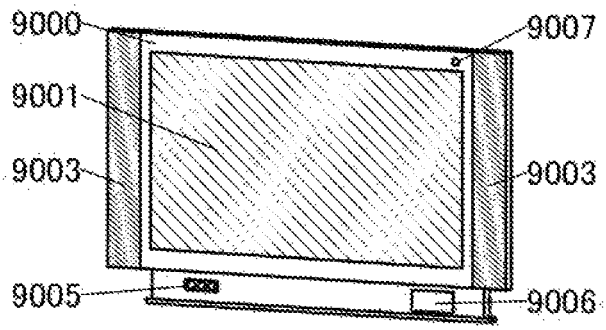
FIGS. 22A-22G are perspective views illustrating examples of electronic devices.

FIG. 22(A) is a perspective view showing a television device 9100. The television device 9100 can include the display portion 9001 having a large screen size of, for example, 50 inches or more, or 100 inches or more.

Figure 22D:
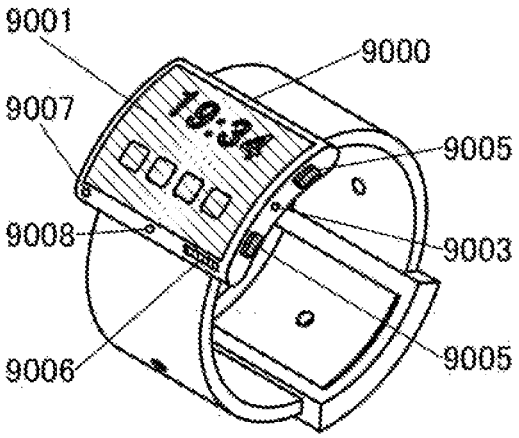
Figure 22B:
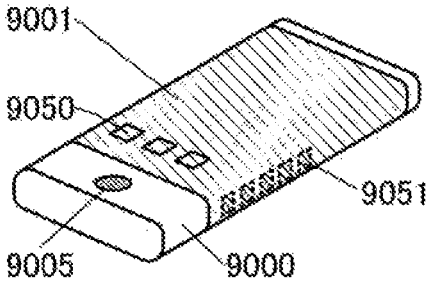

FIG. 22(B) is a perspective view showing a portable information terminal 9101. The portable information terminal 9101 functions as, for example, one or more selected from a telephone set, a notebook, an information browsing device, and the like. Specifically, the portable information terminal 9101 can be used as a smartphone. Note that the speaker 9003, the connection terminal 9006, the sensor 9007, or the like may be provided in the portable information terminal 9101. The portable information terminal 9101 can display characters and image information on its plurality of surfaces. For example, three operation buttons 9050 (also referred to as operation icons, or simply as icons) can be displayed on one surface of the display portion 9001. Information 9051 indicated by dashed rectangles can be displayed on another surface of the display portion 9001. Note that examples of the information 9051 include display indicating reception of an e-mail, an SNS (social networking service), a telephone call, and the like, the title of an e-mail, an SNS, or the like, the sender of an e-mail, an SNS, or the like, date, time, remaining battery, and reception strength of an antenna. Alternatively, the operation buttons 9050 or the like may be displayed on the position where the information 9051 is displayed, in place of the information 9051.

Figure 22E:
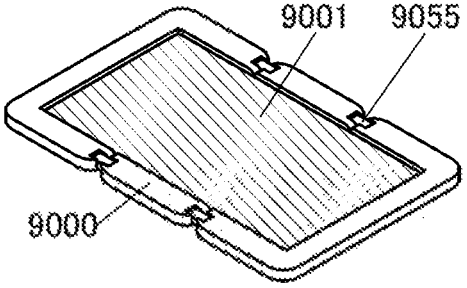
Figure 22F:
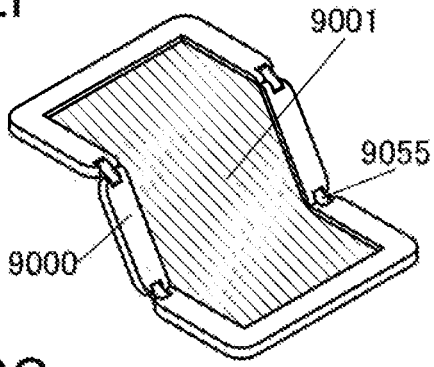
Figure 22C:
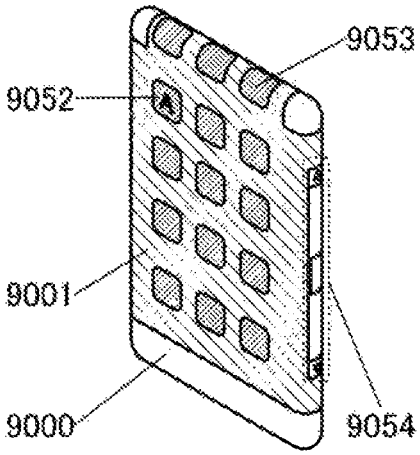

FIG. 22(C) is a perspective view showing a portable information terminal 9102. The portable information terminal 9102 has a function of displaying information on three or more surfaces of the display portion 9001. Here, an example in which information 9052, information 9053, and information 9054 are displayed on different surfaces is shown. For example, a user of the portable information terminal 9102 can see the display (here, the information 9053) with the portable information terminal 9102 put in a breast pocket of the clothes. Specifically, a caller's phone number, name, or the like of an incoming call is displayed in a position that can be seen from above the portable information terminal 9102. The user can see the display without taking out the portable information terminal 9102 from the pocket and decide whether to answer the call.

FIG. 22(D) is a perspective view showing a watch-type portable information terminal 9200. The portable information terminal 9200 is capable of executing a variety of applications such as mobile phone calls, e-mailing, reading and editing texts, music reproduction, Internet communication, and computer games. The display surface of the display portion 9001 is curved and provided, and display can be performed along the curved display surface. The portable information terminal 9200 can execute near field communication conformable to a communication standard. For example, hands-free calling can be achieved by mutual communication with a headset capable of wireless communication. The portable information terminal 9200 includes the connection terminal 9006, and data can be directly transmitted to and received from another information terminal via a connector. Power charging through the connection terminal 9006 is also possible. Note that the charging operation may be performed by wireless power feeding without using the connection terminal 9006.

Figure 22G:
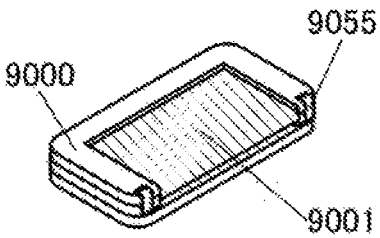

FIGS. 22(E), 22(F), and 22(G) are perspective views showing a foldable portable information terminal 9201. FIG. 22(E) is a perspective view of the portable information terminal 9201 in the opened state, FIG. 22(F) is a perspective view of the portable information terminal 9201 that is shifted from one of the opened state and the folded state to the other, and FIG. 22(G) is a perspective view of the portable information terminal 9201 in the folded state. The portable information terminal 9201 is highly portable in the folded state and is highly browsable in the opened state because of a seamless large display region. The display portion 9001 of the portable information terminal 9201 is supported by three housings 9000 joined by hinges 9055. By being folded at the hinges 9055 between two housings 9000, the portable information terminal 9201 can be reversibly changed in shape from the opened state to the folded state. For example, the portable information terminal 9201 can be bent with a radius of curvature of greater than or equal to 1 mm and less than or equal to 150 mm.

The electronic devices described in this embodiment are characterized by including the display portion for displaying some sort of information. Note that the semiconductor device of one embodiment of the present invention can also be used for an electronic device that does not include a display portion.

At least part of the structure examples, the drawings corresponding thereto, and the like described in this embodiment can be implemented in combination with the other structure examples, the other drawings, and the like as appropriate.

At least part of this embodiment can be implemented in combination with the other embodiments described in this specification as appropriate.

Embodiment 4

In this embodiment, electronic devices of one embodiment of the present invention are described with reference to drawings.

Electronic devices exemplified below include a display device of one embodiment of the present invention in a display portion. Thus, the electronic devices achieve high resolution. In addition, the electronic devices can achieve both high resolution and a large screen.

The display portion of the electronic device of one embodiment of the present invention can display a video with a resolution of, for example, full high definition, 4K2K, 8K4K, 16K8K, or more. In addition, as a screen size of the display portion, the diagonal can be greater than or equal to 20 inches, greater than or equal to 30 inches, greater than or equal to 50 inches, greater than or equal to 60 inches, or greater than or equal to 70 inches.

Examples of the electronic devices include a digital camera, a digital video camera, a digital photo frame, a mobile phone, a portable game console, a portable information terminal, and an audio reproducing device, in addition to electronic devices with a relatively large screen, such as a television device, a desktop or laptop personal computer, a monitor of a computer or the like, digital signage, and a large game machine such as a pachinko machine.

The electronic device of one embodiment of the present invention or a lighting device can be incorporated along a curved inside/outside wall surface of a house or a building or a curved interior/exterior surface of a car.

The electronic device of one embodiment of the present invention may include an antenna. When a signal is received by the antenna, the electronic device can display a video, information, or the like on a display portion. In addition, when the electronic device includes the antenna and a secondary battery, the antenna may be used for contactless power transmission.

The electronic device of one embodiment of the present invention may include a sensor (having a function of measuring force, displacement, position, speed, acceleration, angular velocity, rotational frequency, distance, light, liquid, magnetism, temperature, a chemical substance, sound, time, hardness, electric field, current, voltage, electric power, radioactive rays, flow rate, humidity, gradient, oscillation, odor, or infrared rays).

The electronic device of one embodiment of the present invention can have a variety of functions. For example, it can have a function of displaying a variety of information (a still image, a moving image, a text image, and the like) on the display portion, a touch panel function, a function of displaying a calendar, date, time, and the like, a function of executing a variety of software (programs), a wireless communication function, and a function of reading out a program or data stored in a recording medium.

Figure 23A:
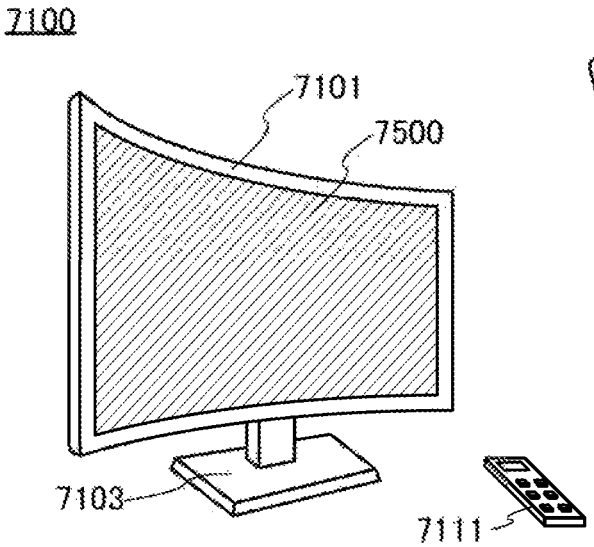
FIGS. 23A-23D are perspective views illustrating examples of electronic devices.

FIG. 23(A) illustrates an example of a television device. In a television device 7100, a display portion 7500 is incorporated in a housing 7101. Here, a structure in which the housing 7101 is supported by a stand 7103 is illustrated.

The display device of one embodiment of the present invention can be used for the display portion 7500.

Operation of the television device 7100 illustrated in FIG. 23(A) can be performed with an operation switch provided in the housing 7101 or a separate remote controller 7111. Alternatively, the display portion 7500 may include a touch sensor, and the television device 7100 may be operated by touch on the display portion 7500 with a finger or the like. The remote controller 7111 may be provided with a display portion for displaying information output from the remote controller 7111. With operation keys or a touch panel provided in the remote controller 7111, channels and volume can be operated and videos displayed on the display portion 7500 can be operated.

Note that the television device 7100 has a structure in which a receiver, a modem, and the like are provided. A general television broadcast can be received with the receiver. In addition, when connected to a communication network with or without wires via the modem, one-way (from a transmitter to a receiver) or two-way (between a transmitter and a receiver or between receivers) data communication can also be performed.

Figure 23B:
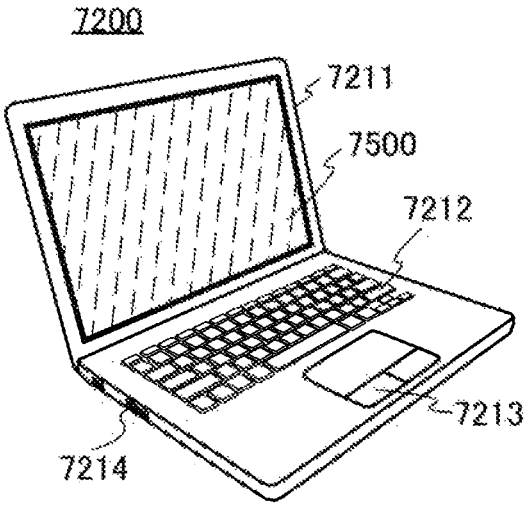

FIG. 23(B) illustrates a laptop personal computer 7200. The laptop personal computer 7200 includes a housing 7211, a keyboard 7212, a pointing device 7213, an external connection port 7214, and the like. In the housing 7211, the display portion 7500 is incorporated.

The display device of one embodiment of the present invention can be used for the display portion 7500.

Figure 23C:
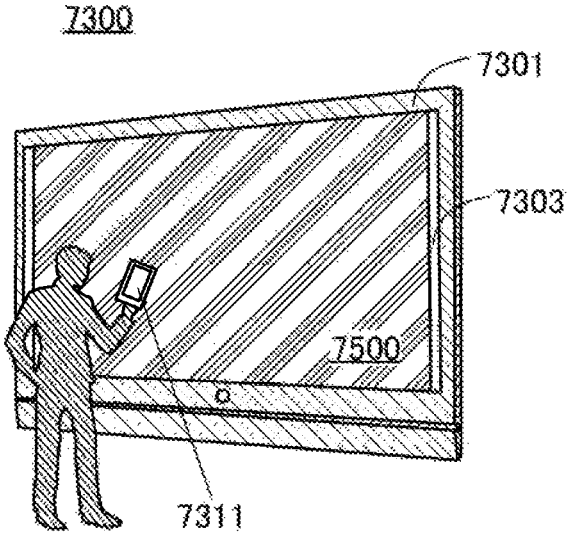
Figure 23D:
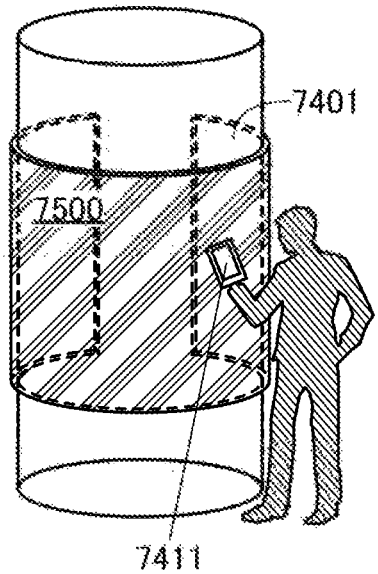

FIGS. 23(C) and 23(D) illustrate examples of digital signage.

Digital signage 7300 illustrated in FIG. 23(C) includes a housing 7301, the display portion 7500, a speaker 7303, and the like. Furthermore, the digital signage can include an LED lamp, operation keys (including a power switch or an operation switch), a connection terminal, a variety of sensors, a microphone, and the like.

FIG. 23(D) is digital signage 7400 attached to a cylindrical pillar 7401. The digital signage 7400 includes the display portion 7500 provided along a curved surface of the pillar 7401.

The display device of one embodiment of the present invention can be used for the display portion 7500 in FIGS. 23(C) and 23(D).

A larger area of the display portion 7500 can increase the amount of information that can be provided at a time. In addition, the larger display portion 7500 attracts more attention, so that the effectiveness of the advertisement can be increased, for example.

It is preferable to use a touch panel for the display portion 7500 because in addition to display of a still image or a moving image on the display portion 7500, intuitive operation by a user is possible. Moreover, for an application for providing information such as route information or traffic information, usability can be enhanced by intuitive operation.

Furthermore, as illustrated in FIGS. 23(C) and 23(D), it is preferable that the digital signage 7300 or the digital signage 7400 work with an information terminal 7311 or an information terminal 7411 such as a smartphone a user has through wireless communication. For example, information of an advertisement displayed on the display portion 7500 can be displayed on a screen of the information terminal 7311 or the information terminal 7411. Moreover, by operation of the information terminal 7311 or the information terminal 7411, a displayed image on the display portion 7500 can be switched.

Furthermore, it is possible to make the digital signage 7300 or the digital signage 7400 execute a game with the use of the screen of the information terminal 7311 or the information terminal 7411 as an operation means (controller). Thus, an unspecified number of users can join in and enjoy the game concurrently.

At least part of this embodiment can be implemented in combination with the other embodiments described in this specification as appropriate.

Embodiment 5

In this embodiment, described is the composition of a CAC (Cloud-Aligned Composite)-OS applicable to the OS transistor described in the above embodiments.

The CAC-OS has, for example, a composition in which elements included in a metal oxide are unevenly distributed. Materials including unevenly distributed elements each have a size of greater than or equal to 0.5 nm and less than or equal to 10 nm, preferably greater than or equal to 1 nm and less than or equal to 2 nm, or a similar size. Note that in the following description of a metal oxide, a state in which one or more metal elements are unevenly distributed and regions including the metal element(s) are mixed is referred to as a mosaic pattern or a patch-like pattern. The regions each have a size of greater than or equal to 0.5 nm and less than or equal to 10 nm, preferably greater than or equal to 1 nm and less than or equal to 2 nm, or a similar size.

Note that a metal oxide preferably contains at least indium. In particular, indium and zinc are preferably contained. In addition, one kind or a plurality of kinds selected from aluminum, gallium, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like may be contained.

For instance, a CAC-OS in an In—Ga—Zn oxide (an In—Ga—Zn oxide in the CAC-OS may be particularly referred to as CAC-IGZO) has a composition in which materials are separated into indium oxide (hereinafter $InO_{X1}$ (X1 is a real number greater than 0)) or indium zinc oxide (hereinafter $In_{X2}Zn_{Y2}O_{Z2}$ (X2, Y2, and Z2 are real numbers greater than 0)) and gallium oxide (hereinafter $GaO_{X3}$ (X3 is a real number greater than 0)) or gallium zinc oxide (hereinafter $Ga_{X4}Zn_{Y4}O_{Z4}$ (X4, Y4, and Z4 are real numbers greater than 0)), for example, so that a mosaic pattern is formed, and mosaic-like $InO_{X1}$ or $In_{X2}Zn_{Y2}O_{Z2}$ is evenly distributed in the film (which is hereinafter also referred to as cloud-like).

That is, the CAC-OS is a composite metal oxide with a composition in which a region including $GaO_{X3}$ as a main component and a region including $In_{X2}Zn_{Y2}O_{Z2}$ or $InO_{X1}$ as a main component are mixed. Note that in this specification, for example, when the atomic ratio of In to an element Min a first region is greater than the atomic ratio of In to an element M in a second region, the first region has higher In concentration than the second region.

Note that IGZO is a common name, which may specify a compound containing In, Ga, Zn, and O. Typical examples of IGZO include a crystalline compound represented by $InGaO_3(ZnO)_{m1}$ (m1 is a natural number) and a crystalline compound represented by $In_{(1+x0)}Ga_{(1-x0)}O_3(ZnO)_{m0}$($-1 \leq x0 \leq 1$; m0 is a given number).

The above crystalline compounds have a single crystal structure, a polycrystalline structure, or a CAAC structure. Note that the CAAC structure is a crystal structure in which a plurality of IGZO nanocrystals have c-axis alignment and are connected in the a-b plane direction without alignment.

On the other hand, the CAC-OS relates to the material composition of a metal oxide. In a material composition of a CAC-OS including In, Ga, Zn, and O, nanoparticle regions including Ga as a main component are observed in part of the CAC-OS and nanoparticle regions including In as a main component are observed in part thereof. These nanoparticle regions are randomly dispersed to form a mosaic pattern. Therefore, the crystal structure is a secondary element for the CAC-OS.

Note that in the CAC-OS, a stacked-layer structure including two or more films with different atomic ratios is not included. For example, a two-layer structure of a film including In as a main component and a film including Ga as a main component is not included.

A boundary between the region including $GaO_{X3}$ as a main component and the region including $In_{X2}Zn_{Y2}O_{Z2}$ or $InO_{X1}$ as a main component is not clearly observed in some cases.

Note that in the case where one kind or a plurality of kinds selected from aluminum, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like are contained instead of gallium, the CAC-OS refers to a composition in which some regions that include the metal element(s) as a main component and are observed as nanoparticles and some regions that include In as a main component and are observed as nanoparticles are randomly dispersed in a mosaic pattern.

The CAC-OS can be formed by a sputtering method under conditions where a substrate is not heated, for example. In the case of forming the CAC-OS by a sputtering method, one or more selected from an inert gas (typically, argon), an oxygen gas, and a nitrogen gas may be used as a deposition gas. The ratio of the flow rate of an oxygen gas to the total flow rate of the deposition gas at the time of deposition is preferably as low as possible, and for example, the flow ratio of an oxygen gas is preferably higher than or equal to 0% and less than 30%, further preferably higher than or equal to 0% and less than or equal to 10%.

The CAC-OS is characterized in that no clear peak is observed in measurement using θ/2θ scan by an Out-of-plane method, which is an X-ray diffraction (XRD) measurement method. That is, X-ray diffraction shows no alignment in the a-b plane direction and the c-axis direction in the measured region.

In an electron diffraction pattern of the CAC-OS which is obtained by irradiation with an electron beam with a probe diameter of 1 nm (also referred to as a nanometer-sized electron beam), a ring-like region with high luminance and a plurality of bright spots in the ring-like region are observed. Therefore, the electron diffraction pattern indicates that the crystal structure of the CAC-OS includes an nc (nano-crystal) structure with no alignment in the plan-view direction and the cross-sectional direction.

Moreover, for example, it can be confirmed by EDX mapping obtained using energy dispersive X-ray spectroscopy (EDX) that the CAC-OS in the In—Ga—Zn oxide has a composition in which regions including $GaO_{x3}$ as a main component and regions including $In_{X2}Zn_{Y2}O_{Z2}$ or $InO_{X1}$ as a main component are unevenly distributed and mixed.

The CAC-OS has a structure different from that of an IGZO compound in which metal elements are evenly distributed, and has characteristics different from those of the IGZO compound. That is, in the CAC-OS, regions including $GaO_{X3}$ or the like as a main component and regions including $In_{X2}Zn_{Y2}O_{Z2}$ or $InO_{X1}$ as a main component are phase-separated from each other and form a mosaic pattern.

The conductivity of a region including $In_{X2}Zn_{Y2}O_{Z2}$ or $InO_{X1}$ as a main component is higher than that of a region including $GaO_{X3}$ or the like as a main component. In other words, when carriers flow through regions including $In_{X2}Zn_{Y2}O_{Z2}$ or $InO_{X1}$ as a main component, the conductivity of a metal oxide is exhibited. Accordingly, when regions including $In_{X2}Zn_{Y2}O_{Z2}$ or $InO_{X1}$ as a main component are distributed in a metal oxide like a cloud, high field-effect mobility (μ) can be achieved.

In contrast, the insulating property of a region including $GaO_{X3}$ or the like as a main component is higher than that of a region including $In_{X2}Zn_{Y2}O_{Z2}$ or $InO_{X1}$ as a main component. In other words, when regions including $GaO_{X3}$ or the like as a main component are distributed in a metal oxide, leakage current can be suppressed and favorable switching operation can be achieved.

Accordingly, when a CAC-OS is used for a semiconductor element, the insulating property derived from $GaO_{X3}$ or the like and the conductivity derived from $In_{X2}Zn_{Y2}O_{Z2}$ or $InO_{X1}$ complement each other, whereby high on-state current ($I_{on}$) and high field-effect mobility (μ) can be achieved.

A semiconductor element including a CAC-OS has high reliability. Thus, the CAC-OS is suitably used in a variety of semiconductor devices typified by a display.

This embodiment can be implemented in appropriate combination with any of the other embodiments.

Unless otherwise specified, an on-state current in this specification refers to a drain current of a transistor in an on state. Unless otherwise specified, the on state (sometimes abbreviated as on) refers to a state where the voltage between its gate and source ($V_G$) is higher than or equal to the threshold voltage ($V_{th}$) in an n-channel transistor, and a state where $V_G$ is lower than or equal to $V_{th}$ in a p-channel transistor. For example, the on-state current of an n-channel transistor refers to a drain current when $V_G$ is higher than or equal to $V_{th}$. Furthermore, the on-state current of a transistor depends on a voltage between a drain and a source ($V_D$) in some cases.

Unless otherwise specified, an off-state current in this specification refers to a drain current of a transistor in an off state. Unless otherwise specified, the off state (sometimes abbreviated as off) refers to a state where $V_G$ is lower than $V_{th}$ in an n-channel transistor, and a state where $V_G$ is higher than $V_{th}$ in a p-channel transistor. For example, the off-state current of an n-channel transistor refers to a drain current when $V_G$ is lower than $V_{th}$. The off-state current of a transistor depends on $V_G$ in some cases. Thus, "the off-state current of a transistor is lower than $10^{-21}$ A" may mean that there is $V_G$ at which the off-state current of the transistor is lower than $10^{-21}$ A.

Furthermore, the off-state current of a transistor depends on $V_D$ in some cases. Unless otherwise specified, the off-state current in this specification may refer to an off-state current at $V_D$ with an absolute value of 0.1 V, 0.8 V, 1 V, 1.2 V, 1.8 V, 2.5 V, 3 V, 3.3 V, 10 V, 12 V, 16 V, or 20 V. Alternatively, the off-state current may refer to an off-state current at $V_D$ used in a semiconductor device or the like including the transistor.

Note that a voltage refers to a potential difference between two points, and a potential refers to electrostatic energy (electric potential energy) of a unit charge at a given point in an electrostatic field. Note that in general, a potential difference between a potential of one point and a reference potential (e.g., a ground potential) is simply called a potential or a voltage, and a potential and a voltage are used as synonymous words in many cases. Therefore, in this specification, a potential may be rephrased as a voltage and a voltage may be rephrased as a potential unless otherwise specified.

In this specification and the like, when there is a description which explicitly states that X and Y are connected, the case where X and Y are electrically connected and the case where X and Y are directly connected are regarded as being disclosed in this specification and the like.

Here, X and Y each denote an object (e.g., a device, an element, a circuit, a wiring, an electrode, a terminal, a conductive film, or a layer).

An example of the case where X and Y are directly connected is the case where X and Y are connected without an element that enables electrical connection between X and Y (e.g., a switch, a transistor, a capacitor, an inductor, a resistor, a diode, a display element, a light-emitting element, or a load).

In an example of the case where X and Y are electrically connected, at least one element that enables electrical connection between X and Y (e.g., a switch, a transistor, a capacitor, an inductor, a resistor, a diode, a display element, a light-emitting element, or a load) can be connected between X and Y. Note that a switch has a function of controlling whether current flows or not by being in a conduction state (an on state) or a non-conduction state (an off state). Alternatively, the switch has a function of selecting and changing a current path. Note that the case where X and Y are electrically connected includes the case where X and Y are directly connected.

Embodiment 6

A semiconductor device that can be used for the frame memory described as an example in the above embodiment is described in this embodiment. The semiconductor device described below as an example can function as a memory device.

In this embodiment, a DOSRAM (registered trademark) is described as an example of a memory device using an oxide semiconductor. The name "DOSRAM" stands for a Dynamic Oxide Semiconductor Random Access Memory. A DOSRAM refers to a memory device in which a memory cell is a 1T1C (one transistor and one capacitor) cell where a writing transistor is a transistor formed using an oxide semiconductor.

A layered structure example of a DOSRAM 1000 is described with reference to FIG. 24. In the DOSRAM 1000, a sense amplifier portion 1002 that performs data reading and a cell array portion 1003 that stores data are stacked.

Figure 24:
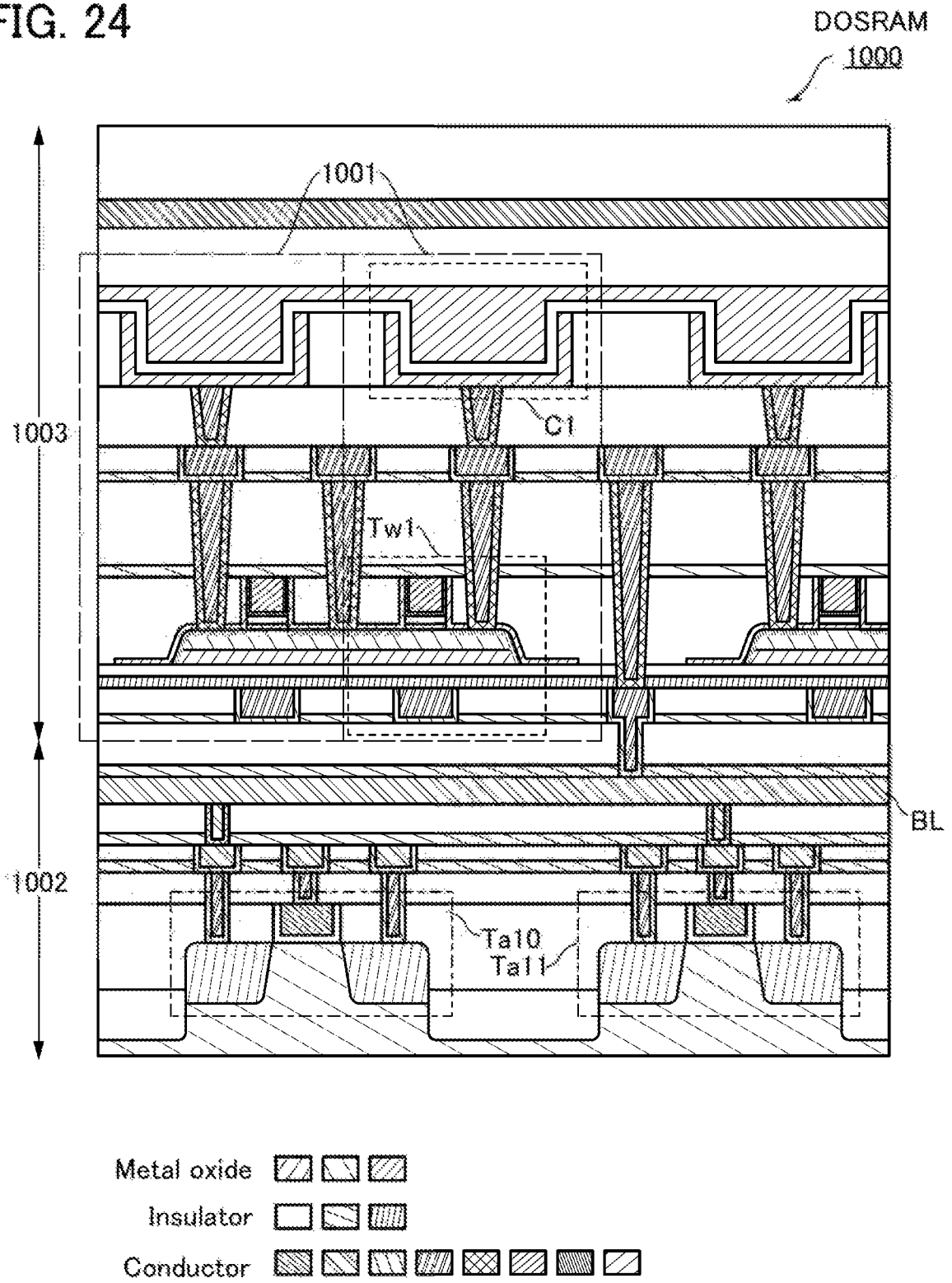
FIG. 24 is a cross-sectional view illustrating a structure example of a DOSRAM.

As illustrated in FIG. 24, a bit line BL and Si transistors Ta10 and Ta11 are provided in the sense amplifier portion 1002. The Si transistors Ta10 and Ta11 have a semiconductor layer in a single crystal silicon wafer. The Si transistors Ta10 and Ta11 constitute the sense amplifier and are electrically connected to the bit line BL.

In the cell array portion 1003, two transistors Tw1 share a semiconductor layer. The semiconductor layer and the bit line BL are electrically connected to each other through a conductor that is not illustrated.

The layered structure illustrated in FIG. 24 can be used for a variety of semiconductor devices formed by stacking a plurality of circuits each including a transistor group.

Metal oxides, insulators, conductors, and the like in FIG. 24 may each be a single layer or a stack of layers. They can be formed by a variety of deposition methods such as a sputtering method, a molecular beam epitaxy method (MBE method), a pulsed laser ablation method (PLA method), a CVD method, and an atomic layer deposition method (ALD method). Examples of the CVD method include a plasma CVD method, a thermal CVD method, and a metal organic CVD method.

Here, the semiconductor layer of the transistor Tw1 is formed using a metal oxide (oxide semiconductor). An example is illustrated in which the semiconductor layer is formed of three metal oxide layers. The semiconductor layer is preferably formed using a metal oxide containing In, Ga, and Zn.

Here, when an element that can form an oxygen vacancy or an element that can be bonded to an oxygen vacancy is added to a metal oxide, the carrier density is increased and the resistance is reduced in some cases. For example, when a semiconductor layer with a metal oxide is selectively reduced in resistance, a source region or a drain region can be provided in the semiconductor layer.

Typical examples of an element that reduces the resistance of a metal oxide include boron and phosphorus. Moreover, hydrogen, carbon, nitrogen, fluorine, sulfur, chlorine, titanium, a rare gas, or the like may be used. Typical examples of the rare gas element include helium, neon, argon, krypton, xenon, and the like. The concentration of the element can be measured by secondary ion mass spectrometry (SIMS) or the like.

In particular, boron and phosphorus are preferably used because an apparatus used in a manufacturing line for amorphous silicon or low-temperature polysilicon can be used. Using the apparatus in the existing production line can reduce capital investment.

The transistor including the semiconductor layer having selectively reduced resistance can be formed using a dummy gate, for example. Specifically, the dummy gate is provided over the semiconductor layer, and an element that reduces the resistance of the semiconductor layer is added to the semiconductor layer using the dummy gate as a mask. That is, the element is added to a region of the semiconductor layer that does not overlap with the dummy gate, so that a low-resistance region is formed. As a method for adding the element, an ion implantation method by which an ionized source gas is subjected to mass separation and then added, an ion doping method by which an ionized source gas is added without mass separation, a plasma immersion ion implantation method, or the like can be used.

Examples of a conductive material used for the conductors include a semiconductor typified by polycrystalline silicon doped with an impurity element such as phosphorus; silicide such as nickel silicide; a metal such as molybdenum, titanium, tantalum, tungsten, aluminum, copper, chromium, neodymium, or scandium; a metal nitride containing the above metal as its component (tantalum nitride, titanium nitride, molybdenum nitride, or tungsten nitride); and the like. A conductive material such as indium tin oxide, indium oxide containing tungsten oxide, indium zinc oxide containing tungsten oxide, indium oxide containing titanium oxide, indium tin oxide containing titanium oxide, indium zinc oxide, or indium tin oxide to which silicon oxide is added can also be used.

Examples of an insulating material used for the insulators include aluminum nitride, aluminum oxide, aluminum nitride oxide, aluminum oxynitride, magnesium oxide, silicon nitride, silicon oxide, silicon nitride oxide, silicon oxynitride, gallium oxide, germanium oxide, yttrium oxide, zirconium oxide, lanthanum oxide, neodymium oxide, hafnium oxide, tantalum oxide, and aluminum silicate. Note that in this specification and the like, an oxynitride refers to a compound whose oxygen content is higher than nitrogen content, and a nitride oxide refers to a compound whose nitrogen content is higher than oxygen content.

REFERENCE NUMERALS

C1: capacitor, C2: capacitor, C3: capacitor, C4: capacitor, CK1: wiring, CK5: wiring, CK6: wiring, CK7: wiring, CK8: wiring, GL1: wiring, GL2: wiring, GL3: wiring, IN1: input terminal, IN2: input terminal, IN3: input terminal, IN4: input terminal, IN5: input terminal, M1: transistor, M2: transistor, M3: transistor, M4: transistor, M5: transistor, M6: transistor, M7: transistor, M8: transistor, M9: transistor, M10: transistor, M11: transistor, M12: transistor, M13: transistor, M14: transistor, M15: transistor, M16: transistor, ND1: node, ND2: node, OP1: output terminal, OP2: output terminal, S1: switch, S2: switch, S3: switch, S4: switch, SL1: wiring, SL2: wiring, VDD1: wiring, VDD2: wiring, 10: semiconductor device, 11: band gap reference circuit, 11*a*: output terminal, 11*b*: output terminal, 11*c*: output terminal, 11*d*: band gap reference circuit, 11*e*: reference voltage current generation circuit, 12: voltage reference circuit, 12*a*: input terminal, 12*b*: output terminal, 12*c*: input terminal, 12*d*: input terminal, 13: selection circuit, 13*a*: input terminal, 13*b*: input terminal, 13*c*: output terminal, 13*d*: input terminal, 14: difference detection circuit, 15: voltage controlled oscillator, 16: negative voltage generation circuit, 16*a*: input terminal, 16*b*: output terminal, 16*c*: level shifter circuit, 16*d*: charge pump circuit, 16*e*: input terminal, 16*f*: input terminal, 17: operation mode control circuit, 18: amplifier, 19: temperature sensor, 20: display device, 21:

control portion, 22: display controller, 23: frame memory, 23*a*: memory device, 23*b*: memory device, 24: source driver, 24*a*: buffer circuit, 24*b*: digital-analog converter circuit, 24*c*: level shifter circuit, 24*d*: latch circuit, 24*e*: switch control circuit, 25: gate driver, 25*a*: shift register circuit, 25*b*: shift register circuit, 25*c*: buffer circuit, 25*d*: buffer circuit, 25*e*: inversion control circuit, 26: display device, 26*a*: pixel, 26*b*: pixel, 26*c*: pixel, 27: CPU, 30: amplifier, 31*a*: transistor, 31*b*: transistor, 31*c*: transistor, 31*d*: transistor, 32*a*: resistor, 32*b*: resistor, 32*c*: resistor, 33: transistor, 34: resistor, 35: transistor, 36*a*: level shifter, 36*b*: level shifter, 37*a*: transistor, 37*b*: transistor, 37*c*: capacitor, 38*a*: transistor, 38*b*: transistor, 38*c*: capacitor, 39: transistor, 41: display element, 42: display element, 45: transistor, 48: transistor, 100: semiconductor device, 100*a*: semiconductor device, 100*b*: semiconductor device.

This application is based on Japanese Patent Application Serial No. 2017-245920 filed with Japan Patent Office on Dec. 22, 2017 and Japanese Patent Application Serial No. 2018-027234 filed with Japan Patent Office on Feb. 19, 2018, the entire contents of which are hereby incorporated herein by reference.

The invention claimed is:

1. A semiconductor device comprising:

a display device;

a source driver;

a first wiring; and a second wiring, wherein the display device comprises a pixel, wherein the source driver comprises a digital-analog converter circuit, a buffer circuit, a first switch, a second switch, a third switch, a fourth switch, and a switch control circuit, wherein the pixel is electrically connected to the first wiring and the second wiring, wherein the digital-analog converter circuit comprises a first output terminal, a second output terminal, and a third output terminal, wherein the first output terminal is electrically connected to a first input terminal included in the buffer circuit, wherein an output terminal of the buffer circuit is electrically connected to one electrode of the third switch, one electrode of the fourth switch, and a second input terminal included in the buffer circuit, wherein the second output terminal is electrically connected to one electrode of the first switch, wherein the third output terminal is electrically connected to one electrode of the second switch, wherein the first wiring is electrically connected to the other electrode of the fourth switch, wherein the second wiring is electrically connected to the other electrode of the first switch, the other electrode of the second switch, and the other electrode of the third switch, wherein the switch control circuit is configured to control the first switch, the second switch, the third switch, and the fourth switch independently, wherein the first output terminal is configured to output a voltage in a range of a first potential to a second potential, wherein the second output terminal is configured to output the first potential, wherein the third output terminal is configured to output the second potential, wherein the pixel comprises a first transistor, a second transistor, a first capacitor, a second capacitor, and a display element, wherein one of a source and a drain of the first transistor is electrically connected to the first wiring, wherein the other of the source and the drain of the first transistor is electrically connected to one electrode of the first capacitor, one electrode of the second capacitor, and one electrode of the display element, wherein one of a source and a drain of the second transistor is electrically connected to the second wiring, and wherein the other of the source and the drain of the second transistor is electrically connected to the other electrode of the second capacitor.

2. An electronic device comprising the semiconductor device according to claim 1, and a temperature sensor.

3. The display device according to claim 1, wherein the display element is a liquid crystal element.

4. The display device according to claim 1, wherein the first transistor or the second transistor comprises a metal oxide in a semiconductor layer.

* * * * *